US009945263B2

(12) United States Patent
Ikegami et al.

(10) Patent No.: US 9,945,263 B2
(45) Date of Patent: Apr. 17, 2018

(54) STEAM POWER CYCLE SYSTEM

(71) Applicant: Saga University, Saga-Shi, Saga (JP)

(72) Inventors: Yasuyuki Ikegami, Saga (JP); Sadayuki Jitsuhara, Tokyo (JP); Taro Watanabe, Tokyo (JP); Shin Okamura, Tokyo (JP)

(73) Assignee: SAGA UNIVERSITY, Saga-Shi (JP)

( * ) Notice: Subject to any disclaimer, the term of this patent is extended or adjusted under 35 U.S.C. 154(b) by 952 days.

(21) Appl. No.: 14/201,406

(22) Filed: Mar. 7, 2014

(65) Prior Publication Data

US 2014/0245737 A1 Sep. 4, 2014

Related U.S. Application Data

(63) Continuation of application No. PCT/JP2012/072850, filed on Sep. 7, 2012.

(30) Foreign Application Priority Data

Sep. 9, 2011 (JP) ..... 2011-197606

(51) Int. Cl.
*F01K 7/12* (2006.01)
*F01K 23/02* (2006.01)
(Continued)

(52) U.S. Cl.
CPC ..... *F01K 7/16* (2013.01); *F01K 23/02* (2013.01); *F01K 25/106* (2013.01); *F28B 1/02* (2013.01);
(Continued)

(58) Field of Classification Search
CPC ..... F01K 23/02; F01K 23/04; F01K 23/06; F01K 23/08; F01K 23/10; F01K 23/106;
(Continued)

(56) References Cited

U.S. PATENT DOCUMENTS 2,998,227 A * 8/1961 Gaston ..... F28B 7/00 165/143
3,795,103 A * 3/1974 Anderson ..... F01K 3/185 60/651
(Continued)

FOREIGN PATENT DOCUMENTS

JP 1975-155436 U 12/1975
JP 52-156246 A 12/1977
(Continued)

OTHER PUBLICATIONS

JP 58-214606 English Translation, Kazumasa, Japan, Pub Date Dec. 13, 1983.*
(Continued)

*Primary Examiner* — Jason Shanske
*Assistant Examiner* — Jessica Kebea
(74) *Attorney, Agent, or Firm* — Duquette Law Group, LLC

(57) ABSTRACT

There is provided a steam power cycle system in which steam power cycles using pure materials as a working fluid is used in a multiple stage to reduce pressure loss in the flow channels in the respective heat exchanger so that the fluid serving as heat sources has been caused to make an effective heat exchange with the working fluid. More specifically, not only that the respective flow channels for the fluid serving as heat sources in the evaporator and the condenser in the respective steam power cycle units are connected in series to each other, but the evaporator and the condenser comprise a cross-flow type heat exchanger and are arranged respectively in a flowing direction of the fluid serving as heat source. Consequently, it is possible to reduce the length of the flow channels to the minimum necessary, simplify the flow channel structure, and reduce the pressure loss.

14 Claims, 19 Drawing Sheets

(51) Int. Cl.

| | |
|---|---|
| ***F01K 25/10*** | (2006.01) |
| ***F28B 1/02*** | (2006.01) |
| ***F28D 1/02*** | (2006.01) |
| ***F28D 1/03*** | (2006.01) |
| ***F28D 21/00*** | (2006.01) |
| ***F01K 7/16*** | (2006.01) |

(52) U.S. Cl.
CPC ..... *F28D 1/022* (2013.01); *F28D 1/0316* (2013.01); *F28D 2021/0063* (2013.01); *F28D 2021/0064* (2013.01); *F28F 2250/106* (2013.01)

(58) Field of Classification Search
CPC ... F01K 7/16; F28D 1/02; F28D 1/022; F28D 1/0316; F28D 2021/0063; F28D 2021/0064; F28F 2250/106
USPC ..... 60/655
See application file for complete search history.

(56) References Cited

U.S. PATENT DOCUMENTS 4,055,145 A * 10/1977 Mager ..... A01K 61/00 119/204
4,700,543 A * 10/1987 Krieger ..... F01K 3/185 60/655
4,827,877 A * 5/1989 Sumitomo ..... F01K 25/06 122/34
5,007,240 A * 4/1991 Ishida ..... F01K 25/065 60/649
5,603,218 A * 2/1997 Hooper ..... F01K 23/04 60/651
5,754,613 A * 5/1998 Hashiguchi ..... F01K 25/065 376/378
7,228,893 B2 * 6/2007 Matsuzaki ..... F28D 9/0037 165/164
7,740,056 B2 * 6/2010 Watanabe ..... F28D 9/0037 165/157
8,899,043 B2 * 12/2014 Krull ..... F03G 7/05 60/641.6
9,016,063 B2 * 4/2015 Gaia ..... F01K 3/18 60/641.2
9,328,634 B2 * 5/2016 Ikegami ..... F01K 25/065
2006/0254758 A1 * 11/2006 Matsuzaki ..... F28F 3/04 165/166
2007/0245560 A1 * 10/2007 Matsuzaki ..... B23K 20/023 29/890.039
2011/0314818 A1 * 12/2011 Breen ..... F01K 25/10 60/676
2013/0160448 A1 * 6/2013 Gaia ..... F01K 25/08 60/651
2015/0000275 A1 * 1/2015 Prueitt ..... F03G 7/05 60/641.7

FOREIGN PATENT DOCUMENTS

JP 55-19985 A 2/1980
JP 56-083504 A 8/1981
JP 57-200607 A 12/1982
JP 58-214606 A 12/1983
JP 05-340342 A 12/1993
JP 2006-250373 A 9/2006
JP 2007278637 A * 10/2007
JP 2011208569 A * 10/2011
WO WO 2014185525 A1 * 11/2014 ..... F25B 29/003

OTHER PUBLICATIONS

International Search Report dated Nov. 20, 2012 from corresponding International Application No. PCT/JP2012/072850 (4 pages).

* cited by examiner

Flow channel of seawater in case where cross-flow type heat exchangers are arranged

* Area of a shaded portion in the figure corresponding to a cross-sectional area of the flow channel of seawater in the heat exchanger (A)

Ideal Rankine cycle (Single stage)

(B)

Ideal Rankine cycle (Dual stage)

Improvement state in heat cycle efficiency by multistage in Rankine cycle
(Shaded portion in the figure: Energy loss)

Flow channel of seawater in case where common plate type heat exchangers are arranged

* Area of a shaded portion in the figure corresponding to a cross-sectional area of the flow channel of seawater in the heat exchanger

STEAM POWER CYCLE SYSTEM

CROSS-REFERENCE TO RELATED APPLICATIONS

This application is a continuation of International Application No. PCT/JP2012/072850, filed Sep. 7, 2012, now pending, which claims priority to Japanese Application No. 2011-197606, filed Sep. 9, 2011, the contents of which are incorporated herein by reference.

TECHNICAL FIELD

The present invention relates to a steam power cycle system that cycles a working fluid, while heating and cooling it, and causes the working fluid repeating a phase change to work, thus obtaining a power, and particularly to a steam power cycle system with a multistage structure in which respective fluids used as a high-temperature heat source and a low-temperature heat source, which are to be caused to make heat exchange with a working fluid, are commonly used in the steam power cycle having the multistage structure.

BACKGROUND ART

As a steam power cycle system that cycles a working fluid, while heating and cooling it, and causes the working fluid repeating a phase change to work, thus obtaining a power, there is generally known a basic type of Rankine cycle that is provided with an evaporator, a turbine, a condenser and a pump, and utilizes water as the working fluid.

However, in order to make a proper phase change of the working fluid to convert effectively heat into power, in case where, in using the steam power cycle as a power generating equipment, etc., a temperature of both a high-temperature heat source and a low-temperature heat source in the steam power cycle is lower than a boiling point of water, in particular, in the application to a power generation apparatus by an ocean thermal energy conversion, and a difference in temperature between the heat sources is small, there has conventionally been proposed a steam power cycle such as Rankine cycle in which a common water is not used, but a fluid such as ammonia having a lower boiling point than water is used as the working fluid, or Kalina cycle in which, there is used, as the working fluid, a mixture medium that has been prepared by mixing water and kinds of fluids having different boiling points from each other so as to make the boiling point of it than water.

Concerning an example of the conventional Rankine cycle using the working fluid having a low boiling point, JP 52-156246 A discloses a power generation apparatus by an ocean thermal energy conversion, and JP 5-340342 A discloses a power generation apparatus by an ocean thermal energy conversion with three cycles. In addition, JP 57-200607 describes an example of a steam power cycle in which the conventional mixture medium is used as the working fluid.

PATENT LITERATURE

[Patent Literature 1] JP 52-156246 A
[Patent Literature 2] JP 5-340342 A
[Patent Literature 3] JP 57-200607 A

SUMMARY

The conventional steam power cycle has a structure as described in each of the patent documents as indicated above. Of these patent documents, the steam power cycle as exemplified in Patent Literature 3 above, in which the conventional mixture medium is used as the working fluid, has an advantage that characteristic properties of change in temperature of the working fluid during a phase change provide a temperature change along with a temperature change on a heat source side in evaporation or condensation of the working fluid, thus improving a heat cycle efficiency in comparison with Rankine cycle using the working fluid of a pure material.

However, due to the use of the mixture medium as the working fluid, an influence on heat transfer between the materials of which the mixture medium is formed may deteriorate the heat transfer performance in the heat exchanger such as the evaporator and the condenser, thus degrading relatively the performance of the heat exchanger. Accordingly, there is a need to make the heat exchanger larger to improve the processing ability thereof, with the result that the costs for the heat exchanger increases, and such a cost problem of the heat exchanger may deteriorate an economy of the whole system, thus causing a problem on difficulty in commercial realization.

On the other hand, the common Rankine cycle, which is disclosed in Patent Literature 1 and uses the pure materials as the working fluid, permits to make the structure of the heat exchanger, etc., simple, while it is inferior in heat cycle efficiency. In order to improve the heat cycle efficiency in case where such a system is applied, there has been proposed an approach to design Rankine cycle in a multiple stage to permit to use in stages the fluid as the heat source for the warm seawater or the cold seawater, as shown in Patent Literature 2 as indicated above, thus improving efficiency by homologizing change in state of the respective cycles designed in the multiple stage with the temperature change on the heat source side and recovering appropriately the heat held by the heat source with the working fluid to decrease remarkably a loss (see FIG. 18).

However, designing Rankine cycle in a multistage would require that flow channels for the fluid as the heat source in the evaporator and the condenser in the each cycle must be connected in series to each other for the respective evaporator and condenser. If Rankine cycle for constituting a power generation apparatus by an ocean thermal energy conversion, is for example designed in a multistage, and a commonly used counter-current and plate-type heat exchanger is applied for the heat exchanger for constituting the evaporator and the condenser, the flow channels for seawater as the fluid serving as the heat source in the respective heat exchanger are connected in series to each other via conduits between the heat exchangers, in view of an actual arrangement of a plurality of heat exchangers (see FIG. 19). On the other hand, difference in temperature between an outlet and an inlet for the fluid serving as the heat source in the evaporator and the condenser in the respective cycle becomes smaller, along with designing it in a multiple stage, there is no other choice to increase a ratio of a flow rate on the side of the fluid serving as the heat source to a flow rate on the side of the working fluid in the evaporator and the condenser in comparison with one stage (single stage) case.

For these reasons, even if it is assumed that Rankine cycle uses the same evaporator and condenser in either single stage case or multiple stage case, a pressure loss of seawater as the fluid for the heat source in the evaporator and the condenser in the multiple stage case may increase to at least several fold value remarkably exceeding a total amount of values for the corresponding number of stages, in comparison with the single stage case, and this may increase self-consumption electric power for a system such as the use of a pump to a value remarkably exceeding a total amount of values for the corresponding number of stages, thus causing a problem.

Especially in case of a power generation system by an ocean thermal energy conversion, a permissible self-consumption electric power would generally be about 30% of a power generation terminal output. Accordingly, the self-consumption electric power as extremely increased in Rankine cycle in a multiple stage leads to difficulty in effective operation of the power generation system utilizing it, and designing the system in a multiple stage causes a problem in realization.

The present invention, which was made to solve the above-mentioned problems, is to provide a steam power cycle system in which the steam power cycle using pure materials as the working fluid is used in a multiple stage to effectively use heat corresponding to a temperature difference of the heat source and to reduce a pressure loss in the flow channels on the side of the fluid serving as the heat source in the respective heat exchanger so that the fluid serving as the heat source is smoothly introduced into the respective heat exchanger to make an effective heat exchange with the working fluid, thus improving cost-effectiveness for constitution and operation of the steam power cycle.

A steam power cycle system according to the present invention comprises: a plurality of steam power cycle units, which comprise: an evaporator that causes a working fluid in a liquid phase to make heat exchange with a predetermined high-temperature fluid and evaporates the working fluid; an expander that receives the working fluid as introduced in a gas phase, which has been obtained by the evaporator, to convert heat energy held by the working fluid into a power; a condenser that causes the working fluid in a gas phase from the expander to make heat exchange with a predetermined low-temperature fluid and condenses it; and a pump that pumps the working fluid in a liquid phase from the condenser toward the evaporator, wherein: the plurality of steam power cycle units has a connection structure in which flow channels for the high-temperature fluid in the respective evaporator are interconnected in series to each other, flow channels for the low-temperature fluid in the respective condenser are interconnected in series to each other, and a passing order for the high-temperature fluid and the low-temperature fluid in the respective steam power cycle unit is set as an inverse or same order between the high-temperature fluid and the low-temperature fluid; the evaporator in the respective steam power cycle units comprises a cross-flow type heat exchanger in which a flowing direction of the working fluid crosses a flowing direction of the high-temperature fluid, the heat exchanger having a structure in which a cross-sectional area of the flow channel for the high-temperature fluid is larger than that for the working fluid, and a length of the flow channel for the high-temperature fluid is smaller than that for the working fluid, and the evaporators are placed in a flowing direction of the high-temperature fluid; and the condenser in the respective steam power cycle units comprises a cross-flow type heat exchanger in which a flowing direction of the working fluid crosses a flowing direction of the high-temperature fluid, the heat exchanger having a structure in which a cross-sectional area of the flow channel for the high-temperature fluid is larger than that for the working fluid, and a length of the flow channel for the low-temperature fluid is smaller than that for the working fluid, and the condensers are placed in a flowing direction of the low-temperature fluid.

According to the present invention, in addition to the feature that the respective flow channels for the high-temperature fluid and the low-temperature fluid serving as the heat sources in the evaporator and the condenser in the respective steam power cycle units as provided in multistage are connected in series to each other in a predetermined order between the steam power cycle units, the evaporator and the condenser in the respective steam power cycle units comprise a cross-flow type heat exchanger and are arranged respectively in a flowing direction of the fluid as the heat source. This causes the respective fluids in the respective heat exchangers for constituting the evaporator and the condenser to flow in the heat exchanger in the same direction as the flowing-in and out directions of the respective fluids, and causes the heat exchangers to be placed appropriately, thus making it possible to reduce the length of the flow channels for the fluids as the heat sources over the entire steam power cycle units to the minimum necessary, simplify the flow channel structure, and control the pressure loss so as to provide a smooth flowing of the fluid as the heat source in the respective steam power cycle units, and also making it possible to reduce energy consumption required for circulation of the fluids and facility cost for the pump, etc. In addition, this makes it possible to make heat exchange between the fluids for the respective heat sources and the working fluid in a sustainable manner in the respective steam power cycle units as provided in a multistage, thus enhancing heat cycle efficiency to generate effectively power.

A steam power cycle system according to the present invention may comprises: a plurality of steam power cycle units, which comprise: an evaporator that causes a working fluid in a liquid phase to make heat exchange with a predetermined high-temperature fluid and evaporates the working fluid; an expander that receives the working fluid as introduced in a gas phase, which has been obtained by the evaporator, to convert heat energy held by the working fluid into a power; a condenser that causes the working fluid in a gas phase from the expander to make heat exchange with a predetermined low-temperature fluid and condenses it; and a pump that pumps the working fluid in a liquid phase from the condenser toward the evaporator, wherein: the plurality of steam power cycle units has a connection structure in which flow channels for the high-temperature fluid in the respective evaporator are interconnected in series to each other, flow channels for the low-temperature fluid in the respective condenser are interconnected in series to each other, and a passing order for the high-temperature fluid and the low-temperature fluid in the respective steam power cycle unit is set as an inverse or same order between the high-temperature fluid and the low-temperature fluid; and there is provided a preheating heat exchanger that causes the working fluid flowing from an outlet of the expander toward the condenser in one of the steam power cycle units to make heat exchange with the working fluid flowing from an outlet of the pump toward the evaporator in another of the steam power cycle units.

According to the present invention, the working fluid in a gas phase, which has been caused to make heat exchange with the high-temperature fluid in the evaporator in one steam power cycle unit and has then been caused to work in the expander, is caused to make heat exchange in the preheating heat exchanger with the working fluid flowing from the pump toward the evaporator in the other steam power cycle unit, to recover heat held by the working fluid in a gas phase by the other working fluid having a lower temperature in the other steam power cycle unit. This makes it possible to make heat exchange on a lower temperature side in the condenser in one steam power cycle unit, on the one hand, and to make heat exchange on a higher temperature side in the evaporator in the other steam power cycle unit, on the other hand, and especially in this evaporator, a workload of heat exchange in a sensible heat region of the working fluid in the evaporator may be reduced by an increased amount of temperature of the working fluid, which has previously increased by the preheating heat exchanger as provided on the upstream side relative to the evaporator, to improve efficiency of heat transfer to the working fluid in the evaporator, thus controlling heat loss over the entire system and enhancing heat efficiency.

A steam power cycle system according to the present invention may comprises: a plurality of steam power cycle units, which comprise: an evaporator that causes a working fluid in a liquid phase to make heat exchange with a predetermined high-temperature fluid and evaporates the working fluid; an expander that receives the working fluid as introduced in a gas phase, which has been obtained by the evaporator, to convert heat energy held by the working fluid into a power; a condenser that causes the working fluid in a gas phase from the expander to make heat exchange with a predetermined low-temperature fluid and condenses it; and a pump that pumps the working fluid in a liquid phase from the condenser toward the evaporator, wherein: the plurality of steam power cycle units has a connection structure in which flow channels for the high-temperature fluid in the respective evaporator are interconnected in series to each other, flow channels for the low-temperature fluid in the respective condenser are interconnected in series to each other, and a passing order for the high-temperature fluid and the low-temperature fluid in the respective steam power cycle unit is set as an inverse or same order between the high-temperature fluid and the low-temperature fluid; and the respective steam power cycle unit is provided, in the flow channel for the working fluid between the evaporator and expander, with a gas-liquid separator that separates the working fluid from the evaporator into a gas phase substance and a liquid phase substance, supplies the working fluid in a gas phase toward the expander and the working fluid in a liquid phase toward an inlet side of the evaporator.

According to the present invention, dryness of the working fluid flowing out from the evaporator of the respective steam power cycle units is reduced so that the gas phase substance and the liquid phase substance of the working fluid exist in a mixed condition, and the working fluid is separated into the gas phase substance and the liquid phase substance by the gas-liquid separator, and the working fluid in a gas phase is caused to flow toward the expander and the working fluid in a liquid phase is caused to flow toward an inlet of the evaporator. This causes circulation of the working fluid having a high temperature in a liquid phase into the evaporator to increase the temperature of the entirety of the working fluid at the inlet of the evaporator, thus permitting to make heat exchange on a higher temperature side in the evaporator, and a workload of heat exchange in a sensible heat region of the working fluid in the evaporator may be reduced by an increased amount of temperature of the working fluid, to improve efficiency of heat transfer to the working fluid in the evaporator, thus controlling heat loss over the entire system and enhancing heat efficiency. In addition, adjustment in condition of flowing of the working fluid in a liquid phase as separated by the gas-liquid separator, into the evaporator would permit to change the evaporation state of the working fluid in the evaporator, thus making it possible to make the operational state of the system stable in response to variation of load to the steam power cycle unit, the temperature of the heat source due to seasonal modulation, etc.

The steam power cycle system according to the present invention may further comprise: a preheating heat exchanger that causes the working fluid flowing from an outlet of the expander toward the condenser in one of the steam power cycle units to make heat exchange with the working fluid flowing from an outlet of the pump toward the evaporator in another of the steam power cycle units.

According to the present invention, there is provided the preheating heat exchanger that causes the working fluid in a gas phase, which has been caused to walk in the expander in one steam power cycle unit of the plurality of steam power cycle units each comprising the evaporator and the condenser, that comprise a cross-flow type heat exchanger, to be made heat exchange with the working fluid flowing from the pump of the other steam power cycle unit toward the evaporator, to recover heat held by the working fluid in the one steam power cycle unit through the other working fluid in the other steam power cycle unit. This makes is possible to make heat exchange on a lower temperature side in the condenser in the one steam power cycle unit, on the one hand, and make heat exchange on a higher temperature side in the evaporator in the other steam power cycle unit, on the other hand, through heat exchange between the working fluids in the steam power cycle units, thus controlling heat loss over the entire system, and controlling pressure loss of the flow channel on the fluid side of the heat source in the respective evaporator and condenser at a lower level, as well as, enhancing surely general efficiency of the system.

The steam power cycle system according to the present invention may further comprise: a gas-liquid separator that separates the working fluid from the evaporator into a gas phase substance and a liquid phase substance, supplies the working fluid in a gas phase toward the expander and the working fluid in a liquid phase toward an inlet side of the evaporator.

According to the present invention, dryness of the working fluid flowing out from the evaporator is reduced so that the gas phase substance and the liquid phase substance of the working fluid exist in a mixed condition, and the working fluid is separated into the gas phase substance and the liquid phase substance by the gas-liquid separator, and the working fluid in the gas phase is caused to flow toward the expander and the working fluid in a liquid phase is caused to flow toward an inlet of the evaporator. This causes circulation of the working fluid having a high temperature in a liquid phase into the evaporator to increase the temperature of the entirety of the working fluid at the inlet of the evaporator, thus permitting to make heat exchange on a higher temperature side in the evaporator, and a workload of heat exchange in a sensible heat region of the working fluid in the evaporator may be reduced by an increased amount of temperature of the working fluid, to improve efficiency of heat transfer to the working fluid in the evaporator, thus controlling heat loss over the entire system and enhancing heat efficiency. In addition, adjustment in condition of flowing of the working fluid in a liquid phase as separated by the gas-liquid separator, into the evaporator would permit to change the evaporation state of the working fluid in the evaporator, thus making it possible to make the operational state of the system stable in response to variation of load to the steam power cycle system, the temperature of the heat source due to seasonal modulation, etc.

The steam power cycle system according to the present invention may further comprise: a regenerative heat exchanger that causes the working fluid in a liquid phase flowing from the gas-liquid separator toward an inlet side of the evaporator in a predetermined steam power cycle unit to make heat exchange with the working fluid flowing from an outlet of the pump toward the evaporator in another steam power cycle unit than the predetermined steam power cycle unit.

According to the present invention, the working fluid having a high temperature in a liquid phase, which has been separated from the gas phase substance by the gas-liquid separator in the predetermined steam power cycle unit, is caused to make heat exchange, by the regenerative heat exchanger, with the working fluid flowing from the pump in the other steam power cycle unit toward the evaporator, to recover heat held by the working fluid having a high temperature in a liquid phase through the other working fluid having a lower temperature in the other steam power cycle unit. This makes it possible to reduce, in addition to control of heat loss in the entire system, a workload of heat exchange in a sensitive heat region of the working fluid in the evaporator, especially in the other steam power cycle unit as described above, by an amount of temperature of the working fluid, which has previously been increased by the regenerative heat exchanger as located on the upstream side relative to the evaporator, to improve efficiency of heat transfer to the working fluid in the evaporator, thus controlling heat loss over the entire system.

The steam power cycle system according to the present invention may have a structure that: each of the evaporator and the condenser in the respective steam power cycle unit comprises a heat exchanging body in which respective heat exchanging plates, which are formed of a metallic thin plate having substantially a rectangular shape and placed in parallel with each other, are welded to a heat exchanging plate in abutting contact with them at predetermined two end sides thereof, which are substantially in parallel with each other, in a water-tight manner, and welded to another heat exchanging plate in abutting contact with them at other predetermined two end sides thereof, which are substantially in parallel with each other and substantially perpendicular to the predetermined two end sides, in a water-tight manner, to form a united body, and first flow channels through which the working fluid flows and second flow channels through which the high-temperature fluid or the low-temperature fluid flows are provided alternately between the respective heat exchanging plates.

According to the present invention, there is used, as an essential component of the evaporator and the condenser of the steam power cycle unit, the heat exchanging body of the plate-type heat exchanger, in which the heat exchanging plates are welded in parallel with each other, and the first flow channels through which the working fluid flows, and the second flow channels through which the high-temperature fluid or the low-temperature fluid flows, are provided alternately between the respective heat exchanging plates. This makes it possible to ensure the maximum opening through which the respective fluids flow in and out in four directions of the heat exchanging body, while maintaining a state in which the working fluid flowing through the respective first flow channels crosses the fluid as the heat source flowing through the respective second flow channels, making the flow channels on the side of the fluid of the heat source in a state where the evaporator and the condenser are arranged, as a simple flow channel structure with a small variation in cross-sectional area of the flow channel, and controlling remarkably pressure loss. In addition, it is possible to make an effective heat exchange of the working fluid with the high-temperature fluid or the low-temperature fluid through the respective heat exchanging plates, thus making the heat exchanger in compact size, while ensuring sufficiently the heat exchange performance, and simplifying the pipe channel arrangement by which the working fluids flow in and out, and effectively using a space around the heat exchanger.

DETAILED DESCRIPTION

First Embodiment

Figure 1:
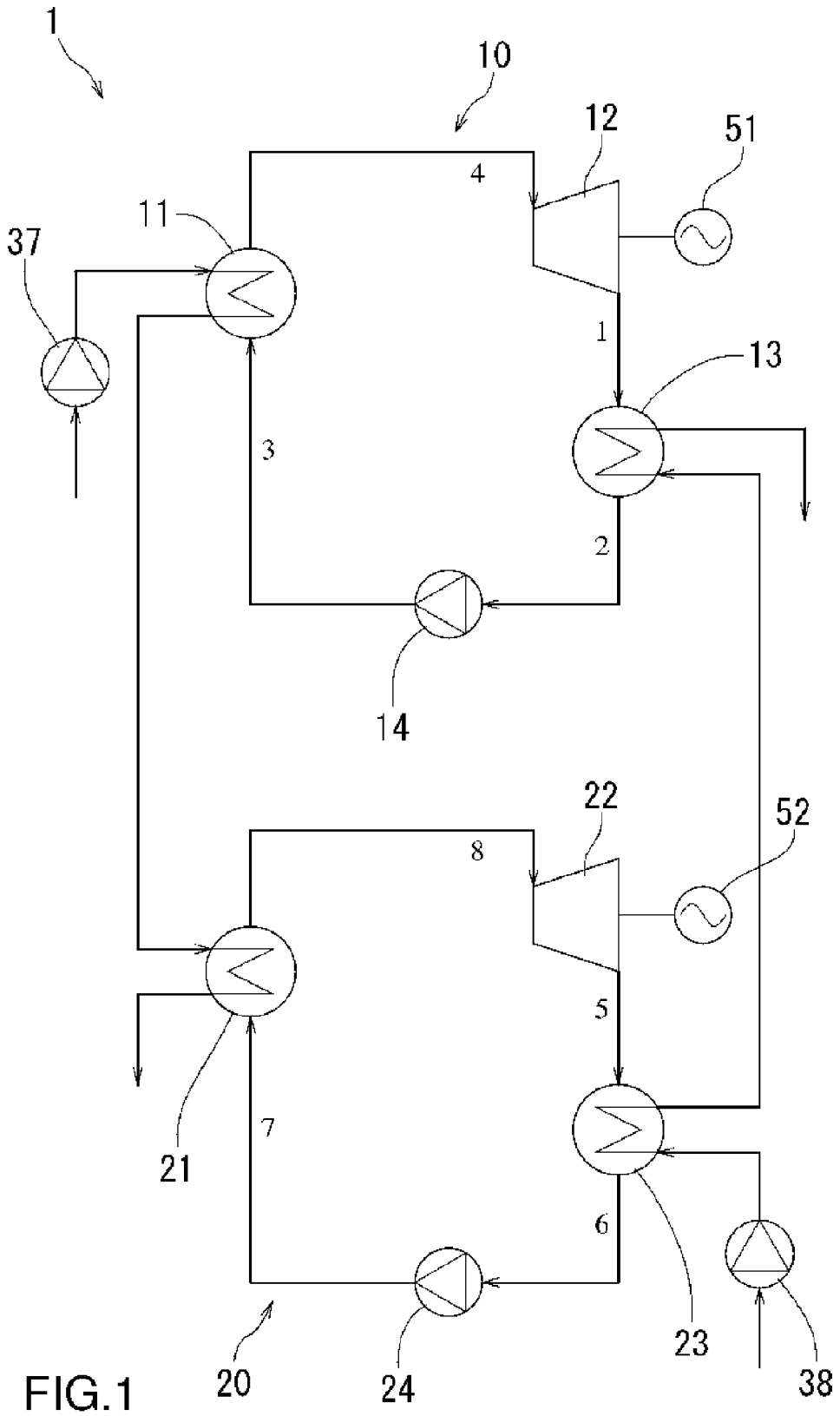
FIG. 1 is a schematic system diagram of a steam power cycle system according to the first embodiment of the present invention.
Figure 2:
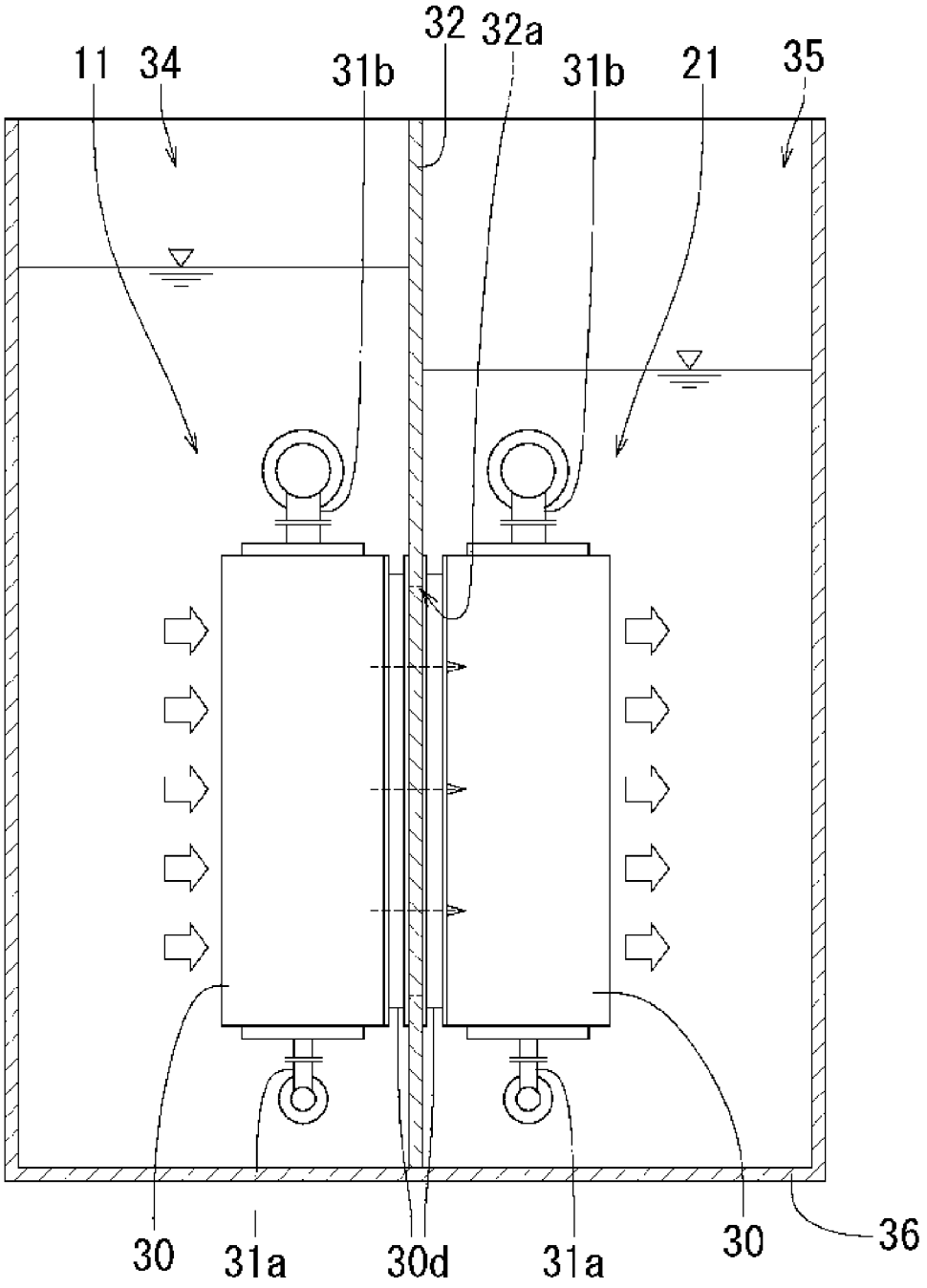
FIG. 2 is a schematic structural view of an evaporator of the steam power cycle system according to the first embodiment of the present invention.
Figure 3:
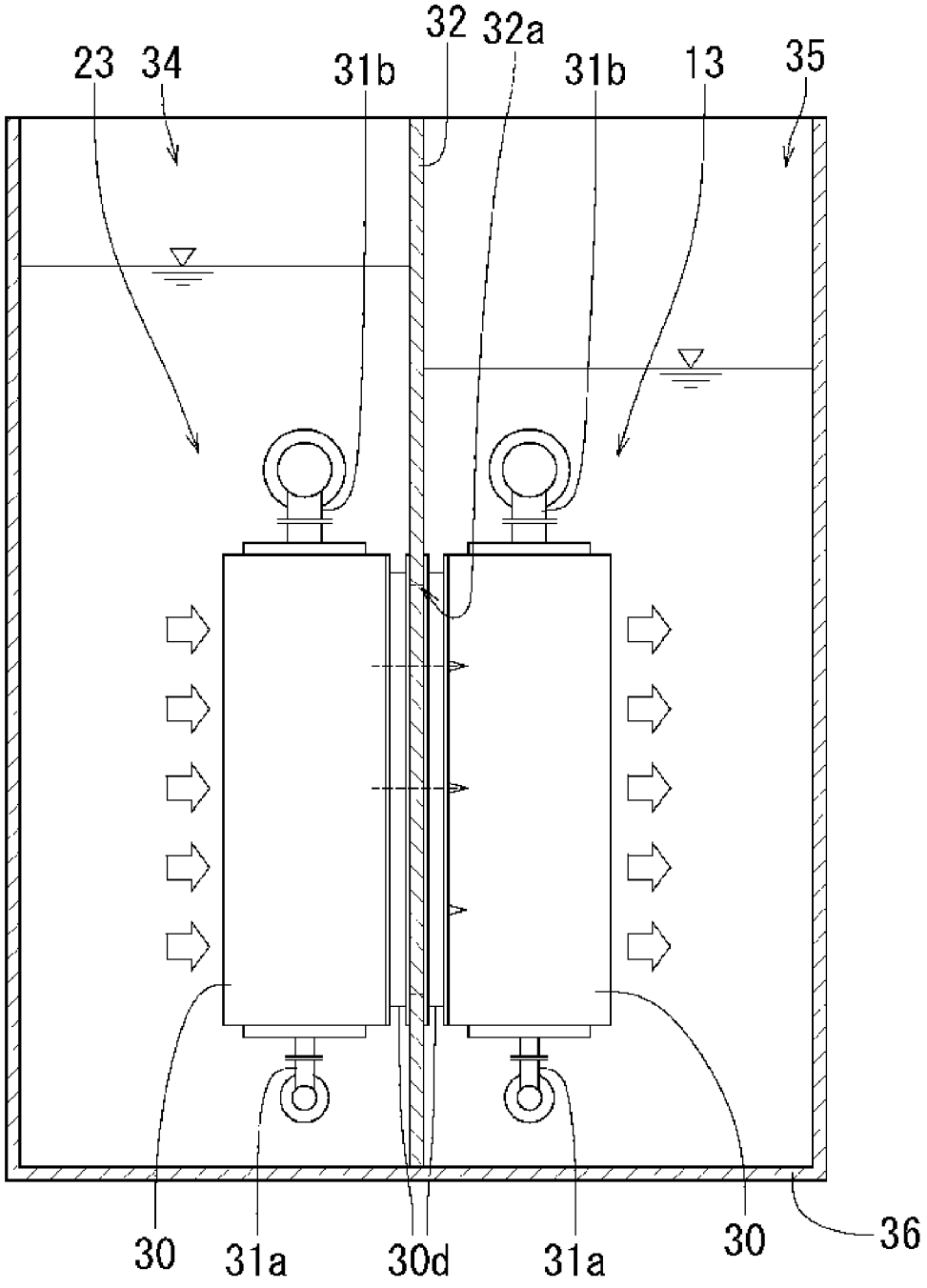
FIG. 3 is a schematic structural view of a condenser of the steam power cycle system according to the first embodiment of the present invention.

Now, the first embodiment of the present invention will be described below with reference to FIGS. 1 to 5. The present embodiment will be described as an example in which the present invention is applied to a power generation apparatus by an ocean thermal energy conversion.

In each of the above indicated figures, the steam power cycle system 1 according to the embodiment of the present invention includes a plurality of steam power cycle units 10, 20 for constituting Rankine cycle, with a multiple structure in which flow channels for a high-temperature fluid are interconnected in series to each other, flow channels for a low-temperature fluid are interconnected in series to each other in the respective steam power cycle units 10, 20, and a passing order for the high-temperature fluid and the low-temperature fluid in the respective steam power cycle unit is set as an inverse order between the high-temperature fluid and the low-temperature fluid, and heat energy obtained by the working fluid in each of the steam power cycle units 10, 20 is converted into power.

The steam power cycle units 10, 20 include evaporators 11, 21 that make heat exchange between the working fluid of ammonia and warm seawater as the above-mentioned high-temperature fluid to obtain a working fluid steam, i.e., the working fluid in a gas phase; turbines 12, 22 as the above-mentioned expander that receive the working fluid in a gas phase as introduced to operate and convert heat energy held by the working fluid into power; condensers 13, 23 that cause the working fluid in a gas phase flowing out of the turbines 12, 22 to be made heat exchange with a cold deep water as the above-mentioned low-temperature fluid to condense it in a liquid phase; and pumps 14, 24 that pump the working fluid taken out of the condensers 13, 23 to the evaporators 11, 21. Of these structural components, the turbines 12, 22 and the pumps 14, 24 are the same as known devices used in a common steam power cycle, and description of them will be omitted.

The respective steam power cycle units 10, 20 are combined with each other so that the high-temperature liquid to be the high-temperature heat source and the low-temperature liquid to be the low-temperature heat source are utilized commonly in a predetermined order. More specifically, the flow channels for the high-temperature fluid in the evaporators 11, 21 are connected to each other so that the high-temperature fluid flows first through the evaporator 11 of the first steam power cycle unit 10 and then flows toward the evaporator 21 of the second steam power cycle unit 20. In addition, the flow channels for the low-temperature fluid in the condensers 13, 23 are connected to each other so that the low-temperature fluid flows first through the condenser 23 of the second steam power cycle unit 20 and then flows toward the condenser 13 of the first steam power cycle unit 10.

However, the respective flow channels for the working fluid in each of the steam power cycle units 10, 20 are independent from each other, and the heat energy obtained by each of the working fluids is converted into power in the respective steam power cycle unit 10, 20. A power generation apparatus by an ocean thermal energy conversion is composed of the steam power cycle system 1 with a multiple stage in which these steam power cycle units 10, 20 are combined to each other, and power generators 51, 52 driven by the turbines 12, 22. The above-mentioned power generators 51, 52 are the same as known devices used in power generation utilizing the turbine as the driving source, and description of them will be omitted.

The above-mentioned evaporators 11, 21 and condensers 13, 23 commonly include a heat exchanging body 30 obtained by welding heat exchanging plates 30*a* arranged in parallel with each other into a united body, and pipe channels 31*a*, 31*b* for flowing the working fluid in and out of the heat exchanging body 30.

There are placed, around the above-described heat exchanging body 30, separation walls 32 that stand upright so as to be connected to a part of the heat exchanging body 30 and divide a space around the heat exchanging body 30 into two regions 34, 35, and a partition wall 36 that separates the two regions 34, 35 divided by the separation wall 32 from an external space.

Figure 4:
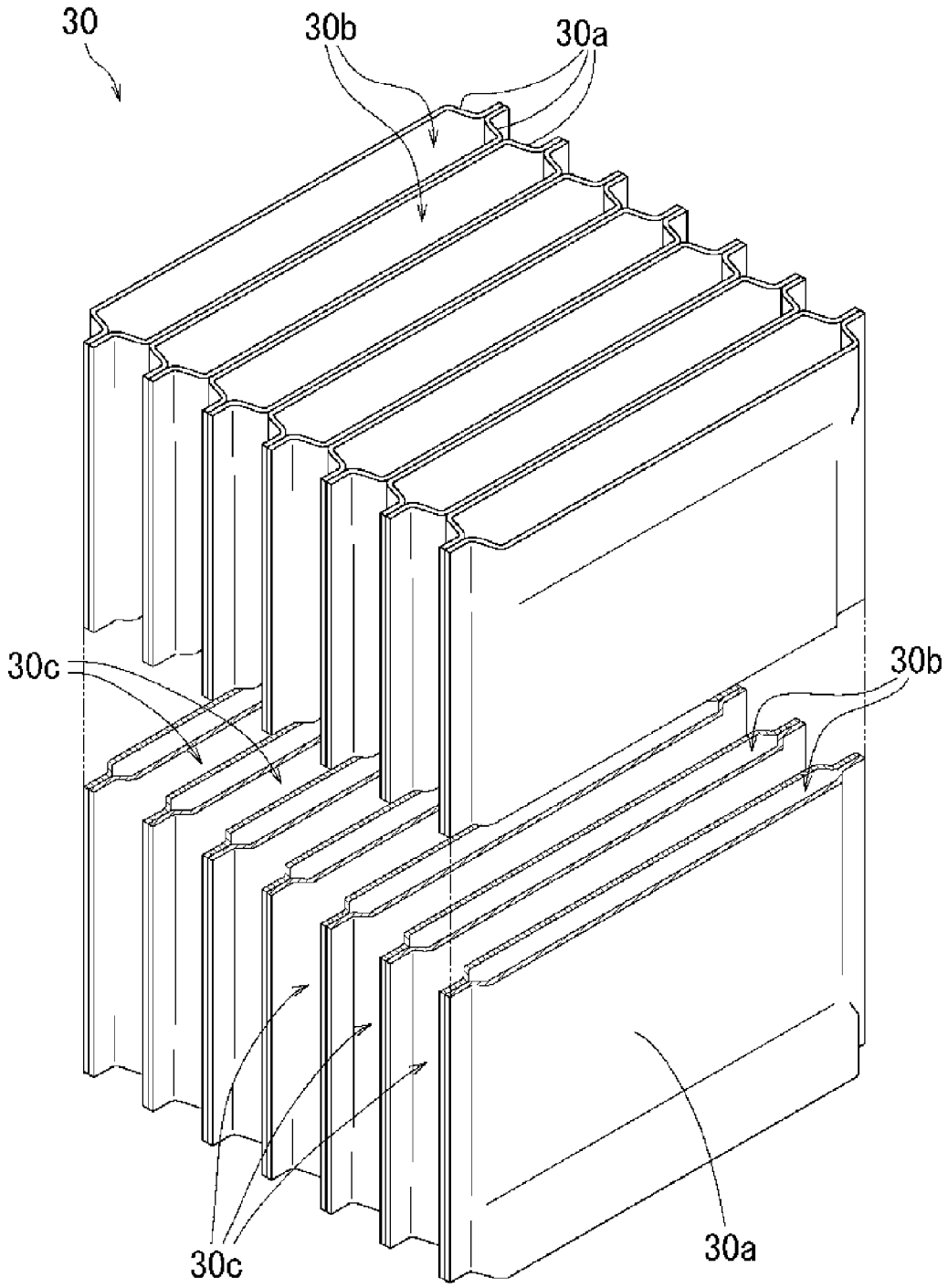
FIG. 4 is a schematic perspective view of an essential component of a heat exchanging body for constituting the evaporator or the condenser of the steam power cycle system according to the first embodiment of the present invention.
Figure 5:
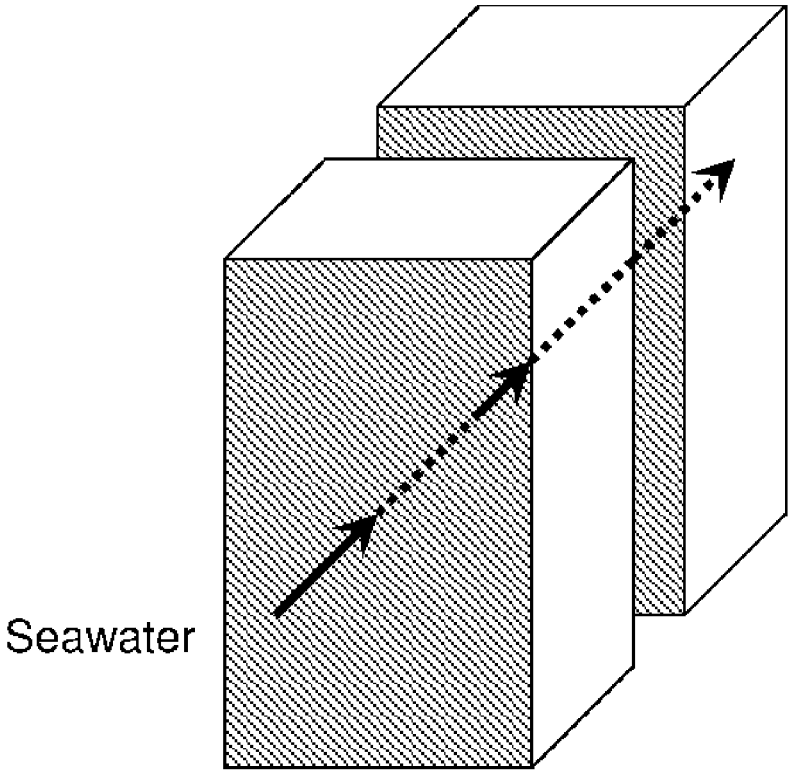
FIG. 5 is a schematic descriptive view of a flow channel of seawater in a plurality of heat exchangers in the steam power cycle system according to the first embodiment of the present invention.

The heat exchanging body 30 has a structure in which the respective heat exchanging plates 30*a*, which are formed of a metallic thin plate having substantially a rectangular shape and placed in parallel with each other, are welded to a heat exchanging plate in abutting contact with them at predetermined two end sides thereof, which are substantially in parallel with each other, in a water-tight manner, and welded to another heat exchanging plate in abutting contact with them at other predetermined two end sides thereof, which are substantially in parallel with each other and substantially perpendicular to said predetermined two end sides, in a water-tight manner, to form a united body (see FIG. 4).

This heat exchanging body 30 has a so-called cross-flow type heat exchanger in which first flow channels 30*b* through which the working fluid flows and second flow channels 30*c* through which seawater as the high-temperature fluid or the low-temperature fluid flows are provided alternately between the respective heat exchanging plates 30*a*, and the working fluid passing through the above-mentioned first flow channel 30*b* crosses the seawater passing through the respective second flow channels 30*c*. More specifically, in case of the evaporators 11, 21, the working fluid circulates in the first flow channel 30*b* and the warm seawater as the high-temperature fluid circulates in the second flow channel 30*c* in the heat exchanging body 30, and the working fluid passing through the respective first flow channel 30*b* crosses the warm seawater passing through the respective second flow channel 30*c*. On the other hand, in case of the condensers 12, 23, the working fluid circulates in the first flow channel 30*b* and the cold seawater as the low-temperature fluid circulates in the second flow channel 30*c*, and the working fluid passing through the respective first flow channel 30*b* crosses the cold seawater passing through the respective second flow channel 10*c*.

A cross-sectional area of the second flow channel 30*c* on the side of the high-temperature fluid or low-temperature fluid in the heat exchanging body 30 is larger than the first flow channel 30*b* on the side of the working fluid, and a length of the second flow channel on the side of the high-temperature fluid or the low-temperature fluid is smaller than the first flow channel 30*b* on the side of the working fluid. In addition, the heat exchanging body 30 is provided around one opening ends of the second flow channels 30*c* with a flange 30*d* by which it is secured to the separation wall 32 in a water-tight manner.

The separation wall 32 as described above is formed as a flat wall body, which is capable of separating seawater by front and rear surfaces side, and placed to stand upright with a height, which is so sufficient so that seawater as the high-temperature fluid or the low-temperature fluid does not overflow from the upper end of it. Of the space around the heat exchanging body 30, one space divided by the separation wall 32 is designated as a region 34, and the other, a region 35. The separation wall 32 has a through-hole 32*a* formed in it so as to correspond to a mounting position of the heat exchanging body 30, and a peripheral portion of this through-hole 32*a* is connected to the flange 30*d* of the heat exchanging body 30 in a water-tight manner into a united body with the respective heat exchanging body 30.

In case of the evaporators 11, 21, the heat exchanging body 30 for constituting the evaporator 11 of the first steam power cycle unit 10 is secured to the peripheral portion of the through-hole 32*a* on the surface on the side of one region 34 of the separation wall 32, and the heat exchanging body 30 for constituting the evaporator 21 of the second steam power cycle unit 20 is secured to the peripheral portion of the through-hole 32*a* on the surface on the side of the other region 35 of the separation wall 32.

In case of the condensers 13, 23, the heat exchanging body 30 for constituting the condenser 23 of the second steam power cycle unit 20 is secured to the peripheral portion of the through-hole 32*a* on the surface on the side of one region 34 of the separation wall 32, and the heat exchanging body 30 for constituting the condenser 13 of the first steam power cycle unit 10 is secured to the peripheral portion of the through-hole 32*a* on the surface on the side of the other region 35 of the separation wall 32.

Thus, the two heat exchanging bodies 30 are secured to the opposite surfaces at the peripheral portion of the through-hole 32*a* of the separation wall 32, and these two heat exchanging bodies 30, which constitute the different evaporator and condenser, respectively, are fixedly connected to each other so that the opening ends of the second flow channels 30*c* face each other. The heat exchanging body 30, which constitutes the evaporator or the condenser, has a cross-flow type structure, with the result that the flowing in and out direction at the opening ends of the second flow channels 30*c* coincides with the flowing direction within the second flow channels 30*c*, and the high-temperature fluid or the low-temperature fluid flows linearly over the two heat exchanging bodies 30 (see FIG. 5).

More specifically, there is applied a structure to obtain a state in which the flow channels for the high-temperature fluid of the two evaporators 11, 21 are connected in series with each other by mounting the two heat exchanging bodies 30, which constitute the different evaporator and condenser, respectively, to the separation wall 32, and the respective evaporators 11, 21 are aligned in the flowing direction of the high-temperature fluid, as well as a state in which the flow channels for the low-temperature fluid of the two condensers 13, 23 are connected in series with each other, and the respective condensers 13, 23 are aligned in the flowing direction of the low-temperature fluid.

Thus, in a state in which the evaporators 11, 21 are connected, as aligned, in series with each other in the flowing direction of the high-temperature fluid or a state in which the condensers 13, 23 are connected, as aligned, in series with each other in the flowing direction of the low-temperature fluid, the high-temperature fluid or the low-temperature fluid flow simply linearly by the shortest distance. In addition, the cross-sectional area of the second flow channel 30*c* is larger than that of the first flow channel 30*b*, and a length of the second flow channel 30*c* is smaller than that of the first flow channel 30*b*. It is therefore possible to extremely reduce pressure loss when the high-temperature fluid flows in the plurality of evaporators 11, 21 and out of them, and flows through them, as well as the low-temperature fluid flows in the plurality of condensers 13, 23 and out of them, and flows through them. Therefore, it is possible to avoid increase in pressure loss to provide surely an effect by designing the steam power cycle unit in a multistage, even when the high-temperature fluid or the low-temperature fluid flows through the plurality of evaporators 11, 21 or condensers 13, 23.

The partition wall 36 as described above is designed in the form of a wall body to encompass the heat exchanging body 30 and the separation wall 32 from the side and the bottom. The partition wall 36 defines the two regions 34, 35 as described above in an appropriate size, while separating them from the outside. There is applied a structure that the partition wall 36 has an opening (not shown) formed in a place where the partition wall face the respective regions 34, 35, so that seawater may flow in the regions 34, 35 and out from them via a pipe for circulation of seawater at the place of the opening, or directly flow from the adjacent external sea. Pumps 37, 38 to pressurize seawater are provided on the outer side of the opening of the partition wall 36 so that the pressurized seawater may flow in one region 34 to provide a difference in hydraulic head between the respective seawaters in the two regions 34, 35 as described above.

In a case where the evaporators 11, 21 or the condensers 13, 23 are used, sea water exists in the two regions 34, 35 as described above and the second flow channels 30*c* of the respective heat exchanging bodies 30, since seawater flows from outside in through the opening of the partition wall 36. Seawater naturally flows in the other region 35, of them, in which the separation wall 32 is placed, but, in addition to natural flow of seawater in the one region 34, the pressure by the pump 37, 38 is also applied to the one region 34 as described above, and the level of seawater in this region 34 is higher than the level in the region 35.

In each of the regions 34, 35, the whole of the heat exchanging body 30 and the pipe channels 31*a*, 31*b* may be placed below the level of seawater, and namely be fully submerged into seawater, and in this case, submerging the pipe channels makes it easy to maintain a temperature of the working fluid flowing out of the heat exchanging body 30, prevent unnecessary condensation or evaporation of the working fluid in the pipe channels and improve heat exchange efficiency, thus being preferable.

There is applied a structure that there is a difference in level as the hydraulic head between the seawater in the one region 34 and the seawater in the other region 35, between which the separation wall 32 is placed, with the result that the seawater flows from the one region 34 through the second flow channel 30*c* of the heat exchanging body 30 and through the through-hole 32*a* of the separation wall 32 to reach the second flow channels 30*c* of the other heat exchanging body 30, and further flows toward the other region 35.

It is possible to make continuously heat exchange between the working fluid in the first flow channels 30*b* and the seawater in the second flow channels 30*c* in the heat exchanging body 30, along with production of flow of the seawater passing through the second flow channels 30*c* of each of the heat exchanging bodies 30. The sweater, which has flowed out of the heat exchanging body 30 to reach the region 35, is to be discharged outside the partition wall 36 through the opening of the partition wall 36, which faces the other region 35 as describe above.

There is provided the separation wall 32 that defines a plurality of regions in which the seawater as the high-temperature fluid or the low-temperature fluid as the heat source may exist, the heat exchanging body 30 is placed along this separation wall 32, a part of the second flow channels 30*c* of the heat exchanging body 30 and the essential part of the separation wall 32 may be submerged into the seawater, when the evaporators 11, 21 or the condensers 13, 23 are in use, and the seawater may flow into the region 34 under an appropriate pressure by the pumps 37, 38, while maintaining communication of the two regions 34, 35 with the outside (sea), in this manner, and thus the seawater may flow smoothly into the second flow channels 30*c* of the heat exchanging body 30. It is therefore possible for the seawater, in addition to controlling of the pressure loss during circulation of the seawater, to flow in and out in a large amount, with the result that there is no need to use a complicated structure of the component such as the pipe channels for communication with the second flow channels 30*c* in the heat exchanging body 30, thus reducing costs for installation of the pipe channels.

In addition, the two regions 34, 35 communicating with the second flow channels 30*c* are defined by the separation wall 32 in the heat exchanging body 30. This makes it possible to introduce easily the seawater into the second flow channels 30*c* and take it from the second flow channels 30*c*, and to arrange the plurality of heat exchangers in a more compact manner, thus permitting to make an effective heat exchange in a minimum space.

In addition, only the separation wall 32 having the through-hole 32*a* is provided in the vicinity of the heat exchanging body 30, but there exists no component such as a pressure tight case to encompass the heat exchanging body 30, and an operator may have an extremely easy access to the heat exchanging body 30, thus performing surely a maintenance operation such as an visual inspection, cleaning, etc. for the heat exchanging body 30, and coping with contamination by living matter resulting from use of the seawater as the fluid for heat exchange, through a cleaning operation or the line in an appropriate manner.

Now, description will be given of an operation state of the steam power cycle system according to the present invention. There is assumed that the warm seawater as the high-temperature fluid and the cold seawater as the low-temperature fluid are taken from the surface of the sea and an area at a predetermined depth of the sea, respectively, while ensuring the respective predetermined flow rates, to introduce them into the evaporators 11, 21 and the condensers 13, 23 of each of the steam power cycle units 10, 20, and there is given a difference in water level as a difference in hydraulic head between the seawaters existing in the two regions 34, 35 encompassing the evaporators 11, 21 and the condensers 13, 23 so that there occurs flow of the seawater from one region 34 through the second flow channels 30*c* of the respective heat exchanging body 30 to the other region 35, and heat exchange between the working fluid and the seawater can be made continuously under the same conditions in the heat exchanging body 30.

In the first steam power cycle unit 10, the evaporator 11 causes heat exchange between the warm seawater as the high-temperature fluid, which has been pressurized by the pump 37 and introduced through the region 34, and the working fluid whole in a liquid phase as introduced from the pipe channel 31*a* for the working fluid on the downside, in the heat exchanging body 30. Of the working fluid as heated here, the working fluid, which has been evaporated by a raised temperature to be converted into a gas phase, passes through the pipe channel 31*b* for the working fluid on the upper side to flow out of the evaporator 11 and toward the turbine 12.

The working fluid from the evaporator 11, having a high temperature in a gas phase reaches the turbine 12 to drive it, and the power generator 51 is driven by this turbine 12 so that heat energy is converted into a usable power and then into an electric power. The working fluid in a gas phase, which has been expanded by the turbine 12 to work, is in a state where pressure and temperature are decreased. Then, the working fluid in a gas phase from the turbine 12 is introduced into the condenser 13.

In the condenser 13, there is made heat exchange between the cold seawater, which first passes through the heat exchanging body 30, on the side of the adjacent region 34, serving as the condenser 23 on the side of the second steam power cycle unit 20, and then is introduced into the heat exchange body 30, on the side of the region 35, serving as this condenser 13, on the one hand, and the working fluid in a gas phase, which has been introduced from the pipe channel 31*b* for the working fluid on the upper side into the heat exchanging body 30, on the other hand, through the heat exchanging plates 30*a*, and the working fluid in a gas phase, which has been cooled, is condensed to be converted into a liquid phase.

The working fluid in a liquid phase, which has been obtained through condensation by the condenser 13, is discharged from the heat exchanging body 30 through the pipe channel 31*a* for the working fluid out of the condenser 13. The working fluid in a liquid phase from the condenser 13 has the lowest temperature and pressure in the steam power cycle unit 10. This working fluid in a liquid phase is flown into the pump 14 and pressurized here, and then toward the evaporator 11.

Then, the working fluid returns into the evaporator 11, and the step of making heat exchange in the evaporator 11 and the subsequent steps are repeated in the same manner as described above.

On the other hand, in the second steam power cycle unit 20, the evaporator 21 causes heat exchange between the warm seawater as the high-temperature fluid, which has passed through the heat exchanging body, on the side of the region 34, serving as the evaporator 11 of the first steam power cycle unit 10, and the working fluid whole in a liquid phase as introduced from the pipe channel 31*a* for the working fluid on the downside, in the heat exchanging body 30, on the side of the region 35, serving as the evaporator 21. Of the working fluid as heated here, the working fluid, which has been evaporated by a raised temperature to be converted into a gas phase, passes through the pipe channel 31*b* for the working fluid on the upper side to flow out of the evaporator 21 and toward the turbine 22.

The working fluid from the evaporator 21, having a high temperature in a gas phase reaches the turbine 22 to drive it, and the power generator 52 is driven by this turbine 22 so that heat energy is converted finally into an electric power, in the same manner as the turbine 12 and the power generator 51 as described above. The working fluid in a gas phase, which has been expanded by the turbine 22 to work, is in a state where pressure and temperature are decreased, and then flows out of the turbine 22 and is introduced into the condenser 23.

In the condenser 23, there is made heat exchange between the cold seawater having a low temperature, which has been pressurized as the low-temperature fluid by the pump 38 and then introduced through the region 34 into the heat exchanging body 30, on the one hand, and the working fluid in a gas phase, which has been introduced from the pipe channel 31*b* for the working fluid into the heat exchanging body 30, on the other hand, through the heat exchanging plates 30*a*, to cool the working fluid, and this working fluid in a gas phase is condensed to be converted into a liquid phase.

The working fluid in a liquid phase, which has been obtained through condensation by the condenser 23, is discharged from the heat exchanging body 30 through the pipe channel 31*a* for the working fluid out of the condenser 23. The working fluid in a liquid phase from the condenser 23 has the lowest temperature and pressure in the steam power cycle unit 20. This working fluid in a liquid phase is flown into the pump 24 and pressurized here, and then toward the evaporator 21.

Then, the working fluid for the second steam power cycle unit 20 returns into the evaporator 21, and the step of making heat exchange in the evaporator 21 and the subsequent steps are repeated in the same manner as described above.

The seawater as the low-temperature fluid, which has been continuously used in the respective heat exchange in the condenser 23 and the condenser 13, has received heat from the working fluid, with the result that it has a predetermined temperature as raised. This seawater flows out from the opening of the partition wall 36, which communicates with the region 35, and is finally discharged into the sea out of the system for spreading.

The seawater as the high-temperature fluid with a decreased temperature due to the heat exchange with the respective working fluid in the evaporator 11 and the evaporator 21, also flows out from the opening of the partition wall 36 through the region 35, and is finally discharged into the sea out of the system for spreading.

On the other hand, new seawater is introduced through the opening of the partition wall 36 into the region 34, and then subjected to the heat exchange by the respective heat exchanging body 30 for constituting the evaporator 11 and the condenser 23. The above-described steps are repeated during using the system, i.e., during continuing the operation of the respective steam power cycle in the two steam power cycle units 10, 20.

It may be deemed that, since the high-temperature fluid and the low-temperature fluid are seawater existing in an extremely large amount, it is almost negligible an effect of heat held by the seawater, which has been subjected to the heat exchange on the whole of the sea, after spreading the seawater, which has been subjected to the heat exchange, into the water outside the system, and namely variation in temperature of the whole of the sea after spreading the seawater, there occurs no variation in temperature of seawater, which is newly and sequentially introduced into the heat exchanging body 30, along with the continuous operation of heat exchange, and it is possible to continuously make heat exchange under the same temperature condition as the initial operation of heat exchange.

In the steam power cycle system according to the embodiment of the present invention, in addition to the feature that the respective flow channels for the high-temperature fluid and the low-temperature fluid serving as the heat sources in the evaporators 11, 21 and the condensers 13, 23 in the respective steam power cycle units 10, 20 as provided in multistage are connected in series to each other in a predetermined order between the steam power cycle units 10, 20, the evaporators 11, 21 and the condensers 13, 23 in the respective steam power cycle units 10, 20 comprise a cross-flow type heat exchanger and are arranged respectively in a flowing direction of the fluid as the heat source. This causes the respective fluids in the respective heat exchangers for constituting the evaporators 11, 21 and the condensers 13, 23 to flow in the heat exchanger in the same direction as the flowing-in and out directions of the respective fluids, and causes the heat exchangers to be placed appropriately, thus making it possible to reduce the length of the flow channels for the fluids as the heat sources over the entire steam power cycle units 10, 20 to the minimum necessary, simplify the flow channel structure, and control the pressure loss to make heat exchange between the fluids for the respective heat sources and the working fluid in a sustainable manner in the respective steam power cycle units 10, 20 as provided in a multistage, thus enhancing heat cycle efficiency to generate effectively power. In addition, it is possible to provide a smooth flowing of the fluid as the heat source in the respective steam power cycle units 10, 20, and also making it possible to reduce energy consumption required for circulation of the fluids and facility cost for the pump, etc.

In addition, the seawater is circulated between the regions 34, 35, which is separated by the separation wall 32, to introduce the seawater as the high-temperature fluid or the low-temperature fluid into the second flow channel 30*c* side of the heat exchanging body 30, without using any conduit. Therefore, there is no need to provide any conduits on the side of seawater, thus reducing costs for installation of the conduits and omitting an installation space for the conduits.

In the steam power cycle system according to the embodiment of the present invention, there is applied a dual stage structure that the two steam power cycle units 10, 20 are used and the flow channels for the high-temperature fluid and the low-temperature fluid serving as the heat sources in the evaporators 11, 21 and the condensers 13, 23 are connected to each other between the different steam power cycle units, and the high-temperature fluid and the low-temperature fluid are commonly used. However, the present invention is not limited only to this embodiment, and the other multistage structure such as three stages, four stages, etc. may be applied.

Figure 6:
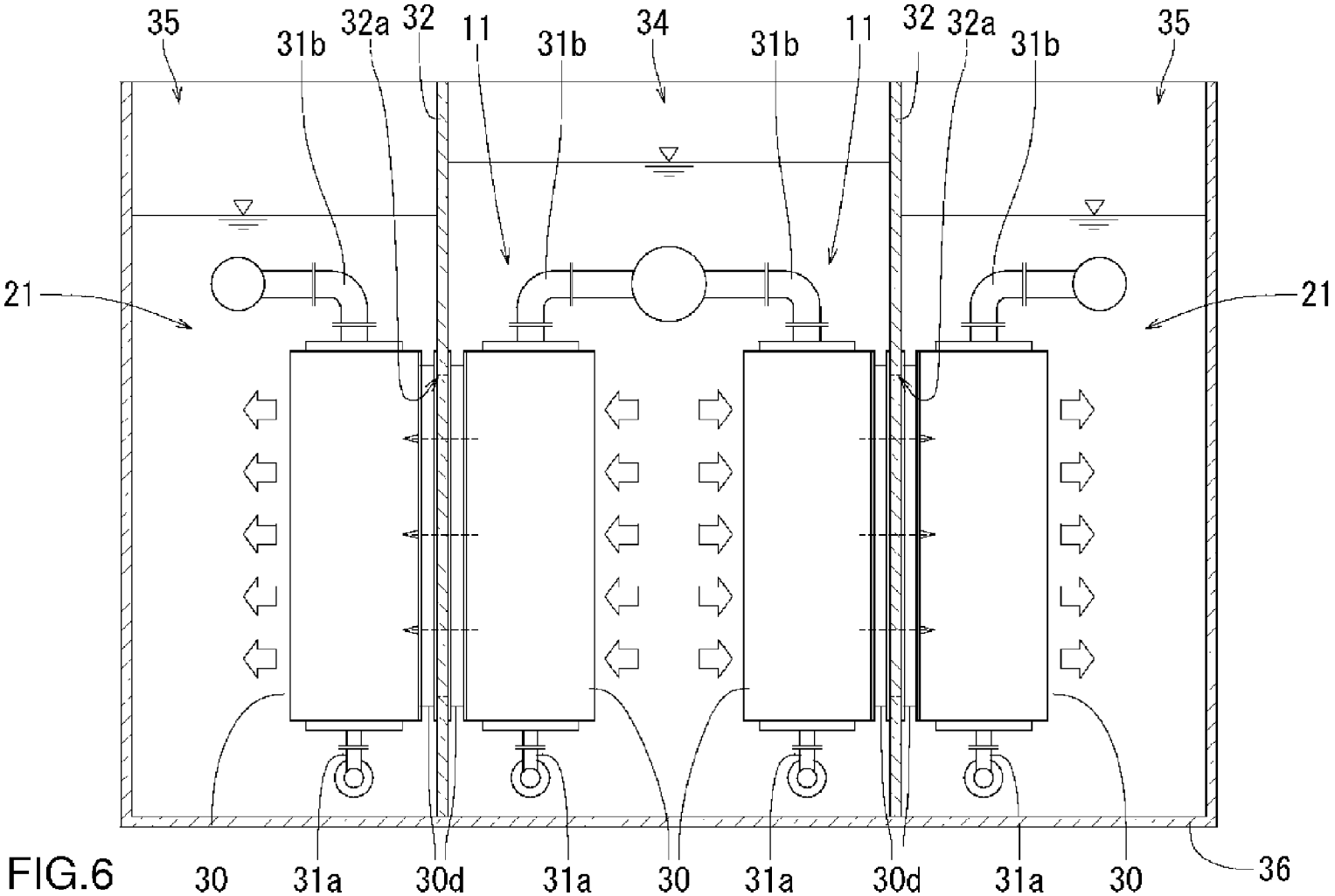
FIG. 6 is a schematic structural view of another evaporator of the steam power cycle system according to the first embodiment of the present invention.

In addition, in the steam power cycle system according to the embodiment of the present invention, there is applied a structure in which each of the evaporators 11, 21 and the condensers 13, 23 is provided with only one heat exchanging body 30, and the heat exchanging body 30 is secured to the peripheral portion of the through-hole 32*a* as only formed in the separation wall 32 so as to circulate the high-temperature fluid and the low-temperature fluid as the heat sources. However, the present invention is not limited only to this embodiment, and there may be applied either of a structure in which a plurality of through-holes is formed so as to be aligned with each other in the separation wall, and a plurality of heat exchanging bodies are provided in the separation wall so as to be aligned with each other and correspond to these through-holes, or a structure in which another separation wall is provided in parallel with the one separation wall to define an intermediate region between the two separation walls, and the heat exchanging bodies 30 are provided in the two separation walls, respectively, and the fluid serving as the heat source is circulated into each of the heat exchanging bodies 30 on the respective separation walls, as shown in FIG. 6. In these cases, a plurality of or a number of heat exchanging bodies 30 are provided so as to be aligned with each other so as to circulate equally the fluid serving as the heat source, and the plurality of or the number of heat exchanging bodies 30 within the same region constitute a single evaporator 11, 21 or condenser 13, 23. Such a plurality of or a number of heat exchanging bodies 30 may constitute the evaporator or condenser, which is appropriately suitable for a flow rate of the high-temperature fluid, the low-temperature fluid or the working fluid in response to an output as required.

In the steam power cycle system according to the embodiment of the present invention, there is applied a structure in which the opening ends of the second flow channels 30*c* of the heat exchanging body 30 for constituting the evaporators 11, 21 and the opening ends of the second flow channels of the other heat exchanging body, which is placed so that the through-hole 32*a* is located between these bodies, are designed in a cross-flow arrangement, the respective heat exchanging bodies are placed so as to be aligned linearly in parallel with the flowing direction of the seawater in the heat exchanging body, and the seawater, which flows in the opening ends and flows through the second flow channels, is caused to go straight as it is to reach the other heat exchanging body. However, the present invention is not limited only to this embodiment, and, in case where a hollow structure, which is different from the separation wall as described above, for example, a chamber 33 as shown in FIG. 7 is placed between the adjacent heat exchanging bodies, to provide a predetermined interval substantially exceeding the depth of the through-hole of the separation wall as described above, the opening ends of the respective second flow channels 30*c* of the adjacent heat exchanging bodies 30 may slightly deviate horizontally and/or vertically from the opposing position in an offset condition. As long as the respective heat exchanging bodies 30 are aligned so that the flowing directions of the seawater in the heat exchanging bodies are in parallel with each other, even when, in case of restriction on arrangement of difficulty in placing a plurality of heat exchanging bodies linearly in a strict sense, the opening ends of the second flow channels 30*c* do not face completely to each other, the seawater may be circulated smoothly in the second flow channels 30*c* of each of the heat exchanging bodies 30, thus maintaining a state of controlling pressure loss.

Figure 7:
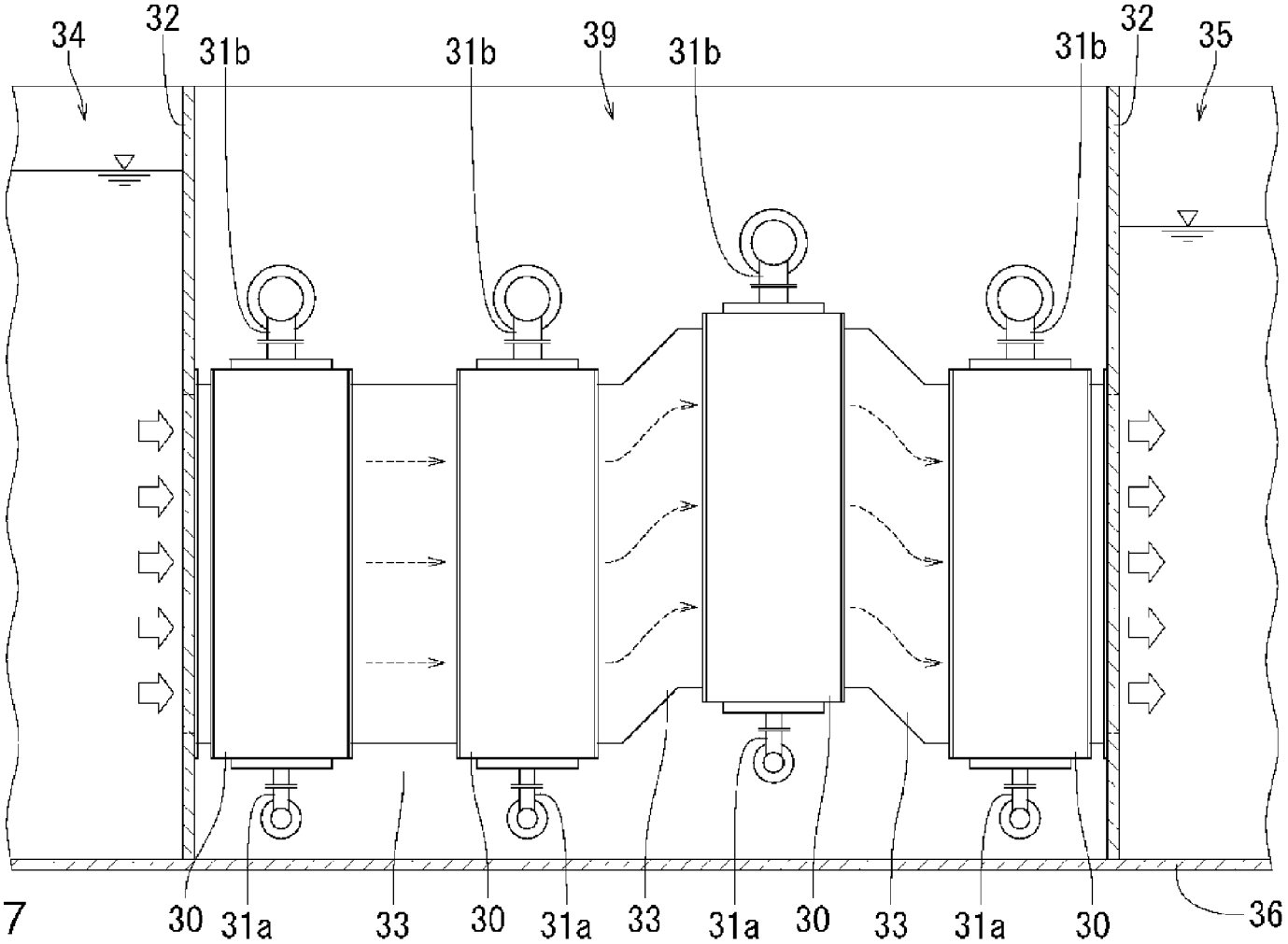
FIG. 7 is a schematic structural view of another condenser of the steam power cycle system according to the first embodiment of the present invention.

In addition, in the steam power cycle system according to the embodiment of the present invention, there is applied a structure in which the second flow channels of the heat exchanging body 30 is secured at one side of the opening ends to the single separation wall 32, and the separation wall 32 separates the region in which the heat exchanging body 30 is placed, from the other region, which is provided on the other side relative to the separation wall 32. It may be applied a structure in which two separation walls 32 are provided in parallel with each other so as to place the heat exchanging body 30 between them, as shown in FIG. 7, and the fluid serving as the heat source is not supplied into the region 39, which is defined by the opposing surfaces of these two separation walls 32. In this case, there is no need to submerge an outside portion of the heat exchanging body 30 excluding the opening ends of the second flow channels, and the pipe channels for supplying the working fluid into the high-temperature fluid or the low-temperature fluid serving as the heat source, thus being convenient in maintenance and management system.

In the steam power cycle system according to the embodiment of the present invention, there is applied a structure in which the separation wall 32 has the through-hole 32*a* formed in it, and the heat exchanging bodies are provided in the peripheral portions of the through-hole 32*a* on the both surfaces of the separation wall 32, respectively. However, it may be applied a structure in which, in case where the region defined by the separation wall 32 is sufficiently large as shown in FIG. 7 as indicated above, a plurality of heat exchanging bodies 30, which are connected in series in the flowing direction of the fluid for heat exchange into a united body into a united body, is secured to the separation wall 32 so that a set of the plurality of heat exchanging bodies is provided for the respective mounting positions of the separation wall. This permits to provide a large number of heat exchanging bodies 30 per an area of the separation wall to use a space effectively and increase a flow rate of the working fluid.

Figure 8:
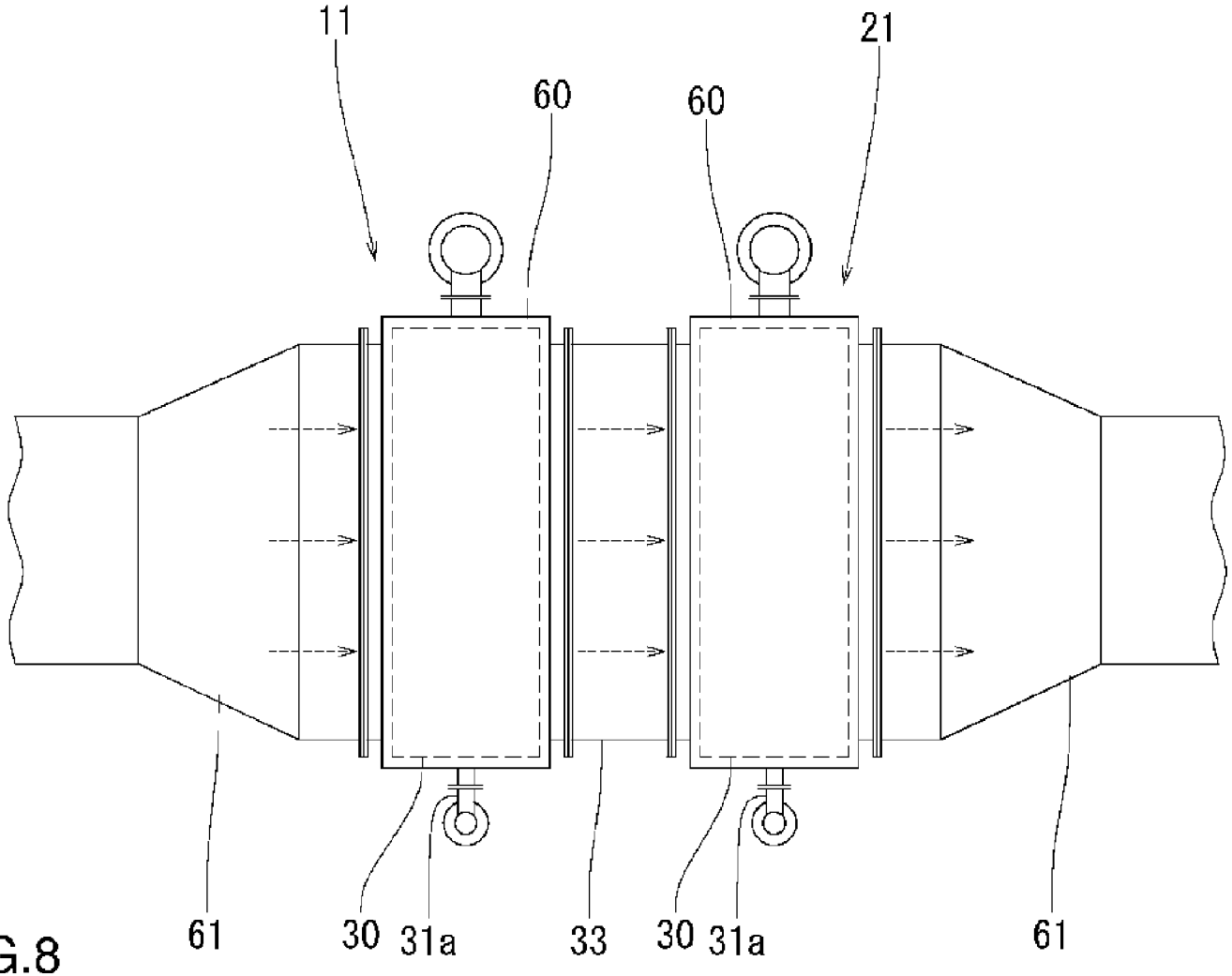
FIG. 8 is a schematic structural view of still another evaporator of the steam power cycle system according to the first embodiment of the present invention.

In the steam power cycle system according to the embodiment of the present invention, there is applied a structure in which the heat exchanging bodies for constituting the evaporators 11, 21 and the condensers 13, 23 are placed along the separation wall 32, the separation wall 32 defines the two regions 34, 35 in which the seawater serving as the high-temperature fluid or the low-temperature fluid of the heart source may exist so as to circulate the seawater in the second flow channels 30*c* of the heat exchanging body 30, and there is used, for circulation of the seawater, neither complicated structural component such as pipe channels communicating with the second flow channels 30*c* of the heat exchanging body 30, nor component such as a pressure tight case to encompass the heat exchanging body 30. However, the present invention is not limited only to this embodiment, and there may be applied a structure in which the respective evaporators 11, 21 as aligned in the flowing direction of the high-temperature fluid, and the respectively condensers as aligned in the flowing direction of the low-temperature fluid form an outermost shell as shown in FIG. 8, to provide a more common structure of the heat exchanger with a shell 60 having a hollow pressure tight structure, which is connected to the other equipment by the pipe channel 61, wherein the heat exchanging bodies for making heat exchange between the high-temperature fluid or low-temperature fluid and the working fluid are placed within the shell 60, and the circulation of the seawater into the second flow channels 30*c* of the heat exchanging body 30 is performed by the pipe channel 61.

In this case, the respective first flow channels 30*b* on the working fluid side of the heat exchanging body 30 with a heat exchanger structure, which is the cross-flow type in which the flowing direction of the seawater as the high-temperature fluid or the low-temperature fluid crosses the flowing direction of the working fluid, the cross-sectional area of the flow channel for the seawater is larger than the working fluid side, and the length of the flow channel on the side of the seawater is shorter than the working fluid side, are connected, for communication, integrally with the inlet and the outlet for the working fluid at the both ends of the shell 60 in the longitudinal direction, and the second flow channels 30*c* on the seawater side of the heat exchanging body 30 are connected, for communication, integrally with the inlet and the outlet for the seawater at the both ends of the shell 60 in a perpendicular direction to the longitudinal direction of it, and the inside of the shell 60 is separated in a water-tight manner from the outside of it.

Second Embodiment

Now, the second embodiment of the present invention will be described below with reference to FIGS. 9 and 10.

In each of the above indicated figures, the steam power cycle system 2 according to the embodiment of the present invention includes a plurality of steam power cycle units 10, 20 in the same manner as the first embodiment of the present invention as described above, but has a different structure that there is provided a preheating heat exchanger 41 that causes the working fluid flowing from an outlet of the turbine 12 toward the condenser 13 in of the first steam power cycle unit 10 to make heat exchange with the working fluid flowing from an outlet of the pump 24 toward the evaporator 21 in the second steam power cycle unit 20, which has a posterior order for passing the high-temperature fluid relative to the first steam power cycle unit 10.

Concerning a connection structure of the flow channels for the high-temperature fluid or the low-temperature fluid in the respective steam power cycle units 10, 20 for constituting the steam power cycle system 2 according to the embodiment of the present invention, there is applied a passing order by which the high-temperature fluid flows from the evaporator 11 of the first steam power cycle unit 10 to the evaporator 21 of the second steam power cycle unit 20 in the same manner as the first embodiment of the present invention, on the one hand, and there is applied a passing order by which the low-temperature fluid flows from the condenser 23 of the second steam power cycle unit 20 to the condenser 13 of the first steam power cycle unit 10, inversely with the case of the high-temperature fluid, on the other hand.

The steam power cycle units 10, 20 include evaporators 11, 21, turbines 12, 22, condensers 13, 23 and pumps 14, 24, in the same manner as the first embodiment of the present invention as described above, and there is applied, as a different feature, a structure in which the preheating heat exchanger 41 for making heat exchange between the working fluid for the first steam power cycle unit 10 and the working fluid for the second steam power cycle unit 20 are commonly used. A power generation apparatus by an ocean thermal energy conversion is composed of the steam power cycle system 2 in which the steam power cycle units 10, 20 are combined to each other, and power generators 51, 52 driven by the turbines 12, 22 in the same manner as the first embodiment of the present invention as described above.

The evaporators 11, 21, the turbines 12, 22, the condensers 13, 23 and the pumps 14, 24 as indicated above are the same as those of the first embodiment of the present invention as described above, and description of them will be omitted.

The preheating heat exchanger 41 as indicated above is a heat exchanger that makes heat exchange between the working fluid whole in a liquid phase, which does not reach the evaporator 21 of the second steam power cycle unit 20, and the working fluid in a gas phase, which has flown from the turbine 12 of the first steam power cycle unit 10, and is a plate-type heat exchanger in the same manner as the heat exchanging body 30 for constituting the evaporators 11, 21 and the condensers 13, 23, and description of it will be omitted.

The flow channels on the side of working fluid in the first steam power cycle unit 10 in this preheating heat exchanger 41 is connected to an outlet side of the turbine 12 of the first steam power cycle unit 10 and an inlet side of the condenser 13 of this unit, respectively, and the working fluid, which has flowed out of the turbine 13 and cooled through heat exchange in the preheating heat exchanger 41, reaches the condenser 13.

On the other hand, the flow channels on the side of working fluid in the second steam power cycle unit 20 in the preheating heat exchanger 41 is connected to an outlet side of the pump 24 of the second steam power cycle unit 20 and an inlet side of the evaporator 21 of this unit, respectively, and the working fluid, which has flowed out of the pump and heated through heat exchange in the preheating heat exchanger 41, reaches the evaporator 21.

There is made heat exchange between the working fluid at the outlet of the turbine of the first steam power cycle unit 10 and the working fluid at the inlet of the evaporator of the second steam power cycle unit 20, between which fluids there is caused a difference in temperature by a multistage structure of the steam power cycle unit, to recover heat held by the working fluid in the first steam power cycle unit 10 through the working fluid having a lower temperature in the second steam power cycle unit 20, with the result that, in the first steam power cycle unit 10, the temperature of the working fluid as introduced into the condenser 13 is decreased and the heat exchange in the condenser 13 may be made on a lower temperature side. In addition, in the second steam power cycle unit 20, the temperature of the working fluid as introduced into the evaporator 21 is increased and the heat exchange in the evaporator 21 may be made on a higher temperature side, thus improving the heat cycle efficiency of the whole system.

Further, the heat exchange in a sensible heat region to increase the temperature of the working fluid to a boiling point and the heat exchange in a latent heat region to evaporate the working fluid are made in the evaporators 11, 21 (see FIG. 9), and in case of a cross-flow type evaporator, it is no easy to improve the performance of heat exchange in the heat exchange of the working fluid in the sensible heat region. However, in the second steam power cycle unit 20, a workload of heat exchange in a sensible heat region of the working fluid in the evaporator 21 may be reduced by an increased amount of temperature of the working fluid, along with the preheating by the preheating heat exchanger 41 on the upstream side relative to the evaporator 21, to improve relatively the performance of the evaporator (overall heat transfer coefficient).

Now, description will be given of an operation state of the steam power cycle system according to the present invention. There is assumed that the warm seawater as the high-temperature fluid and the cold seawater as the low-temperature fluid are taken from the surface of the sea and an area at a predetermined depth of the sea, respectively in the same manner as the first embodiment of the present invention as described above, while ensuring the respective predetermined flow rates, to introduce them into the evaporators 11, 21 and the condensers 13, 23 of each of the steam power cycle units 10, 20, and there is given a difference in water level as a difference in hydraulic head between the seawaters existing in the two regions 34, 35 encompassing the evaporators 11, 21 and the condensers 13, 23 so that there occurs flow of the seawater from one region 34 through the second flow channels 30*c* of the respective heat exchanging body 30 to the other region 35, and heat exchange between the working fluid and the seawater can be made continuously under the same conditions in the heat exchanging body 30.

In the first steam power cycle unit 10, the evaporator 11 causes heat exchange between the warm seawater as the high-temperature fluid, which has been pressurized by the pump 37 and introduced through the region 34, and the working fluid whole in a liquid phase as introduced from the pipe channel 31*a* for the working fluid on the downside, in the heat exchanging body 30. Of the working fluid as heated here, the working fluid, which has been evaporated by a raised temperature to be converted into a gas phase, passes through the pipe channel 31*b* for the working fluid on the upper side to flow out of the evaporator 11 and toward the turbine 12.

The working fluid from the evaporator 11, having a high temperature in a gas phase reaches the turbine 12 to drive it, and the power generator 51 is driven by this turbine 12 so that heat energy is converted into a usable power and then into an electric power. The working fluid in a gas phase, which has been expanded by the turbine 12 to work, is in a state where pressure and temperature are decreased. Then, the working fluid in a gas phase from the turbine 12 is introduced into the preheating heat exchanger 41.

In the preheating heat exchanger 41, there is made heat exchange between the working fluid in a gas phase from the above-mentioned turbine 12 and the working fluid in a liquid phase in the second steam power cycle unit 20, as introduced separately into the preheating heat exchanger 41, to increase the temperature of the working fluid in a liquid phase on the side of the second steam power cycle unit 20, thus recovering heat held by the working fluid in a gas phase on the side of the first steam power cycle unit 10.

The working fluid in a gas phase on the side of the first steam power cycle unit 10 is cooled through the heat exchange by the preheating heat exchanger 41, and the thus cooled working fluid in a gas phase flows out of the preheating heat exchanger 41 and then flows toward the condenser 13.

In the condenser 13, there is made heat exchange between the cold seawater, which first passes through the heat exchanging body 30, on the side of the adjacent region 34, serving as the condenser 23 on the side of the second steam power cycle unit 20, and then is introduced into the heat exchange body 30, on the side of the region 35, serving as this condenser 13, on the one hand, and the working fluid in a gas phase, which has been introduced from the pipe channel 31*b* for the working fluid on the upper side into the heat exchanging body 30, on the other hand, through the heat exchanging plates 30*a*, and the working fluid in a gas phase, which has been cooled, is condensed to be converted into a liquid phase.

The working fluid in a liquid phase, which has been obtained through condensation by the condenser 13, is discharged from the heat exchanging body 30 through the pipe channel 31*a* for the working fluid out of the condenser 13. The working fluid in a liquid phase from the condenser 13 has the lowest temperature and pressure in the steam power cycle unit 10. This working fluid in a liquid phase is flown into the pump 14 and pressurized here, and then toward the evaporator 11.

Then, the working fluid returns into the evaporator 11, and the step of making heat exchange in the evaporator 11 and the subsequent steps are repeated in the same manner as described above.

On the other hand, in the second steam power cycle unit 20, the evaporator 21 causes heat exchange between the warm seawater as the high-temperature fluid, which has passed through the heat exchanging body, on the side of the region 34, serving as the evaporator 11 of the first steam power cycle unit 10, and the working fluid whole in a liquid phase as introduced from the pipe channel 31*a* for the working fluid on the downside, in the heat exchanging body 30, on the side of the region 35, serving as the evaporator 21. Of the working fluid as heated here, the working fluid, which has been evaporated by a raised temperature to be converted into a gas phase, passes through the pipe channel 31*b* for the working fluid on the upper side to flow out of the evaporator 21 and toward the turbine 22.

The working fluid from the evaporator 21, having a high temperature in a gas phase reaches the turbine 22 to drive it, and the power generator 52 is driven by this turbine 22 so that heat energy is converted finally into an electric power, in the same manner as the turbine 12 and the power generator 51 as described above. The working fluid in a gas phase, which has been expanded by the turbine 22 to work, is in a state where pressure and temperature are decreased, and then flows out of the turbine 22 and is introduced into the condenser 23.

In the condenser 23, there is made heat exchange between the cold seawater having a low temperature, which has been pressurized as the low-temperature fluid by the pump 38 and then introduced through the region 34 into the heat exchanging body 30, on the one hand, and the working fluid in a gas phase, which has been introduced from the pipe channel 31*b* for the working fluid into the heat exchanging body 30, on the other hand, through the heat exchanging plates 30*a*, to cool the working fluid, and this working fluid in a gas phase is condensed to be converted into a liquid phase.

The working fluid in a liquid phase, which has been obtained through condensation by the condenser 23, is discharged from the heat exchanging body 30 through the pipe channel 31*a* for the working fluid out of the condenser 23. The working fluid in a liquid phase from the condenser 23 has the lowest temperature and pressure in the steam power cycle unit 20. This working fluid in a liquid phase is flown into the pump 24 and pressurized here, and then reaches the preheating heat exchanger 41

In the preheating heat exchanger 41, there is made heat exchange between the working fluid in a liquid phase from the above-mentioned pump 24 and the working fluid in a gas phase from the turbine 12 of the first steam power cycle unit 10 as described above, to increase the temperature of the working fluid in a liquid phase on the side of the second steam power cycle unit 20. The working fluid having the thus increased temperature flows out of the preheating heat exchanger 41 and then flows toward the evaporator 21.

The working fluid in a liquid phase on the side of the second steam power cycle unit 20 returns into the evaporator 21 in a state in which the temperature is previously increased to a predetermined temperature through the heat exchange by the preheating heat exchanger 41, and the step of making heat exchange in the evaporator 21 and the subsequent steps are repeated in the same manner as described above.

The seawater as the low-temperature fluid, which has been continuously used in the respective heat exchange in the condenser 23 and the condenser 13, has received heat from the working fluid, with the result that it has a predetermined temperature as raised. This seawater flows out from the opening of the partition wall 36, which communicates with the region 35, and is finally discharged into the sea out of the system for spreading.

The seawater as the high-temperature fluid with a decreased temperature due to the heat exchange with the respective working fluid in the evaporator 11 and the evaporator 21, also flows out from the opening of the partition wall 36 through the region 35, and is finally discharged into the sea out of the system for spreading.

On the other hand, new seawater is introduced through the opening of the partition wall 36 into the region 34, and then subjected to the heat exchange by the respective heat exchanging body 30 for constituting the evaporator 11 and the condenser 23. The above-described steps are repeated during using the system, i.e., during continuing the operation of the respective steam power cycle in the two steam power cycle units 10, 20.

It may be deemed that, since the high-temperature fluid and the low-temperature fluid are seawater existing in an extremely large amount, it is almost negligible an effect of heat held by the seawater, which has been subjected to the heat exchange on the whole of the sea, after spreading the seawater, which has been subjected to the heat exchange, into the water outside the system, and namely variation in temperature of the whole of the sea after spreading the seawater, there occurs no variation in temperature of seawater, which is newly and sequentially introduced into the heat exchanging body 30, along with the continuous operation of heat exchange, and it is possible to continuously make heat exchange under the same temperature condition as the initial operation of heat exchange, in the same manner as the first embodiment of the present invention as described above.

In the steam power cycle system according to the embodiment of the present invention, the working fluid in a gas phase, which has been caused to make heat exchange with the high-temperature fluid in the evaporator 11 in the first steam power cycle unit 10 and has then been caused to work in the turbine 12, is caused to make heat exchange in the preheating heat exchanger 41 with the working fluid flowing from the pump 24 in the second steam power cycle unit 20 toward the evaporator 21 in the second steam power cycle unit, to recover heat held by the working fluid in a gas phase in the first steam power cycle unit 10 by the other working fluid having a lower temperature in the second steam power cycle unit 20. This makes it possible to make heat exchange on a lower temperature side in the condenser 13 in the first steam power cycle unit 10, on the one hand, and to make heat exchange on a higher temperature side in the evaporator 21 in the second steam power cycle unit 20, on the other hand, and especially in this evaporator 21, a workload of heat exchange in a sensible heat region of the working fluid in the evaporator 21 may be reduced by an increased amount of temperature of the working fluid, which has previously increased by the preheating heat exchanger 41 as provided on the upstream side relative to the evaporator 21, to improve efficiency of heat transfer to the working fluid in the evaporator 21, thus controlling heat loss over the entire system and enhancing heat efficiency.

Figure 11:
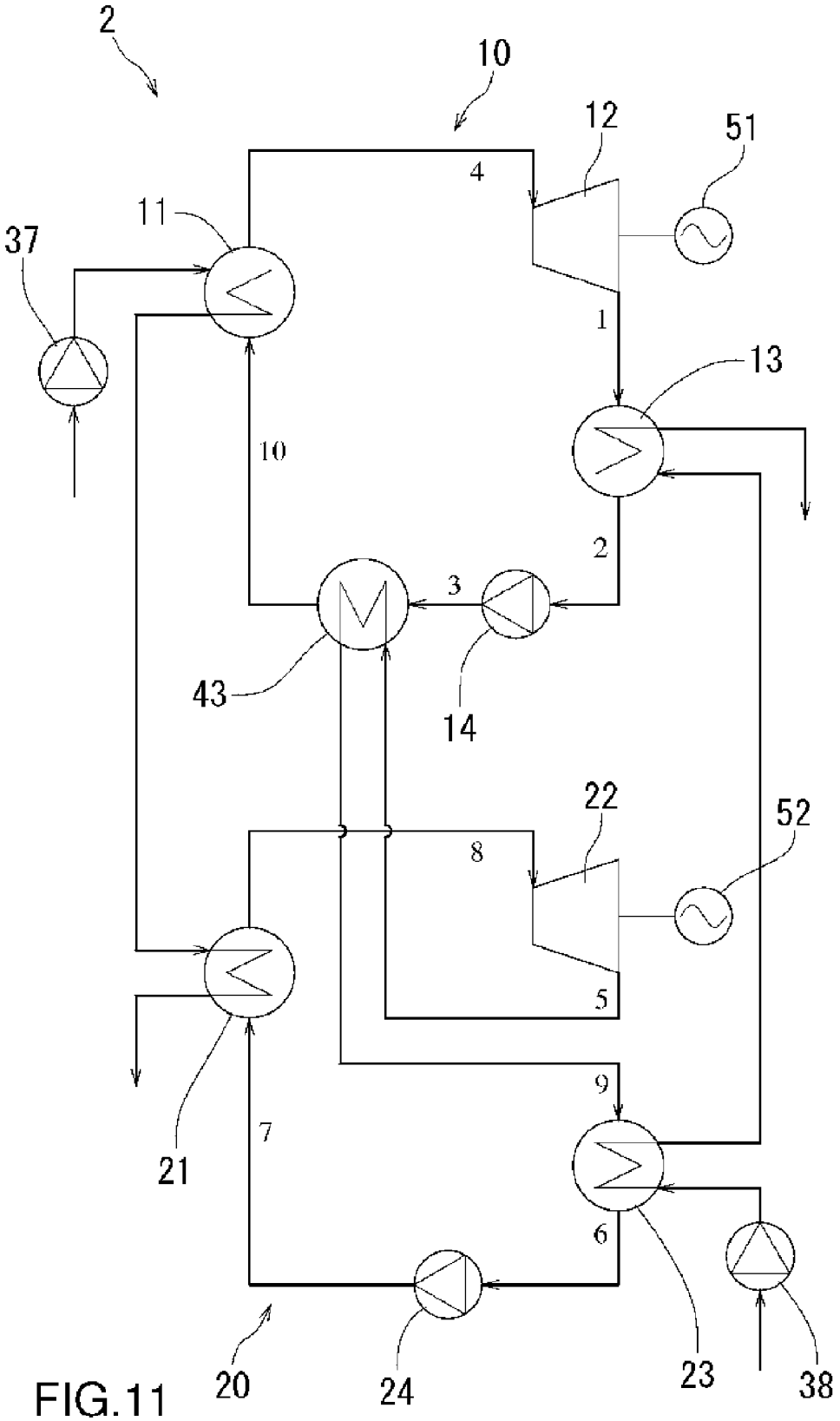
FIG. 11 is another schematic system diagram of the steam power cycle system according to the second embodiment of the present invention.

In the steam power cycle system according to the embodiment of the present invention as described above there is applied a structure in which there is made, in the preheating heat exchanger 41, heat exchange between the working fluid in a gas phase from the turbine 12 in the first steam power cycle unit 10 and the working fluid in a liquid phase from the pump 24 in the second steam power cycle unit 20, to increase the temperature of the working fluid in a liquid phase on the side of the second steam power cycle unit 20, thus recovering heat held by the working fluid in a gas phase on the side of the first steam power cycle unit 10. However, the present invention is not limited only to this embodiment, and there may be provided another preheating heat exchanger 43, as shown in FIG. 11, to make heat exchange between the working fluid in a gas phase from the turbine 22 from the steam power cycle unit, which has a posterior order for passing the high-temperature fluid into the evaporator, e.g., the second steam power cycle unit 20, on the one hand, and the working fluid in a liquid phase from the pump 14 in the other steam power cycle unit, which has an anterior order for passing the high-temperature fluid into the evaporator, i.e., in the first steam power cycle unit 10, on the other hand, to increase the temperature of the working fluid in a liquid phase on the side of the first steam power cycle unit 10, thus recovering heat held by the working fluid in a gas phase on the side of the second steam power cycle unit 20, and improving a heat cycle efficiency in the same manner as the embodiment of the present invention as described above.

Third Embodiment

Now, the third embodiment of the present invention will be described below with reference to FIG. 12.

Figure 12:
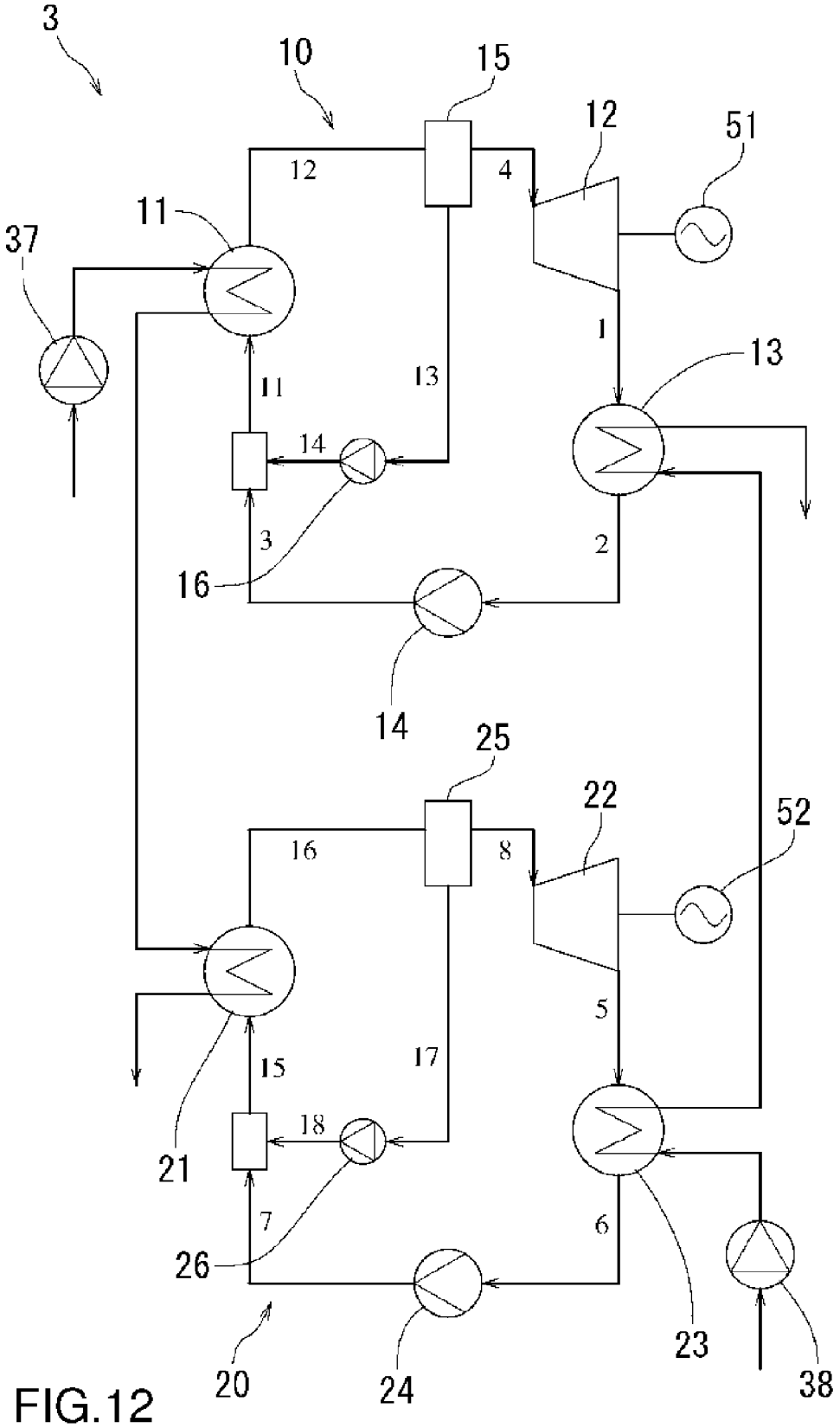
FIG. 12 is a schematic system diagram of a steam power cycle system according to the third embodiment of the present invention.

In FIG. 12 as indicated above, the steam power cycle system 3 according to the embodiment of the present invention includes a plurality of steam power cycle units 10, 20 in the same manner as the first embodiment of the present invention as described above, but has a different structure that each of the above-mentioned steam power cycle units 10, 20 is provided in the flow channel for the working fluid between the evaporator 11, 21 and the turbine 12, 22, with a gas-liquid separator 15, that separates the working fluid from the evaporator 11, 21 into a gas phase substance and a liquid phase substance, supplies the working fluid in a gas phase toward the turbine 12, 22 and the working fluid in a liquid phase toward an inlet side of the evaporator 11, 21, and is also provided in the flow channel for the working fluid in a liquid phase flowing from this gas-liquid separator 15, 25 toward the inlet side of the evaporator 11, 21 with an auxiliary pump 16, 26 that pumps the working fluid toward the evaporator 11, 21.

A power generation apparatus by an ocean thermal energy conversion is composed of the steam power cycle system 3 in which the steam power cycle units 10, 20 are combined to each other, and power generators 51, 52 driven by the turbines 12, 22 in the same manner as the first embodiment of the present invention as described above. The evaporators 11, 21, the turbines 12, 22, the condensers 13, 23 and the pumps 14, 24 as indicated above are the same as those of the first embodiment of the present invention as described above, and description of them will be omitted.

The above-mentioned gas-liquid separator 15, 25 is a known device that separates the working fluid, which has converted into a gas-liquid mixture phase with a high-temperature through heat exchange with warm seawater by the evaporator 11, 21, into a gas phase substance and a liquid phase substance, and description of it will be omitted. The working fluid is separated into a gas phase substance and a liquid phase substance in this gas-liquid separator 15, 25, and the working fluid in a gas phase flows through a pipe channel communicating with the inlet side of the turbine 12, 22 toward the turbine 12, 22.

On the other hand, the working fluid in a liquid phase passes through a pipe channel for communicating the outlet side of the gas-liquid separator 15 for the working fluid in a liquid phase with the inlet side of the evaporator 11, 21, flows toward the inlet side of the evaporator 11, 21, while being subjected to pressure by the auxiliary pump 16, 26 in the middle way, and joins together with the working fluid flowing from the pump 14, 24 toward the evaporator 11, 21, to flow in the evaporator 11, 21.

There is provided the gas-liquid separator 15, 25 to separate the working fluid from the evaporator 11, 21 into a gas phase substance and a liquid phase substance so that the gas phase substance flows toward the turbine 12, 22 and the liquid phase substance is circulated into the inlet side of the evaporator. This makes it possible to increase the total flow rate of the working fluid introduced into the evaporator 11, 21 by an amount of the working fluid in a liquid phase flowing from the gas-liquid separator 15, 25 toward the inlet side of the evaporator in case where the flow rate of the working fluid flowing toward the turbine is set as the same as a steam power cycle unit provided with no gas-liquid separator. In addition, circulation of the working fluid in a liquid phase, which has been separated by the gas-liquid separator 15, 25, into the inlet side of the evaporator, using the auxiliary pump 16, 26 permits to increase a flow velocity of the working fluid in the evaporator 11, 21.

Particularly, when the flow velocity of the working fluid flowing through vertical flow channels is low in the evaporator, which is composed of a cross-flow type heat exchanger, gravity becomes dominant in flowage, with the result that it is not possible to mitigate sufficiently an influence of seawater as the high-temperature fluid flowing in a perpendicular direction to the working fluid on a temperature distribution from the inlet side to the outlet side of the flow channel, and disproportion for heat exchange of the working fluid in the flow channel in the flowing direction of the seawater becomes severe, thus deteriorating performance on evaporation. To the contrary, the flow velocity of the working fluid in the evaporator 11, 21 is increased by the use of the auxiliary pump 16, 26, thus making it possible to cause the working fluid to flow and convect forcedly, equalize the heat exchange to promote evaporation and prevent deterioration of performance, thus achieving a full performance as the evaporator.

In addition, circulation of the working fluid in a liquid phase having a high temperature, which has been separated by the gas-liquid separator 15, 25, into the evaporator 11, 21 makes it possible to reduce a workload of heat exchange in a sensible heat region of the working fluid in the evaporator 11, 21 by an increased amount of temperature of the whole of the working fluid at the inlet of the evaporator, to improve relatively the performance of the evaporator (overall heat transfer coefficient) and control heat loss, thus enhancing heat efficiency.

In addition, it is possible to adjust a flowing condition of the working fluid in a liquid phase into the evaporator 11, 21 by changing an amount of supplying the working fluid in a liquid phase, which has been separated by the gas-liquid separator 15, 25, by the auxiliary pump 16, 26. Along with this, an evaporation condition of the whole of the working fluid in the evaporator 11, 21 may be changed. If an amount of supplying the working fluid in a liquid phase is adjusted by the auxiliary pump 16, 26 in response to variation of the temperature of the heat source due to load variation, seasonal modulation, etc. relative to the steam power cycle unit 10, 20, it is possible to control the evaporation condition of the working fluid in the evaporator 11, 21 in an appropriate manner, thus making the operation condition of the system stable and adjusting dryness of the working fluid in a gas phase flowing out of the evaporator 11, 21, so as to increase the dryness to improve the turbine efficiency.

The above-described auxiliary pump 16, 26 is normally set as operating always during a cycle operation of the steam power cycle unit 10, 20. However, it may be set as operating only when necessary such as an initial start-up. In case where there is a sufficient difference in pressure between the gas-liquid separator 15, 25 and the inlet side of the evaporator 11, 21 in the flow channel for the working fluid in a liquid phase, for example in a stationary operation condition of the steam power cycle unit, the working fluid in a liquid phase can be circulated appropriately into the inlet side of the evaporator, without operating the auxiliary pump, with the result that no operation of the auxiliary pump leads to decrease in self-consumption electric power.

Now, description will be given of an operation state of the steam power cycle system according to the present invention. There is assumed that the warm seawater as the high-temperature fluid and the cold seawater as the low-temperature fluid are taken from the surface of the sea and an area at a predetermined depth of the sea, respectively in the same manner as the first embodiment of the present invention as described above, while ensuring the respective predetermined flow rates, to introduce them into the evaporators 11, 21 and the condensers 13, 23 of each of the steam power cycle units 10, 20, and there is given a difference in water level as a difference in hydraulic head between the seawaters existing in the two regions 34, 35 encompassing the evaporators 11, 21 and the condensers 13, 23 so that there occurs flow of the seawater from one region 34 through the second flow channels 30*c* of the respective heat exchanging body 30 to the other region 35, and heat exchange between the working fluid and the seawater can be made continuously under the same conditions in the heat exchanging body 30.

In the first steam power cycle unit 10, the evaporator 11 causes heat exchange between the warm seawater as the high-temperature fluid, which has been pressurized by the pump 37 and introduced through the region 34, and the working fluid whole in a liquid phase as introduced from the pipe channel 31*a* for the working fluid on the downside, in the heat exchanging body 30. The working fluid, which has been heated through the heat exchange, has a tendency to evaporate to go out of the evaporator 11, but the working fluid is not a saturated vapor, but a wet vapor containing a liquid phase substance. The working fluid having a high temperature in a gas-liquid mixture phase passes through the pipe channel 31*b* for the working fluid in an upper side, flows out of the evaporator 11 and reaches the gas-liquid separator 15. The working fluid is separated into a gas phase substance and a liquid phase substance by the gas-liquid separator 15, and the working fluid in a gas phase flows toward the turbine 12.

The working fluid in a gas phase having a high temperature from the gas-liquid separator 15 has a higher dryness in comparison with the working fluid prior to introduction of it into the gas-liquid separator 15. Such a working fluid reaches the turbine 12 to drive it, and the power generator 51 is driven by this turbine 12 so that heat energy is converted into a usable power and then into an electric power. The working fluid in a gas phase, which has been expanded by the turbine 12 to work, is in a state where pressure and temperature are decreased. Then, the working fluid in a gas phase from the turbine 12 is introduced into the condenser 13.

In the condenser 13, there is made heat exchange between the cold seawater, which first passes through the heat exchanging body 30, on the side of the adjacent region 34, serving as the condenser 23 on the side of the second steam power cycle unit 20, and then is introduced into the heat exchange body 30, on the side of the region 35, serving as this condenser 13, on the one hand, and the working fluid in a gas phase, which has been introduced from the pipe channel 31*b* for the working fluid on the upper side into the heat exchanging body 30, on the other hand, through the heat exchanging plates 30*a*, and the working fluid in a gas phase, which has been cooled, is condensed to be converted into a liquid phase.

The working fluid in a liquid phase, which has been obtained through condensation by the condenser 13, is discharged from the heat exchanging body 30 through the pipe channel 31*a* for the working fluid out of the condenser 13. The working fluid in a liquid phase from the condenser 13 has the lowest temperature and pressure in the steam power cycle unit 10. This working fluid in a liquid phase is flown into the pump 14 and pressurized here, and then toward the evaporator 11.

The working fluid in a liquid phase having a high temperature, which has been separated from the gas phase substance by the gas-liquid separator 15, passes through a pipe channel communicating with the inlet side of the evaporator 11, and is then introduced, together with the working fluid from the pump 14, into the evaporator 11.

Then, the working fluid returns into the evaporator 11, and the step of making heat exchange in the evaporator 11 and the subsequent steps are repeated in the same manner as described above.

On the other hand, in the second steam power cycle unit 20, the evaporator 21 causes heat exchange between the warm seawater as the high-temperature fluid, which has passed through the heat exchanging body, on the side of the region 34, serving as the evaporator 11 of the first steam power cycle unit 10, and the working fluid whole in a liquid phase as introduced from the pipe channel 31*a* for the working fluid on the downside, in the heat exchanging body 30, on the side of the region 35, serving as the evaporator 21. The working fluid as heated here becomes a gas-liquid mixture phase flow containing droplets. This working fluid in a mixture phase having a high temperature passes through the pipe channel 31*b* for the working fluid on the upside, goes out of the evaporator 21, and reaches the gas-liquid separator 25. The working fluid is separated into a gas phase substance and a liquid phase substance by the gas-liquid separator 25, and the working fluid in a gas phase flows toward the turbine 22.

The working fluid in a gas phase having a high temperature from the gas-liquid separator 25 has a higher dryness in comparison with the working fluid prior to introduction of it into the gas-liquid separator 25. Such a working fluid reaches the turbine 22 to drive it, and the power generator 52 is driven by this turbine 22 so that heat energy is converted into a usable power and then into an electric power, in the same manner as the turbine 12 and the power generator 51 as described above. The working fluid in a gas phase, which has been expanded by the turbine 22 to work, is in a state where pressure and temperature are decreased. Then, the working fluid in a gas phase from the turbine 22 is introduced into the condenser 23.

In the condenser 23, there is made heat exchange between the cold seawater having a low temperature, which has been pressurized as the low-temperature fluid by the pump 38 and then introduced through the region 34 into the heat exchanging body 30, on the one hand, and the working fluid in a gas phase, which has been introduced from the pipe channel 31*b* for the working fluid into the heat exchanging body 30, on the other hand, through the heat exchanging plates 30*a*, to cool the working fluid, and this working fluid in a gas phase is condensed to be converted into a liquid phase.

The working fluid in a liquid phase, which has been obtained through condensation by the condenser 23, is discharged from the heat exchanging body 30 through the pipe channel 31*a* for the working fluid out of the condenser 23. The working fluid in a liquid phase from the condenser 23 has the lowest temperature and pressure in the steam power cycle unit 20. This working fluid in a liquid phase is flown into the pump 24 and pressurized here, and then flows toward the evaporator 21.

The working fluid in a liquid phase having a high temperature, which has been separated from the gas phase substance by the gas-liquid separator 25, passes through a pipe channel communicating with the inlet side of the evaporator 21, and is then introduced, together with the working fluid from the pump 24, into the evaporator 21.

Then, the working fluid in the second steam power cycle unit 20 returns into the evaporator 21, and the step of making heat exchange in the evaporator 21 and the subsequent steps are repeated in the same manner as described above.

The seawater as the low-temperature fluid, which has been continuously used in the respective heat exchange in the condenser 23 and the condenser 13, has received heat from the working fluid, with the result that it has a predetermined temperature as raised. This seawater flows out from the opening of the partition wall 36, which communicates with the region 35, and is finally discharged into the sea out of the system for spreading.

The seawater as the high-temperature fluid with a decreased temperature due to the heat exchange with the respective working fluid in the evaporator 11 and the evaporator 21, also flows out from the opening of the partition wall 36 through the region 35, and is finally discharged into the sea out of the system for spreading.

On the other hand, new seawater is introduced through the opening of the partition wall 36 into the region 34, and then subjected to the heat exchange by the respective heat exchanging body 30 for constituting the evaporator 11 and the condenser 23. The above-described steps are repeated during using the system, i.e., during continuing the operation of the respective steam power cycle in the two steam power cycle units 10, 20.

It may be deemed, in the same manner as the first embodiment of the present invention as described above, that, since the high-temperature fluid and the low-temperature fluid are seawater existing in an extremely large amount, it is almost negligible an effect of heat held by the seawater, which has been subjected to the heat exchange on the whole of the sea, after spreading the seawater, which has been subjected to the heat exchange, into the water outside the system, and namely variation in temperature of the whole of the sea after spreading the seawater, there occurs no variation in temperature of seawater, which is newly and sequentially introduced into the heat exchanging body 30, along with the continuous operation of heat exchange, and it is possible to continuously make heat exchange under the same temperature condition as the initial operation of heat exchange.

In the steam power cycle system according to the embodiment of the present invention, the working fluid from the evaporator 11, 21 in the respective steam power cycle unit 10, 20 is separated into the gas phase substance and the liquid phase substance by the gas-liquid separator 15, 25, and the working fluid in a gas phase is caused to flow toward the turbine 12, 22 and the working fluid in a liquid phase is caused to flow toward an inlet of the evaporator 11, 21. This causes circulation of the working fluid having a high temperature in a liquid phase into the evaporator 11, 21 to increase the temperature of the entirety of the working fluid at the inlet of the evaporator, thus permitting to make heat exchange on a higher temperature side in the evaporator 11, 21, and a workload of heat exchange in a sensible heat region of the working fluid in the evaporator 11, 21 may be reduced by an increased amount of temperature of the working fluid, to improve efficiency of heat transfer to the working fluid in the evaporator 11, 21, thus controlling heat loss over the entire system and enhancing heat efficiency.

In addition, adjustment, with the use of the auxiliary pump 16, 26, in condition of flowing of the working fluid in a liquid phase as separated by the gas-liquid separator 15, 25, into the evaporator 11, 21 would permit to change the evaporation state of the working fluid in the evaporator 11, 21, thus making it possible to make the operational state of the system stable in response to variation of load to the steam power cycle unit 10, 20, the temperature of the heat source due to seasonal modulation, etc.

Figure 13:
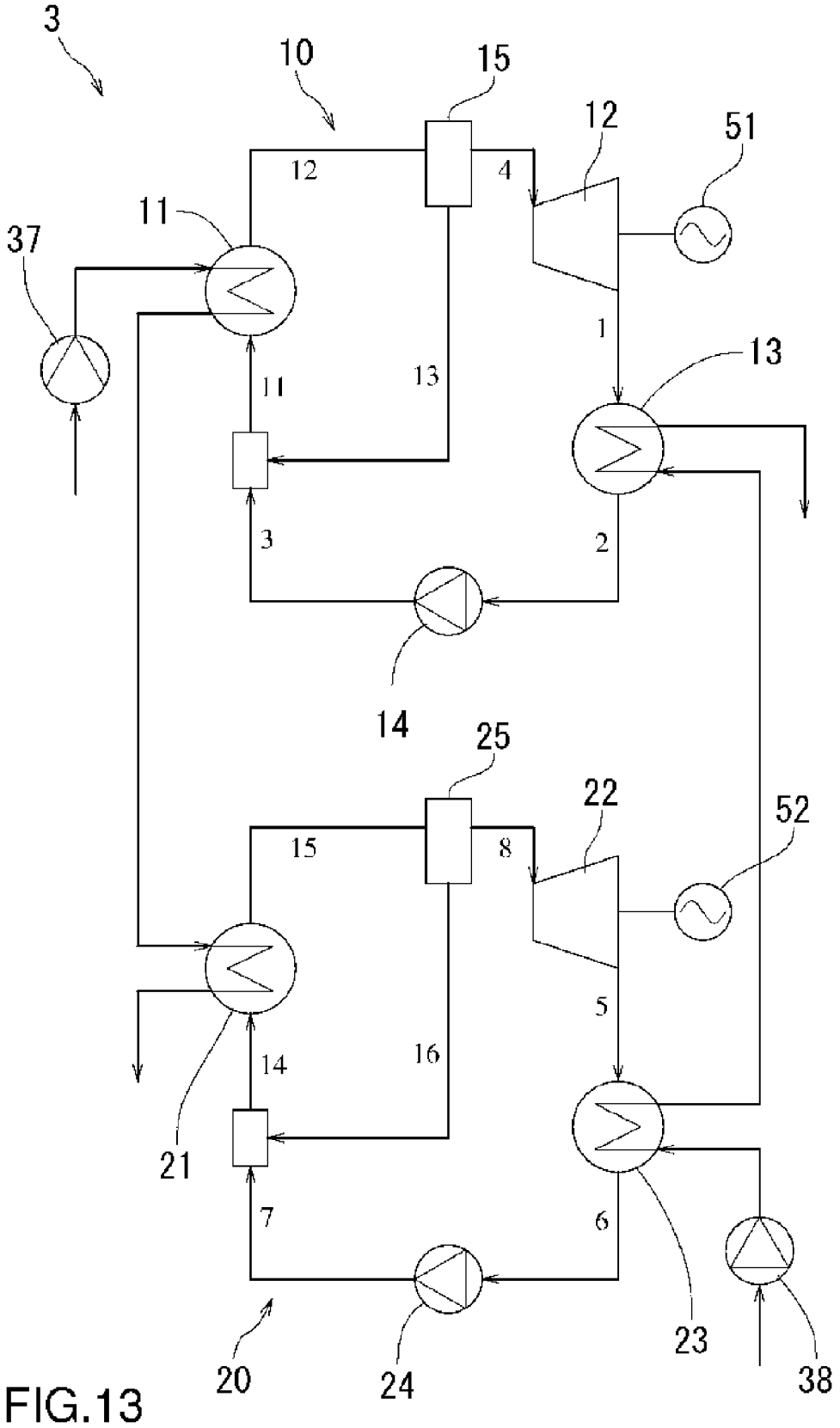
FIG. 13 is a schematic system diagram of another steam power cycle system according to the third embodiment of the present invention.

In the steam power cycle system according to the embodiment of the present invention as described above, there is applied a structure in which the auxiliary pumps 16, 26 are provided in the flow channels for the working fluid in a liquid phase having a high temperature, flowing from the gas-liquid separators 15, toward the inlet sides of the evaporators 11, 21. However, the present invention is not limited only to this embodiment, and there may be applied a structure that no pump, etc. is provided in the flow channels for the working fluid in a liquid phase having a high temperature, flowing from the gas-liquid separators 15, 25 toward the inlet sides of the evaporators 11, 21, as shown in FIG. 13. In case where there is a sufficiently large difference in pressure between the gas-liquid separator 15, 25 and the inlet side of the evaporator 11, 21, and pressure loss of the flow channel as described above is small, it is possible to cause the working fluid to reach surely the inlet side of the evaporator without applying pressure by the pump, etc. In addition, there may be applied adjustment to placing, instead of providing the auxiliary pump 16, 26, the gas-liquid separator 15, 25 in a higher position than the evaporator 11, 21, to ensure difference in pressure by a liquid level, or decreasing a flow rate of the working fluid, which has been flown out of the condenser 13, 23 and then to be supplied into the evaporator 11, 21, so that the whole of the working fluid is to be evaporated, and then increasing the flow rate of the working fluid in the pump 14, 24, when difference in pressure occurs.

Fourth Embodiment

Now, the fourth embodiment of the present invention will be described below with reference to FIG. 14.

Figure 14:
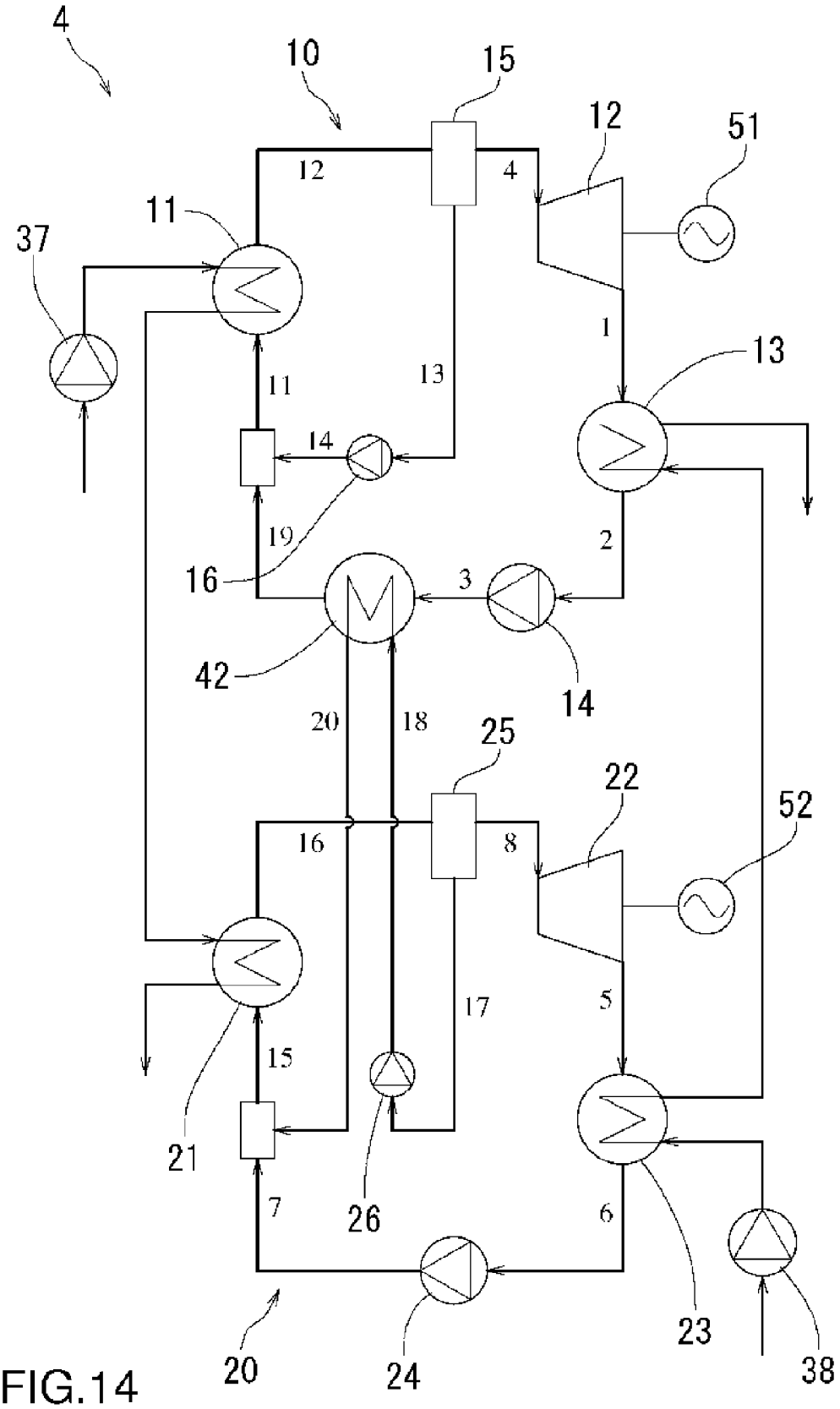
FIG. 14 is a schematic system diagram of a steam power cycle system according to the fourth embodiment of the present invention.

In FIG. 14 as indicated above, the steam power cycle system 4 according to the embodiment of the present invention includes the steam power cycle units 10, 20 having the gas-liquid separators 15, 25, respectively, in the same manner as the third embodiment of the present invention as described above, but has a different structure that there is provided a regenerative heat exchanger 42 that makes heat exchange between the working fluid in a liquid phase flowing from the gas-liquid separator 25 toward the inlet side of the evaporator 21 in the second steam power cycle unit 20 as described above, on the one hand, and the working fluid flowing from the outlet of the pump 14 toward the evaporator 11 in the first steam power cycle unit 10 having a preceding passing order for the high-temperature fluid relative to the second steam power cycle unit 20, on the other hand.

The regenerative heat exchanger 42 as indicated above is a heat exchanger that makes heat exchange between the working fluid having the lowest temperature and pressure in the first steam power cycle unit 10, which has flown from the condenser 13, passed through the pump 14 and then flows toward the evaporator 11 in the first steam power cycle unit 10, on the one hand, and the working fluid in a liquid phase having a high temperature, which has been separated from the working fluid in a gas phase by the gas-liquid separator 25 in the second steam power cycle unit 20, on the other hand. It has the same structure as the respective heat exchanging body 11*b*, 14*b* of the evaporator 11, 21 or the condenser 13, 23 as described above, and description of it will be omitted.

This regenerative heat exchanger 42 has a structure that a branch channel 1*b*, on the side of the working fluid in a liquid phase having a high temperature, communicating with the outlet 11*d* for the working fluid of the gas-liquid separator 25, is connected to the inlet side of the evaporator 21 by a pipe channel so that the working fluid in a liquid phase from the regenerative heat exchanger 42 is introduced into the evaporator 21.

Now, description will be given of an operation state of the steam power cycle system according to the present invention. There is assumed that the warm seawater as the high-temperature fluid and the cold seawater as the low-temperature fluid are taken from the surface of the sea and an area at a predetermined depth of the sea, respectively in the same manner as the first embodiment of the present invention as described above, while ensuring the respective predetermined flow rates, to introduce them into the evaporators 11, 21 and the condensers 13, 23 of each of the steam power cycle units 10, 20, and there is given a difference in water level as a difference in hydraulic head between the seawaters existing in the two regions 34, 35 encompassing the evaporators 11, 21 and the condensers 13, 23 so that there occurs flow of the seawater from one region 34 through the second flow channels 30*c* of the respective heat exchanging body 30 to the other region 35, and heat exchange between the working fluid and the seawater can be made continuously under the same conditions in the heat exchanging body 30.

In the first steam power cycle unit 10, the evaporator 11 causes heat exchange between the warm seawater as the high-temperature fluid, which has been pressurized by the pump 37 and introduced through the region 34, and the working fluid whole in a liquid phase as introduced from the pipe channel 31*a* for the working fluid on the downside, in the heat exchanging body 30. The working fluid, which has been heated through the heat exchange, has a tendency to evaporate to go out of the evaporator 11, but the working fluid is not a saturated vapor, but a wet vapor containing a liquid phase substance. The working fluid having a high temperature in a gas-liquid mixture phase passes through the pipe channel 31*b* for the working fluid in an upper side, flows out of the evaporator 11 and reaches the gas-liquid separator 15. The working fluid is separated into a gas phase substance and a liquid phase substance by the gas-liquid separator 15, and the working fluid in a gas phase flows toward the turbine 12.

The working fluid in a gas phase having a high temperature from the gas-liquid separator 15 has a higher dryness in comparison with the working fluid prior to introduction of it into the gas-liquid separator 15. Such a working fluid reaches the turbine 12 to drive it, and the power generator 51 is driven by this turbine 12 so that heat energy is converted into a usable energy. The working fluid in a gas phase, which has been expanded by the turbine 12 to work, is in a state where pressure and temperature are decreased. Then, the working fluid in a gas phase from the turbine 12 is introduced into the condenser 13.

In the condenser 13, there is made heat exchange between the cold seawater, which first passes through the heat exchanging body 30, on the side of the adjacent region 34, serving as the condenser 23 on the side of the second steam power cycle unit 20, and then is introduced into the heat exchange body 30, on the side of the region 35, serving as this condenser 13, on the one hand, and the working fluid in a gas phase, which has been introduced from the pipe channel 31*b* for the working fluid on the upper side into the heat exchanging body 30, on the other hand, through the heat exchanging plates 30*a*, and the working fluid in a gas phase, which has been cooled, is condensed to be converted into a liquid phase.

The working fluid in a liquid phase, which has been obtained through condensation by the condenser 13, is discharged from the heat exchanging body 30 through the pipe channel 31*a* for the working fluid out of the condenser 13. The working fluid in a liquid phase from the condenser 13 has the lowest temperature and pressure in the steam power cycle unit 10. This working fluid in a liquid phase is flown into the pump 14 and pressurized here, and then toward the regenerative heat exchanger 42.

In the regenerative heat exchanger 42, there is made heat exchange between the working fluid in a liquid phase from the pump 14 as described above and the working fluid in a liquid phase, which has been separated by the gas-liquid separator 25 in the second steam power cycle unit 20 as described above, to increase the temperature of the working fluid in a liquid phase on the side of the first steam power cycle unit 10, thus recovering heat held by the working fluid in a liquid phase on the side of the second steam power cycle unit 20. The working fluid in a liquid phase having an increased temperature on the side of the first steam power cycle unit 10 flows out of the regenerative heat exchanger 42 and then flows toward the evaporator 11.

The working fluid in a liquid phase having a high temperature, which has been separated from the gas phase substance by the gas-liquid separator 15, passes through a pipe channel communicating with the inlet side of the evaporator 11, and is then introduced, together with the working fluid from the regenerative heat exchanger 42, into the evaporator 11.

Then, the working fluid returns into the evaporator 11, and the step of making heat exchange in the evaporator 11 and the subsequent steps are repeated in the same manner as described above.

On the other hand, in the second steam power cycle unit 20, the evaporator 21 causes heat exchange between the warm seawater as the high-temperature fluid, which has passed through the heat exchanging body, on the side of the region 34, serving as the evaporator 11 of the first steam power cycle unit 10, and the working fluid whole in a liquid phase as introduced from the pipe channel 31*a* for the working fluid on the downside, in the heat exchanging body 30, on the side of the region 35, serving as the evaporator 21. The working fluid as heated here becomes a gas-liquid mixture phase flow containing droplets. This working fluid in a mixture phase having a high temperature passes through the pipe channel 31*b* for the working fluid on the upside, goes out of the evaporator 21, and reaches the gas-liquid separator 25. The working fluid is separated into a gas phase substance and a liquid phase substance by the gas-liquid separator 25, and the working fluid in a gas phase flows toward the turbine 22.

The working fluid in a gas phase having a high temperature from the gas-liquid separator 25 has a higher dryness in comparison with the working fluid prior to introduction of it into the gas-liquid separator 25. Such a working fluid reaches the turbine 22 to drive it, and the power generator 51 is driven by this turbine 22 so that heat energy is converted into a usable energy. The working fluid in a gas phase, which has been expanded by the turbine 22 to work, is in a state where pressure and temperature are decreased, and it flows out of the turbine 22 and is then introduced into the condenser 23.

In the condenser 23, there is made heat exchange between the cold seawater having a low temperature, which has been pressurized as the low-temperature fluid by the pump 38 and then introduced through the region 34 into the heat exchanging body 30, on the one hand, and the working fluid in a gas phase, which has been introduced from the pipe channel 31*b* for the working fluid into the heat exchanging body 30, on the other hand, through the heat exchanging plates 30*a*, to cool the working fluid, and this working fluid in a gas phase is condensed to be converted into a liquid phase.

The working fluid in a liquid phase, which has been obtained through condensation by the condenser 23, is discharged from the heat exchanging body 30 through the pipe channel 31*a* for the working fluid out of the condenser 23. The working fluid in a liquid phase from the condenser 23 has the lowest temperature and pressure in the steam power cycle unit 20. This working fluid in a liquid phase is flown into the pump 24 and pressurized here, and then flows toward the evaporator 21.

The working fluid in a liquid phase having a high temperature, which has been separated from the gas phase substance by the gas-liquid separator 25, passes through a pipe channel communicating with the inlet side of the evaporator 21, and is then introduced into the regenerative heat exchanger 42. In this regenerative heat exchanger 42, there is made heat exchange between the working fluid in a liquid phase having a high temperature, which has been separated by the gas-liquid separator 25 as described above, on the one hand, and the working fluid in a liquid phase from the pump 14 in the first steam power cycle unit 10, on the other hand, to increase the temperature of the working fluid on the side of the first steam power cycle unit 10.

The working fluid in a liquid phase on the side of the second steam power cycle unit 20, which has been cooled by this regenerative heat exchanger 42, flows out of the regenerator 42, passes through a pipe channel communicating with the inlet side of the evaporator 21, and is then introduced, together with the working fluid from the pump 24, into the evaporator 21.

Then, all the working fluid in the second steam power cycle unit 20 returns into the evaporator 21, and the step of making heat exchange in the evaporator 21 and the subsequent steps are repeated in the same manner as described above.

The seawater as the low-temperature fluid, which has been continuously used in the respective heat exchange in the condenser 23 and the condenser 13, has received heat from the working fluid, with the result that it has a predetermined temperature as raised. This seawater flows out from the opening of the partition wall 36, which communicates with the region 35, and is finally discharged into the sea out of the system for spreading.

The seawater as the high-temperature fluid with a decreased temperature due to the heat exchange with the respective working fluid in the evaporator 11 and the evaporator 21, also flows out from the opening of the partition wall 36 through the region 35, and is finally discharged into the sea out of the system for spreading.

On the other hand, new seawater is introduced through the opening 36*a* of the partition wall 36 into the region 34, and then subjected to the heat exchange by the respective heat exchanging body 30 for constituting the evaporator 11 and the condenser 23. The above-described steps are repeated during using the system, i.e., during continuing the operation of the respective steam power cycle in the two steam power cycle units 10, 20.

It may be deemed, in the same manner as the first embodiment of the present invention as described above, that, since the high-temperature fluid and the low-temperature fluid are seawater existing in an extremely large amount, it is almost negligible an effect of heat held by the seawater, which has been subjected to the heat exchange on the whole of the sea, after spreading the seawater, which has been subjected to the heat exchange, into the water outside the system, and namely variation in temperature of the whole of the sea after spreading the seawater, there occurs no variation in temperature of seawater, which is newly and sequentially introduced into the heat exchanging body 30, along with the continuous operation of heat exchange, and it is possible to continuously make heat exchange under the same temperature condition as the initial operation of heat exchange.

In the steam power cycle system according to the embodiment of the present invention, the working fluid from the evaporator in each of the steam power cycle unit 10, 20 is separated into a gas phase substance and a liquid phase substance, and the regenerative heat exchanger 42 makes, during causing the working fluid in a liquid phase to flow toward the inlet side of the evaporator, heat exchange between the working fluid in a liquid phase, which has been separated by the gas-liquid separator 25 in the second steam power cycle unit 20, on the one hand, and the working fluid flowing from the outlet of the pump 14 in the first steam power cycle unit 10, on the other hand, to increase the temperature of the working fluid in a liquid phase on the side of the first steam power cycle unit 10, thus recovering heat held by the working fluid in a liquid phase on the side of the second steam power cycle unit 20. This makes it possible not only to control heat loss over the entire system with the heat exchange of the working fluids between the steam power cycle units 10, 20, but also reduce, especially in the second steam power cycle unit 20, a workload of heat exchange in a sensible heat region of the working fluid in the evaporator 21 may be reduced by an increased amount of temperature of the working fluid, which has previously increased by the regenerative heat exchanger 42 as provided on the upstream side relative to the evaporator 21, to improve efficiency of heat transfer to the working fluid in the evaporator 21, thus enhancing heat efficiency over the entire system.

Figure 15:
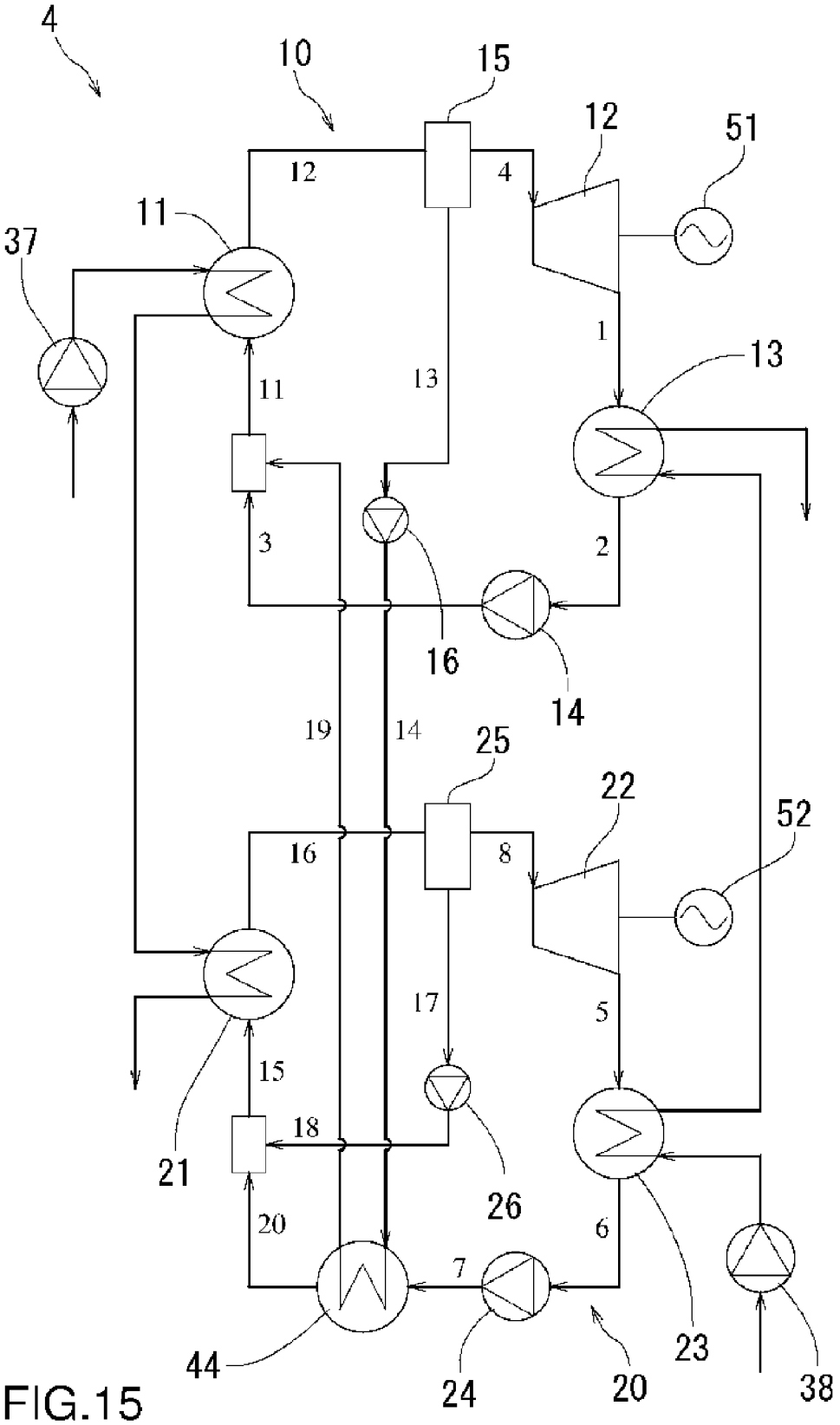
FIG. 15 is a schematic system diagram of another steam power cycle system according to the fourth embodiment of the present invention.

In the steam power cycle system according to the embodiment of the present invention as described above there is applied a structure in which the regenerative heat exchanger 42 makes heat exchange between the working fluid in a liquid phase, which has been separated by the gas-liquid separator 25 in the second steam power cycle unit 20, on the one hand, and the working fluid flowing from the outlet of the pump 14 in the first steam power cycle unit 10, on the other hand, to increase the temperature of the working fluid in a liquid phase on the side of the first steam power cycle unit 10, thus recovering heat held by the working fluid in a liquid phase on the side of the second steam power cycle unit 20. However, the present invention is not limited only to this embodiment, and there may be applied a structure in which there is provided another regenerative heat exchanger 44 that makes heat exchange, as shown in FIG. 15, between the working fluid in a liquid phase, which has been separated by the gas-liquid separator 15 in the steam power cycle unit having the most anterior order for passing the high-temperature fluid into the evaporator of a plurality of steam power cycle units, i.e., in the first steam power cycle unit 10, and then flows toward the inlet side of the evaporator 11, on the one hand, and the working fluid from the pump 24 in the steam power cycle unit having the posterior order for passing the high-temperature fluid into the evaporator, relative to the first steam power cycle unit 10, i.e., in the second steam power cycle unit 20, on the other hand, to increase the temperature of the working fluid in a liquid phase on the side of the second steam power cycle unit 20, thus recovering heat held by the working fluid in a liquid phase on the side of the first steam power cycle unit 10 and improving a heat cycle efficiency in the same manner as described above.

Figure 16:
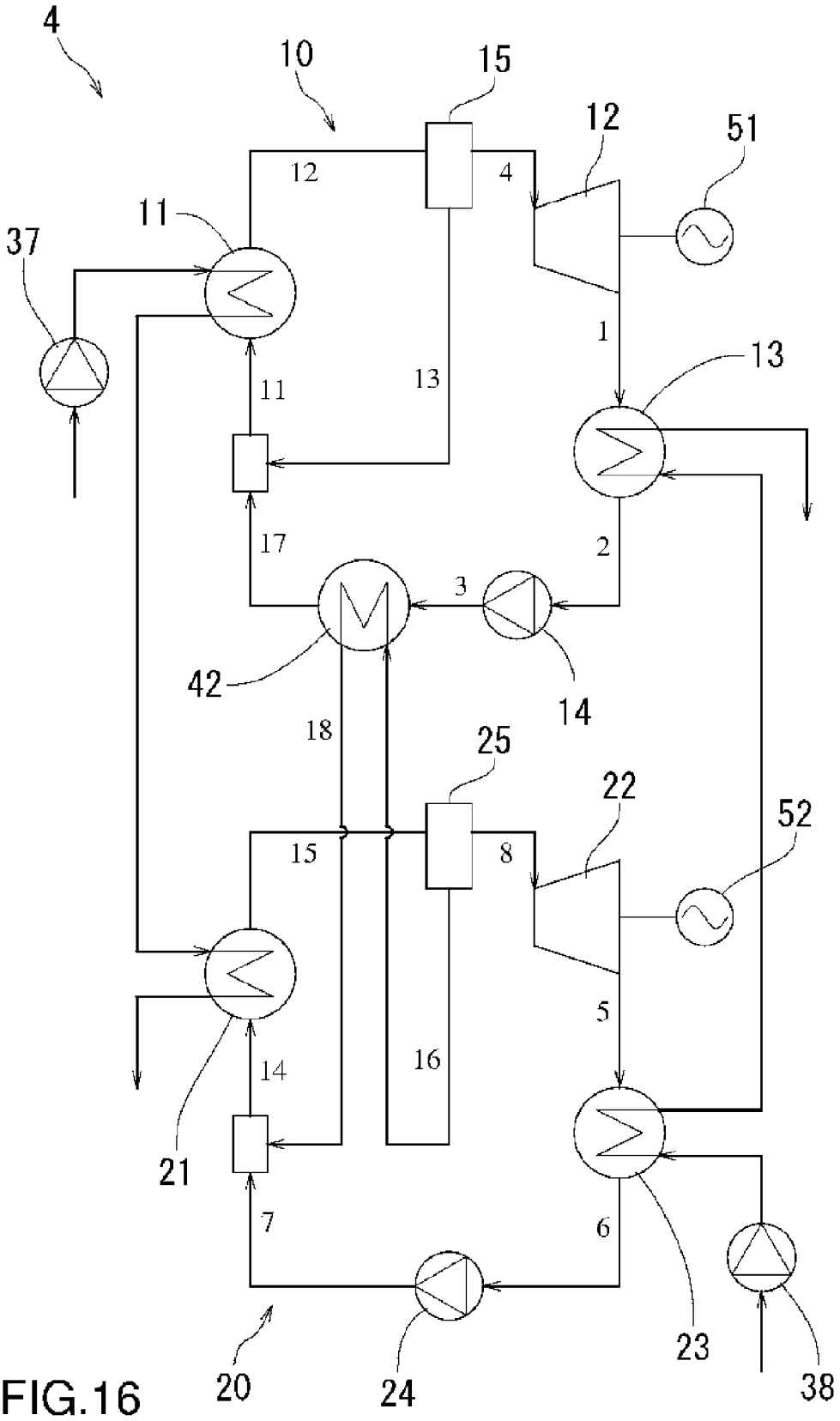
FIG. 16 is a schematic system diagram of still another steam power cycle system according to the fourth embodiment of the present invention.

In the steam power cycle system according to the fourth embodiment of the present invention as described above, there is applied a structure in which the auxiliary pumps 16, 26 are provided in the flow channels for the working fluid in a liquid phase having a high temperature, flowing from the gas-liquid separators 15, 25 toward the inlet sides of the evaporators 11, 21. However, the present invention is not limited only to this embodiment, and there may be applied a structure that no pump, etc. is provided in the flow channels for the working fluid in a liquid phase having a high temperature, flowing from the gas-liquid separators 15, 25 toward the inlet sides of the evaporators 11, 21, as shown in FIG. 16. In case where there is a sufficiently large difference in pressure between the gas-liquid separator 15, 25 and the inlet side of the evaporator 11, 21, and pressure loss is sufficiently small, even when the working fluid in a liquid phase can pass through the regenerative heat exchanger 42 and be introduced into the inlet side of the evaporator 21, it is possible to cause the working fluid to reach surely the inlet side of the evaporator without applying pressure by the pump, etc.

In the steam power cycle system according to each of the first to fourth embodiments of the present invention as described above, there is applied a structure that, a passing order for the high-temperature in each of the steam power cycle units 10, 20 for connecting the flow channels in series to each other for the high-temperature in each of the evaporators 11, 21 in the steam power cycle units 10, 20 as provided in multistage, and a passing order for the low-temperature in each of the steam power cycle units 10, 20 for connecting the flow channels in series to each other for the low-temperature in each of the condensers 13, 23 are set to be inverse with each other. However, the present invention is not limited only to this embodiment, and there may be applied a structure that a passing order for the high-temperature fluid and the low-temperature fluid in the respective steam power cycle units is set as the same order between the high-temperature fluid and the low-temperature fluid, and there may be set an appropriate structure in which the high-temperature fluid and the low-temperature fluid can naturally be introduced into the evaporator or condenser in response to an introduction position of the high-temperature fluid and the low-temperature fluid into the system and the position of the evaporator or condenser of each of the steam power cycle units.

In the steam power cycle system according to each of the first to fourth embodiments of the present invention as described above, there is applied a structure that the same kind of working fluid is used in each of the steam power cycle units 10, 20 as provided in multistage. However, there may be applied a structure that the steam power cycle unit uses the working fluid as being circulated in it as the different working fluid from that used in the other one or plurality of steam power cycle units so that a magnitude relationship in boiling point between these different working fluids corresponds to a magnitude relationship in temperature between the high-temperature fluids, which are to be subjected to heat exchange in the steam power cycle unit in which the respective working fluids are circulated. The different kinds of working fluids are used in the respective steam power cycle units to cope with a temperature region of the high-temperature fluid to be subjected to heat exchange so that the working fluid in the respective steam power cycle unit has characteristic properties such as a boiling point, etc., according to a temperature level of the high-temperature fluid for circulating in the respective steam power cycle unit, and namely, a boiling point of the working fluid for circulating in this steam power cycle unit becomes higher in the steam power cycle unit having a more anterior passing order for the high-temperature fluid for circulation, with the result that a workload of heat exchange in a sensible heat region of the working fluid can be reduced, and heat loss can be kept to the minimum necessary, thus converting effectively heat energy into power, etc. In case of using the different kinds of working fluids, it is preferable in relationship with a phase change of each of the working fluids that a passing order for the high-temperature fluid and a passing order for the low-temperature fluid in a plurality of steam power cycle units are to be inverse with each other.

EXAMPLES

Values relating to performance such as heat efficiency have been determined with the use of condition such as an amount of heat input and output, pressure, etc., for the steam power cycle system according to the present invention. The results as obtained were compared with results for examples for comparison of the conventional steam power cycle, etc, for assessment, and there was made a judgment as to whether an effective improvement in performance was achieved or not.

However, when determining values relating to performance such as heat efficiency for the steam power cycle system according to the present invention, no consideration was made on internal efficiency of the turbine, pump, etc., mechanical efficiency, pressure loss in the heat exchanger, etc., if not otherwise specified.

Example No. 1

First, there was used, as Example No. 1 of the Invention, the same steam power cycle system as the first embodiment of the present invention as described above, and namely, the steam power cycle units as provided in a dual stage as shown in FIG. 1, the high-temperature fluid was caused to flow continuously in the evaporator of each of the steam power cycle units, as well as the low-temperature fluid was caused to flow continuously in the condenser of each of the steam power cycle units, and values of heat efficiency, etc., were calculated for heat exchange between the high-temperature fluid or the low-temperature fluid and the working fluid in each of the steam power cycle units. For calculation, various kinds of physical properties indicative of pressure, temperature, etc., of the working fluid at each point (1 to 4, 5 to 8) of the cycle as shown in FIG. 1 were calculated using assumed values based on an actual environment such as heat transfer performance of the heat exchanger for the evaporator and condenser, temperature conditions of the high-temperature fluid and the low-temperature fluid as the heat source, etc., and then respective values such as heat efficiency, etc., of the cycle were calculated.

Concerning the major conditions for the steam power cycle of Example No. 1 of the Invention, ammonia was used as the working fluid in each of the steam power cycle units, an inlet temperature $T_{WSI}$ on the side of the high-temperature fluid in the evaporator 11 of the first steam power cycle unit 10 was set as 28° C., an outlet temperature $T_{WSM}$ thereon was set as 26° C., and an outlet (at Point 4) temperature $T_4$ of the evaporator for the working fluid, which was to be subjected to heat exchange with the above-mentioned working fluid was set as 24° C. In addition, an inlet temperature $T_{WSM}$ on the side of the high-temperature fluid in the evaporator 21 of the second steam power cycle unit 20 was set as 26° C., an outlet temperature $T_{WSO}$ thereon was set as 24° C., and an outlet (at Point 8) temperature $T_8$ of the evaporator for the working fluid, which was to be subjected to heat exchange with the above-mentioned working fluid was set as 22° C.

On the other hand, an inlet temperature $T_{CSI}$ on the side of the low-temperature fluid in the condenser 23 of the second steam power cycle unit 20 was set as 4° C., an outlet temperature $T_{CSM}$ thereon was set as 7° C., and an outlet (at Point 6) temperature $T_6$ of the condenser for the working fluid, which was to be subjected to heat exchange with the above-mentioned working fluid was set as 9° C. In addition, an inlet temperature $T_{CSM}$ on the side of the low-temperature fluid in the condenser 13 of the first steam power cycle unit 10 was set as 7° C., an outlet temperature $T_{CSO}$ thereon was set as 10° C., and an outlet (at Point 2) temperature $T_2$ of the condenser for the working fluid, which was to be subjected to heat exchange with the above-mentioned working fluid was set as 12° C.

The flow rate $G_{WF1}$ of the working fluid in the first steam power cycle unit 10 was set as 65.2 t/h. In addition, the flow rate $G_{WF2}$ of the working fluid in the second steam power cycle unit 20 was set as 64.6 t/h. Further, the flow rate $G_{WS}$ of the working fluid was set as 10000 t/h and the flow rate $G_{CS}$ of the working fluid was set as 6390 t/h.

Each of the condition values such as a pressure P, a temperature T, a specific enthalpy h, etc. of the working fluid in each point (1 to 4, 5 to 8) of the steam power cycle is shown in Table 1.

See Appendix A, Table 1.

Figure 17:
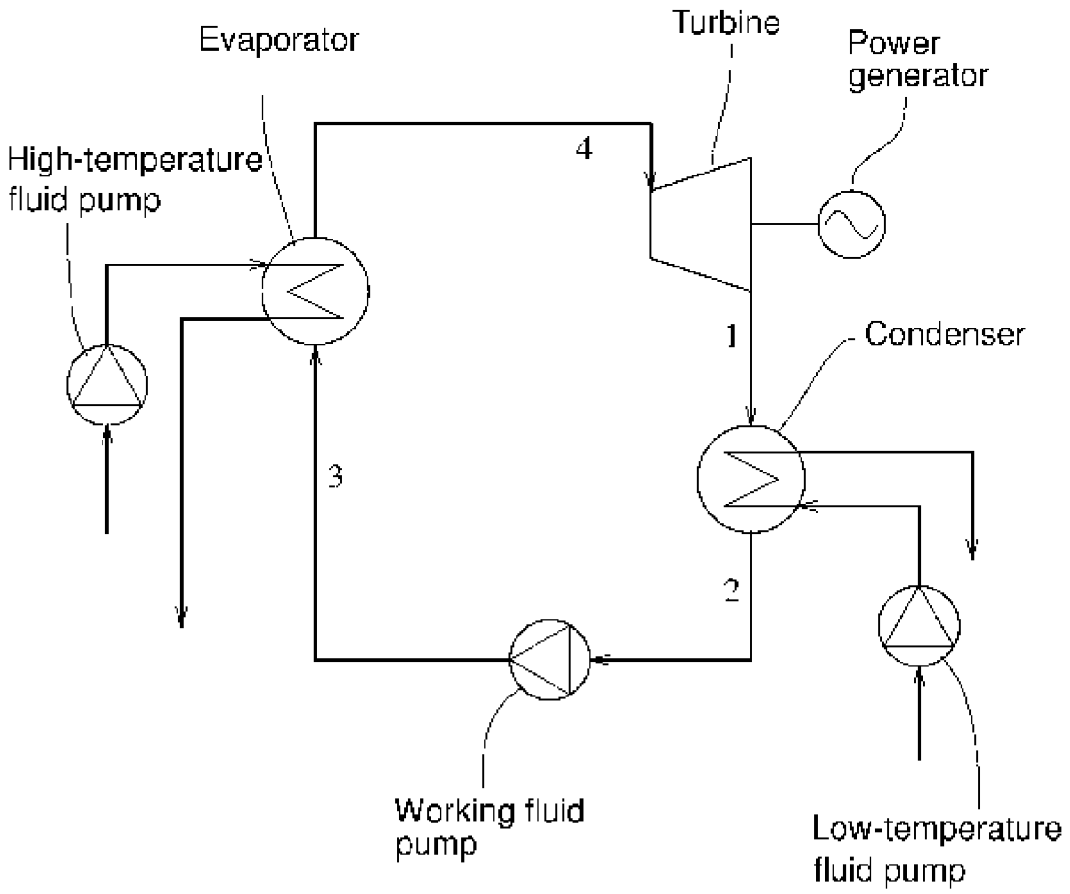
FIG. 17 is a schematic system diagram of a single-stage system as a comparative example to the steam power cycle system according to the embodiments of the present invention.
Figure 18:
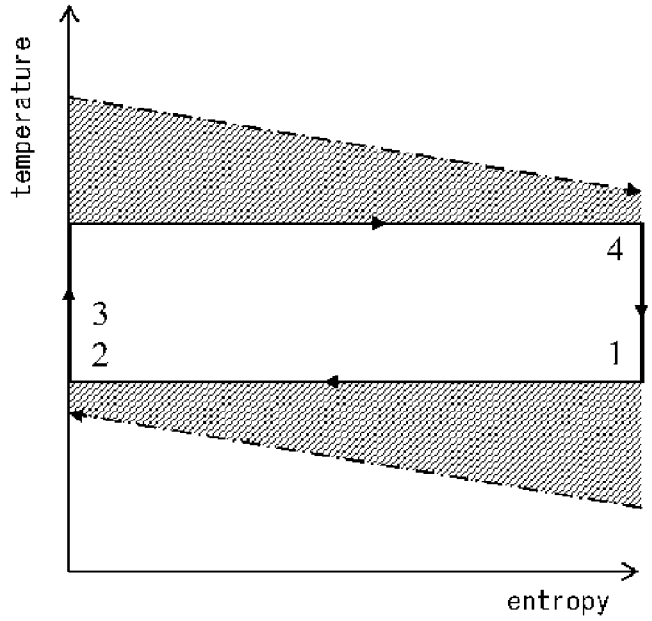
FIG. 18 is a descriptive view of an improved state of heat cycle efficiency by a multiple stage of a conventional Rankine cycle.
Figure 18:
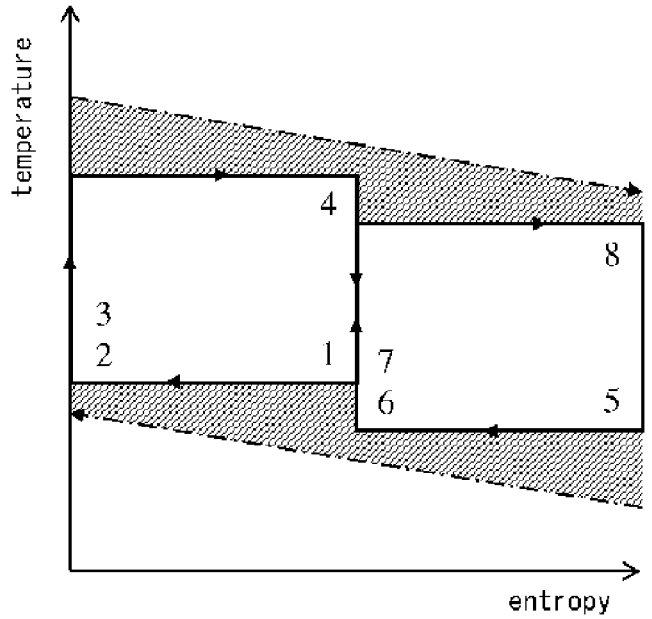
Figure 19:
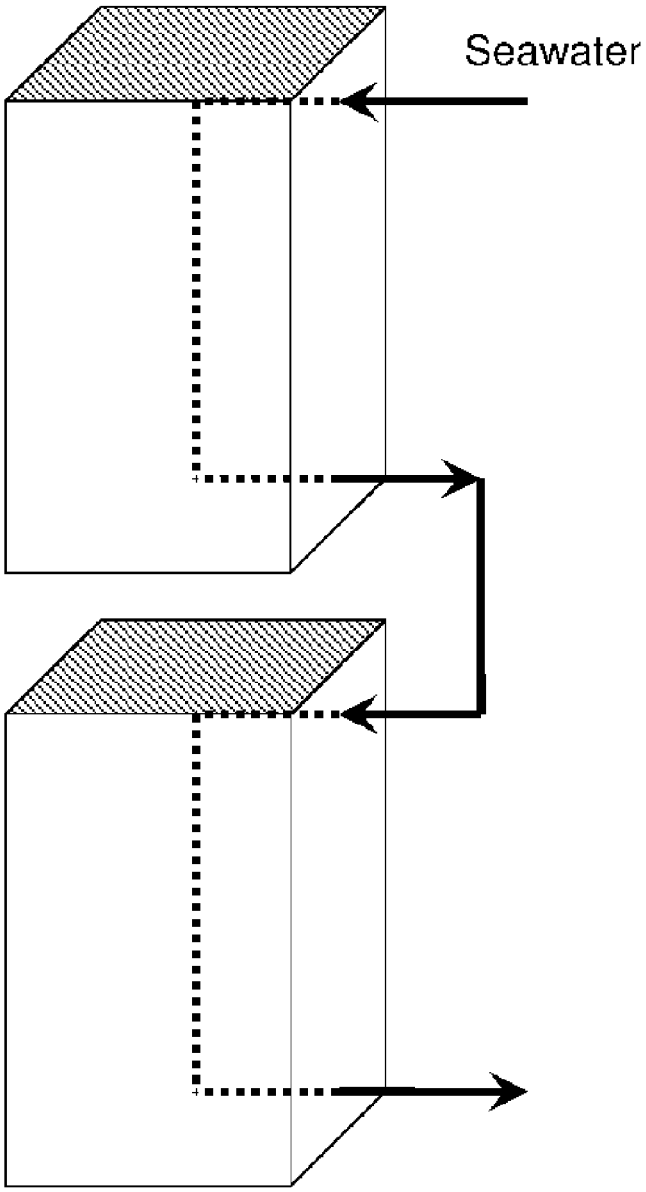
FIG. 19 is a schematic descriptive view of a flow channel of seawater in a plurality of heat exchangers in the conventional multistage steam power cycle.

For each of the systems in a single stage (see FIG. 17; Example No. 1 for Comparison) and in a dual stage (Example No. 2 for Comparison) based on Rankine cycle using the conventional counter-flow type heat exchanger as the evaporator and the condenser, as well as the system with the same steam power cycle unit as the example of the invention, in a single stage (Example No. 3 for Comparison), as the examples for comparison, conditions such as a pressure, a temperature, etc. of the working fluid at each point (1 to 4, 5 to 8) of the cycle were determined, and then heat efficiency of the cycle was obtained in the same manner as Example No. 1 of the Invention.

The temperature conditions of the high-temperature fluid and the low-temperature fluid, as well as the temperature of the working fluid at the respective points of the cycle were the same as the set values for the apparatus according to Example No. 1 of the present invention, except that the temperature of the working fluid at the outlet of the evaporator was set as 22° C.

Each of the condition values at each point of the cycle for the example for comparison was also shown in this table, together with each value in case of Example No. 1 of the Invention. Of the examples for comparison, the respective conditions values for Example No. 1 for Comparison and Example No. 2 for Comparison were shown in Table 2, and those for Example No. 3 for Comparison were shown, together with the respective values for Example No. 1 of the Invention, in Table 1.

See Appendix A, Table 2.

Based on the condition values of the respective fluids as the heat source and the working fluid, as shown in Table 1, the heat efficiency $\eta_{th}$ of the cycle for Example No. 1 of the Invention may be expressed as follows:

$$\eta_{th}=(W_T-W_{PWF})/Q_E=\{(W_{T1}+W_{T2})-(W_{PWF1}+W_{PWF2})\}/(Q_{E1}+Q_{E2})$$

Here, the turbine output $W_T=W_{T1}+W_{T2}=G_{WF1}(h_4-h_1)+G_{WF2}(h_8-h_5)=65.2\times10^3(1626.0\times10^3-1577.1\times10^3)/3600+64.6\times10^3(1624.7\times10^3-1570.9\times10^3)/3600=6663.8\times10^6/3600$ In addition, the pump power $W_{PWF}=W_{PWF1}+W_{PWF2})=G_{WF1}(h_3-h_2)+G_{WF2}(h_7-h_6)=65.2\times10^3(399.6\times10^3-399.1\times10^3)/3600+64.6\times10^3(385.5\times10^3-385.0\times10^3)/3600=64.9\times10^6/3600$ Further, the heat exchange amount $Q_E$ of the evaporator$=Q_{E1}+Q_{E2}=G_{WS}Cp_{WS}(T_{WSM}-T_{WSI})+G_{WS}Cp_{WS}(T_{WSO}-T_{WSM})=G_{WS}Cp_{WS}(T_{WSO}-T_{WSI})=10000\times10^3\cdot4.0\times10^3(28-24)/3600=160000\times10^6/3600$ From these relationship, $$\eta_{th}=(6663.8-64.9)/160000=0.0412$$

Therefore, the heat efficiency of the cycle for Example No. 1 of the Invention was 4.12%.

Pressure loss $dP_{E1}$ of the high-temperature fluid of the evaporator in the first steam power cycle unit was determined as 11.0 kPa from actually measured values for the heat exchanger performance of the evaporator at the flow rate of the high-temperature fluid of 0.341 m/s and with a flow channel length of 0.70 m, and pressure loss $dP_{E2}$ of the high-temperature fluid of the evaporator in the second steam power cycle unit was determined as 11.3 kPa from actually measured values for the heat exchanger performance of the evaporator at the flow rate of the high-temperature fluid of 0.341 m/s and with a flow channel length of 0.70 m. As a result, pressure loss $dP_E$ of the high-temperature fluid of the evaporator in the steam power cycle unit in a dual stage was calculated as follows: $dP_E=dP_{E1}+dP_{E2}=11.0+11.3=22.3$ [kPa]. Accordingly, the self-consumption electric power $W_{PWS}$ of the pump for the high-temperature fluid was determined in the form of input heat ratio as follows:

$$W_{PWS}/Q_E=G_{WS}/\rho_{WS}\cdot dP_E\cdot Q_E=G_{WS}/\rho_{WS}\cdot dP_E\cdot\{G_{WS}Cp_{WS}(T_{WS0}-T_{WS1})\}=dP_E\cdot/\{\rho_{WS}\cdot Cp_{WS}(T_{WS0}-T_{WS1})\}=22.3\times10^3/\{1.023\times10^3\cdot4.0\times10^3(28-24)\}=0.0014$$

Therefore, the self-consumption electric power (input heat ratio) of the pump for the high-temperature fluid was determined as 0.14%.

Pressure loss $dP_{C1}$ of the low-temperature fluid of the condenser in the first steam power cycle unit was determined as 17.2 kPa from actually measured values for the heat exchanger performance of the condenser at the flow rate of the low-temperature fluid of 0.430 m/s and with a flow channel length of 0.70 m, and pressure loss $dP_{C2}$ of the low-temperature fluid of the condenser in the second steam power cycle unit was determined as 18.3 kPa from actually measured values for the heat exchanger performance of the condenser at the flow rate of the low-temperature fluid of 0.430 m/s and with a flow channel length of 0.70 m. As a result, pressure loss $dP_C$ of the low-temperature fluid of the condenser in the steam power cycle unit in a dual stage was calculated as follows: $dP_C=dP_{C1}+dP_{C2}=17.2++18.3=35.5$ [kPa]. Accordingly, the self-consumption electric power $W_{PWS}$ of the pump for the high-temperature fluid was determined in the form of input heat ratio as follows:

$$W_{PCS}/Q_E=G_{CS}/\rho_{CS}\cdot dP_C\cdot Q_E=G_{CS}/\rho_{CS}\cdot dP_C\cdot\{G_{WS}Cp_{WS}(T_{WSO}-T_{WS1})\}=6390\times10^3 35.5\times10^3\cdot/\{0.027\times10^3\cdot10000\times10^3\cdot4.0\times10^3\cdot(28-24)=0.0014$$

Therefore, the self-consumption electric power (input heat ratio) of the pump for the low-temperature fluid was determined as 0.14%.

Further, the pump power, i.e., the self-consumption electric power $W_{PWF}$ of the pump for the working fluid was represented in the form of input heat ratio as follows:

$$W_{PWF}/Q_E=(W_{PWF1}+W_{PWF2})/Q_E=\{G_{WF1}+(h_3-h_1)+G_{WF2}+(h_7-h_6)\}/\{G_{WS}Cp_{WS}(T_{WS0}-T_{WS1})\}=\{65.2\times10^3\cdot(399.6\times10^3-399.1\times10^3)/3600+64.6\times10^3(385.5\times10^3-385.5\times10^3/3600\}/\{10000\times10^3\cdot4.0\times10^3(28-24)/3600\}=0.0003$$

Therefore, the self-consumption electric power (input heat ratio) of the pump for the working fluid was determined as 0.03%.

Based on the foregoing, the ratio of the self-consumption electric power to the turbine output was represented as follows:

$$(W_{PWS}+W_{PCS}+W_{PWF})/W_T=(0.0014+0.0014+0.0003)/0.0416=0.0075$$

and therefore was 7.5%.

Heat efficiency, taking into consideration the self-consumption electric power was represented as follows:

$$\eta=\{W_T-(W_{PWS}+W_{PCS}+W_{PWF})\}/Q_E=0.00416-(0.0014+0.0014+0.0003)=0.0384$$

and therefore was 3.84%.

On the other hand, for each of the cycles as the examples for comparison, there were determined, based on each of the condition values as shown in Table 1 and Table 2 as indicated above, the heat efficiency $\eta_{th}$ of the cycle, the self-consumption electric power $W_{PWS}$ of the pump for the high-temperature fluid, the self-consumption electric power $W_{PCS}$ of the pump for the low-temperature fluid, the self-consumption electric power $W_{PWF}$ of the pump for the working fluid, the rate of the self-consumption electric power to the turbine output, and the heat efficiency in view of the self-consumption electric power.

However, pressure loss $dP_E$ of the high-temperature fluid of the evaporator in the steam power cycle unit of Example No. 1 for Comparison in a single stage utilizing the conventional counter-flow type heat exchanger was determined as 38.6 kPa from actually measured values for the performance of the evaporator at the flow rate of the high-temperature fluid of 0.637 m/s and with a flow channel length of 1.80 m, and the self-consumption electric power $W_{PWS}$ of the pump for the high-temperature fluid was determined utilizing this value in the same manner as described above. In addition, pressure loss $dP_C$ of the low-temperature fluid of the condenser was determined as 26.4 kPa from actually measured values for the performance of the condenser at the flow rate of the low-temperature fluid of 0.517 m/s and with a flow channel length of 1.20 m, and the self-consumption electric power $W_{PCS}$ of the pump for the low-temperature fluid was determined utilizing this value in the same manner as described above.

Pressure loss $dP_E$ of the high-temperature fluid of the evaporator in the steam power cycle unit of Example No. 2 for Comparison in a dual stage in the first steam power unit, utilizing the conventional counter-flow type heat exchanger was determined as 51.7 kPa from actually measured values for the performance of the evaporator at the flow rate of the high-temperature fluid of 0.776 m/s and with a flow channel length of 1.80 m, and pressure loss $dP_E$ of the high-temperature fluid of the evaporator in the second steam power unit was determined as 52.7 kPa from actually measured values for the performance of the evaporator at the flow rate of the high-temperature fluid of 0.776 m/s and with a flow channel length of 1.80 m, and pressure loss $dP_E$ of the high-temperature fluid was calculated as follows: $dP_E=dP_{E1}+dP_{E2}=51.7+52.7=104.4$ [kPa], and the self-consumption electric power $W_{PWS}$ of the pump for the high-temperature fluid was determined utilizing this value in the same manner as described above. Pressure loss $dP_{C1}$ of the low-temperature fluid of the condenser in the steam power cycle unit in a dual stage in the first steam power unit was determined as 59.4 kPa from actually measured values for the performance of the condenser at the flow rate of the low-temperature fluid of 0.940 m/s and with a flow channel length of 1.20 m, and pressure loss $dP_{C2}$ of the low-temperature fluid of the condenser in the second steam power unit was determined as 62.2 kPa from actually measured values for the performance of the condenser at the flow rate of the low-temperature fluid of 0.940 m/s and with a flow channel length of 1.20 m, and pressure loss $dP_C$ of the low-temperature fluid was calculated as follows: $dP_C=dP_{C1}+dP_{C2}=59.4+62.2=121.6$ [kPa], and the self-consumption electric power $W_{PCS}$ of the pump for the low-temperature fluid was determined utilizing this value in the same manner as described above.

In addition, pressure loss $dP_E$ of the high-temperature fluid of the evaporator in the system of Example No. 3 for Comparison in which the same steam power cycle unit as the example of the invention was provided in a single stage structure, was determined as 6.2 kPa from actually measured values for the performance of the evaporator at the flow rate of the high-temperature fluid of 0.221 m/s and with a flow channel length of 0.70 m, and the self-consumption electric power $W_{PWS}$ of the pump for the high-temperature fluid was determined utilizing this value in the same manner as described above. In addition, pressure loss $dP_C$ of the low-temperature fluid of the condenser was determined as 7.5 kPa from actually measured values for the performance of the condenser at the flow rate of the low-temperature fluid of 0.223 m/s and with a flow channel length of 0.70 m, and the self-consumption electric power $W_{PCS}$ of the pump for the low-temperature fluid was determined utilizing this value in the same manner as described above.

The results as calculated of the heat efficiency and the other values for the example of the invention and the examples for comparison as described above are shown, together with each of the condition values as indicated above, in Table 1 and Table 2, as indicated above.

The results as calculated in Table 1 and Table 2 revealed that the self-consumption electric power of the pump for the high-temperature fluid or the low-temperature fluid in the steam power cycle system of Example No. 1 of the Invention was smaller than that of Example No. 1 for Comparison, and the pressure loss was reduced by using the cross-flow type heat exchanger as the evaporator and the condenser in the two steam power cycle units and aligning the evaporators and aligning the condensers in an appropriate manner. This revealed that the heat efficiency taking into consideration the self consumption electric power in case of Example No. 1 of the Invention was more remarkably improved than each of the examples for comparison, and improvement in efficiency by a multistage structure could be achieved by improvement in the heat exchanger, etc.

It is clear from the foregoing that the steam power cycle system of Example No. 1 of the Invention has a more excellent efficiency than the system based on Rankine cycle in which the conventional heat exchanger is used as the evaporator and the condenser under the actual conditions, and a more effective use of difference in temperature between the high-temperature fluid and the low-temperature fluid as the heat source can be achieved by providing in a multistage the steam power cycle units in which the cross-flow type heat exchanger is used.

Example No. 2 of the Invention

Figure 9:
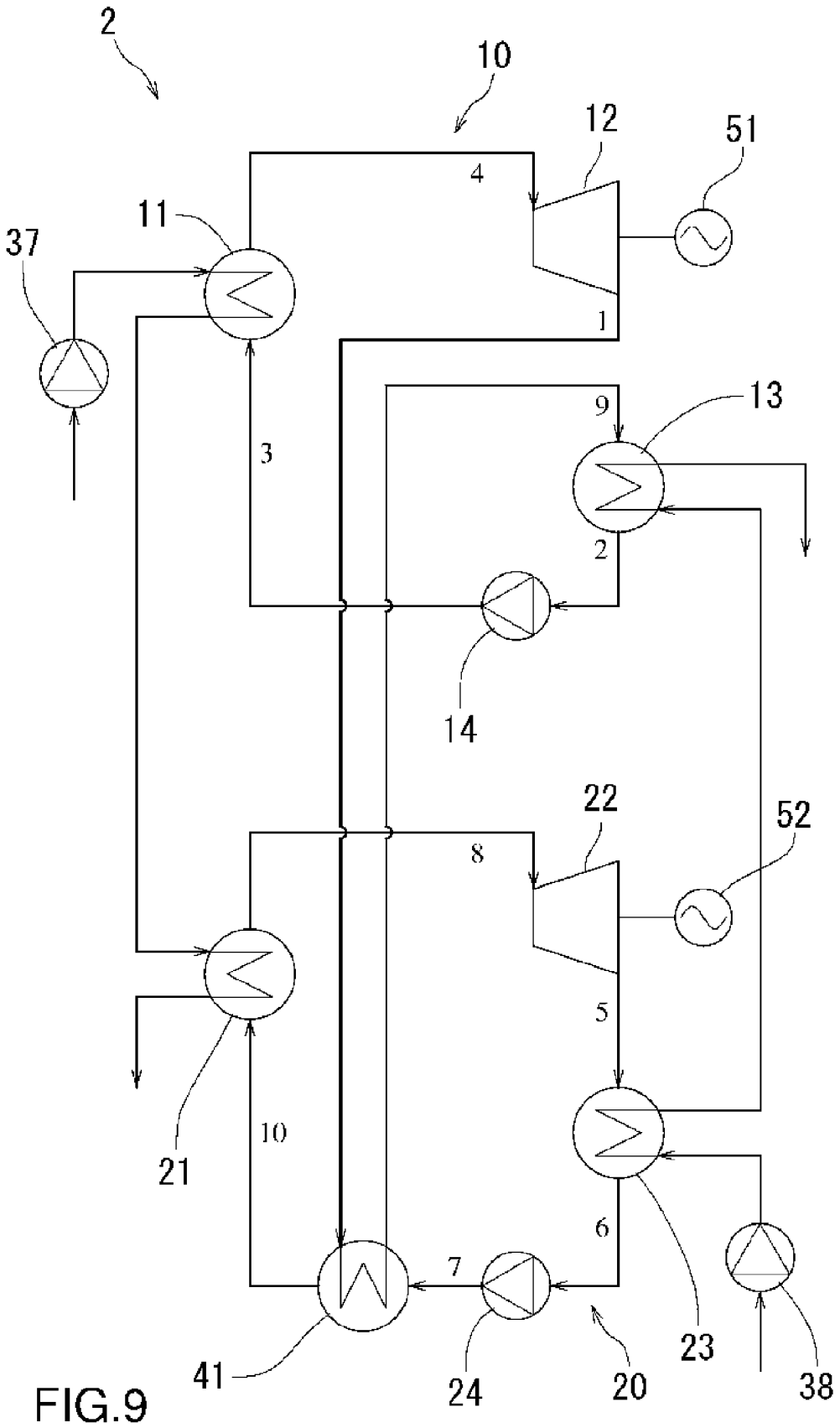
FIG. 9 is a schematic system diagram of a steam power cycle system according to the second embodiment of the present invention.
Figure 10:
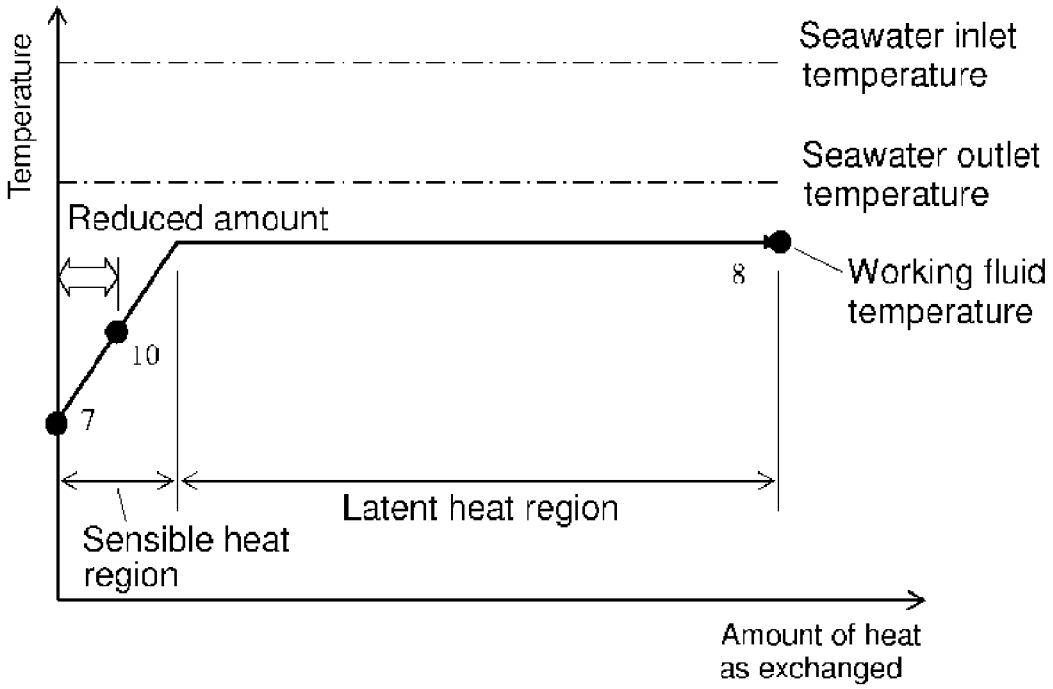
FIG. 10 is a descriptive diagram of a reduced state of an amount of heat exchange in a sensitive heat region of the evaporator of the steam power cycle system according to the second embodiment of the present invention.

Then, there was used, as Example No. 2 of the Invention, the same steam power cycle system as the second embodiment of the present invention as described above, and namely, the system in which the steam power cycle unit was provided in a dual stage as shown in FIG. 9, the high-temperature fluid was caused to flow continuously in the evaporator of each of the steam power cycle units, as well as the low-temperature fluid was caused to flow continuously in the condenser of each of the steam power cycle units, and in addition, there was made heat exchange, in the preheating heat exchanger 41, between the working fluid flowing from the outlet of the turbine to the condenser in the first steam power cycle unit 10 and the working fluid flowing from the outlet of the pump to the evaporator in the second steam power cycle unit 20, and values of heat efficiency, etc., were calculated. For calculation, various kinds of physical properties indicative of pressure, temperature, etc., of the working fluid at each point (1-9-2-3-4, 5-6-7-10-8) of the cycle as shown in FIG. 9 were calculated using assumed values based on an actual environment such as heat transfer performance of the heat exchanger for the evaporator and condenser, temperature conditions of the high-temperature fluid and the low-temperature fluid as the heat source, etc., and then respective values such as heat efficiency, etc., of the cycle were calculated.

Concerning the major conditions for the steam power cycle of Example No. 2 of the Invention, pentane was used as the working fluid in each of the steam power cycle units, an inlet temperature $T_{WSI}$ on the side of the high-temperature fluid of the evaporator 11 of the first steam power cycle unit 10 was set as 28° C., an outlet temperature $T_{WSM}$ thereon was set as 26° C., and an outlet (at Point 4) temperature $T_4$ of the evaporator for the working fluid, which was to be subjected to heat exchange with the above-mentioned working fluid was set as 24° C. In addition, an inlet temperature $T_{WSM}$ of the evaporator 21 on the side of the high-temperature fluid of the second steam power cycle unit 20 was set as 26° C., an outlet temperature $T_{WSO}$ thereon was set as 24° C., and an outlet (at Point 8) temperature $T_8$ of the evaporator for the working fluid, which was to be subjected to heat exchange with the above-mentioned working fluid was set as 22° C.

On the other hand, an inlet temperature $T_{CSI}$ on the side of the low-temperature fluid in the condenser 23 of the second steam power cycle unit 20 was set as 4° C., an outlet temperature $T_{CSM}$ thereon was set as 7° C., and an outlet (at Point 6) temperature $T_6$ of the condenser for the working fluid, which was to be subjected to heat exchange with the above-mentioned working fluid was set as 9° C. In addition, an inlet temperature $T_{CSM}$ on the side of the low-temperature fluid in the condenser 13 of the first steam power cycle unit 10 was set as 7° C., an outlet temperature $T_{CSO}$ thereon was set as 10° C., and an outlet (at Point 2) temperature $T_2$ of the condenser for the working fluid, which was to be subjected to heat exchange with the above-mentioned working fluid was set as 12° C.

In addition, the inlet temperature $T_1$ of the preheating heat exchanger 41 for the working fluid on the side of the first steam power cycle unit 10 was set as 13.8° C., and the outlet temperature $T_9$ was set as 12° C., as well as the inlet temperature $T_7$ for the working fluid, which was to be subjected to heat exchange with the above-mentioned working fluid, on the side of the second steam power cycle unit 20 was set as 9.0° C., and the outlet temperature $T_{10}$ was set as 13.6° C.

Further, the flow rate $G_{WF1}$ of the working fluid in the first steam power cycle unit 10 was set as 203 t/h. In addition, the flow rate $G_{WF2}$ of the working fluid in the second steam power cycle unit 20 was set as 206 t/h. Further, the flow rate $G_{WS}$ of the working fluid was set as 10000 t/h and the flow rate $G_{CS}$ of the working fluid was set as 6390 t/h.

Each of the condition values such as a pressure P, a temperature T, a specific enthalpy h, etc. of the working fluid in each point (1-9-2-3-4, 5-6-7-10-8) of the steam power cycle is shown in Table 3.

See Appendix A, Table 3.

For the system as provided in a dual stage in the same manner as Example No. 1 of the Invention as described above, but without making heat exchange by the preheating heat exchanger as the example for comparison (Example No. 4 for Comparison), conditions such as a pressure, a temperature, etc. of the working fluid at each point (1 to 4, 5 to 8) of the cycle as shown in FIG. 1 were determined, and then heat efficiency of the cycle was obtained in the same manner as Example No. 2 of the Invention.

The temperature conditions of the high-temperature fluid and the low-temperature fluid used in Example No. 4 for Comparison, as well as the temperature of the working fluid at the respective points of the cycle were the same as the set values for the apparatus according to Example No. 2 of the present invention, except that the inlet temperature of the condenser for the working fluid in the first steam power cycle unit 10 was set as the same as the outlet temperature of the turbine, i.e., as 13.8° C., and the inlet temperature of the evaporator in the second steam power cycle unit 20 was set as the same as the outlet temperature of the pump, i.e., as 9.0° C., because of no use of the preheating heat exchanger.

Each of the condition values at each point of the cycle for Example No. 4 for Comparison was also shown in Table 3, together with each value in case of Example No. 2 of the Invention.

Based on the condition values of the respective fluids as the heat source and the working fluid, as shown in Table 3, the heat efficiency $\eta_{th}$ of the cycle for Example No. 2 of the Invention may be expressed as follows:

$$\eta_{th}=(W_T-W_{PWF})/Q_E=\{(W_{T1}+W_{T2})-(W_{PWF1}+W_{PWF2})\}/(Q_{E1}+Q_{E2})$$

Here, the turbine output $W_T=W_{T1}+W_{T2}=G_{WF1}(h_4-h_1)+G_{WF2}(h_8-h_5)=203\times10^3(338.8\times10^3-323.4\times10^3)/3600+206\times10^3(335.7\times10^3-318.8\times10^3)/3600=6607.6\times10^6/3600$ In addition, the pump power $W_{PWF}=W_{PWF1}+W_{PWF2})=G_{WF1}(h_3-h_2)+G_{WF2}(h_7-h_6)=203\times10^3(55.6\times10^3-55.7\times10^3)/3600+206\times10^3(62.4\times10^3-62.4\times10^3)/3600=20.3\times10^6/3600$ Further, the heat exchange amount $Q_E$ of the evaporator$=Q_{E1}+Q_{E2}=G_{WS}Cp_{WS}(T_{WSM}-T_{WSI})+G_{WS}Cp_{WS}(T_{WSO}-T_{WSM})=G_{WS}Cp_{WS}(T_{WSO}-T_{WSI})=10000\times10^3\cdot4.0\times10^3(28-24)/3600=160000\times10^6/3600$ From these relationship, $$\eta_{th}=(6607.8-20.3)/160000=0.0413$$

Therefore, the heat efficiency of the cycle for Example No. 2 of the Invention was 4.13%.

To the contrary, the heat efficiency $\eta_{th}$ of the cycle for Example No. 4 for Comparison may be expressed as follows:

$$\eta_{th}=(W_T-W_{PWF})/Q_E=\{(W_{T1}+W_{T2})-(W_{PWF1}+W_{PWF2})\}/(Q_{E1}+Q_{E2})$$

Here, the turbine output $W_T=W_{T1}+W_{T2}=G_{WF1}(h_4-h_1)+G_{WF2}(h_8-h_5)=203\times10^3(338.8\times10^3-323.4\times10^3)/3600+201\times10^3(335.7\times10^3-318.8\times10^3)/3600=6523.1\times10^6/3600$ In addition, the pump power $W_{PWF}=W_{PWF1}+W_{PWF2})=G_{WF1}(h_3-h_2)+G_{WF2}(h_7-h_6)=203\times10^3(-55.6\times10^3+55.7\times10^3)/3600+201\times10^3(-62.4\times10^3+62.4\times10^3)/3600=20.3\times10^6/3600$ Further, the heat exchange amount $Q_E$ of the evaporator$=Q_{E1}+Q_{E2}=G_{WS}Cp_{WS}(T_{WSM}-T_{WSI})+G_{WS}Cp_{WS}(T_{WSO}-T_{WSM})=G_{WS}Cp_{WS}(T_{WSO}-T_{WSI})=10000\times10^3\cdot4.0\times10^3(28-24)/3600=160000\times10^6/3600$ From these relationship, $$\eta_{th}=(6523.1-20.3)/160000=0.0407$$

Therefore, the heat efficiency of the cycle for Example No. 4 of the Comparison was 4.07%.

It is clear from the foregoing that the steam power cycle system of Example No. 2 of the Invention makes heat recovery with the use of the preheating heat exchanger to provide values indicative of more excellent heat efficiency than the dual stage structure of Example No. 4 for Comparison in which no preheating heat exchanger is used, and a more effective use of difference in temperature between the high-temperature fluid and the low-temperature fluid as the heat source can be achieved.

Example No. 3

Next, there was used, as Example No. 3 of the Invention, the same steam power cycle system as the third embodiment of the present invention as described above, and namely, the system in which the steam power cycle unit was provided in a dual stage as shown in FIG. 13, in addition, each of the steam power cycle units was provided with the gas-liquid separator that separated the working fluid from the evaporator into the gas phase substance and the liquid phase substance and caused the working fluid in a gas phase to flow toward the turbine, and caused the working fluid in a liquid phase to flow toward the inlet side of the evaporator, and values of performance of the evaporator, etc., were calculated. For calculation, various kinds of physical properties indicative of pressure, temperature, etc., of the working fluid at each point (1-2-3-11-12-4•13, 5-6-7-14-15-8•16) of the cycle as shown in FIG. 13 were calculated using assumed values based on an actual environment such as heat transfer performance of the heat exchanger for the evaporator and condenser, temperature conditions of the high-temperature fluid and the low-temperature fluid as the heat source, etc., and then performance values of the evaporator of the cycle were calculated.

Concerning the major conditions for the steam power cycle of Example No. 3 of the Invention, ammonia was used as the working fluid in each of the steam power cycle units, an inlet temperature $T_{WSI}$ on the side of the high-temperature fluid of the evaporator 11 of the first steam power cycle unit 10 was set as 28° C., an outlet temperature $T_{WSM}$ thereon was set as 26° C., and an inlet temperature $T_{WSM}$ on the side of the high-temperature fluid in the evaporator 21 of the second steam power cycle unit 20 was set as 26° C., an outlet temperature $T_{WSO}$ thereon was set as 24° C.

On the other hand, an inlet temperature $T_{CSI}$ on the side of the low-temperature fluid in the condenser 23 of the second steam power cycle unit 20 was set as 4° C., an outlet temperature $T_{CSM}$ thereon was set as 7° C., and an outlet (at Point 6) temperature $T_6$ of the condenser for the working fluid, which was to be subjected to heat exchange with the above-mentioned working fluid was set as 9° C. In addition, an inlet temperature $T_{CSM}$ on the side of the low-temperature fluid in the condenser 13 of the first steam power cycle unit 10 was set as 7° C., an outlet temperature $T_{CSO}$ thereon was set as 10° C., and an outlet (at Point 2) temperature $T_2$ of the condenser for the working fluid, which was to be subjected to heat exchange with the above-mentioned working fluid was set as 12° C.

In addition, in the case of Example No. 3 of the Invention, an inlet (at Point 11) temperature $T_{11}$ on the side of the working fluid of the evaporator 11 of the first steam power cycle unit 10 was set as 15.5° C., and an outlet (at Point 12) temperature $T_{12}$ was set as 24° C., and the temperature $T_{13}$ of the working fluid flowing from the gas-liquid separator toward the inlet of the evaporator was set as 24° C., because of the gas-liquid separator as being provided. Further, an inlet (at Point 14) temperature $T_{14}$ on the side of the working fluid of the evaporator 21 of the second steam power cycle unit 20 was set as 12.8° C., and an outlet (at Point 15) temperature $T_{15}$ was set as 22° C., and the temperature $T_{16}$ of the working fluid flowing from the gas-liquid separator toward the inlet of the evaporator was set as 22° C.

Further, dryness of the working fluid flowing from the gas-liquid separator toward the turbine in each of the steam power cycle units was set as 0.6.

Each of the condition values such as a pressure P, a temperature T, a specific enthalpy h, etc. of the working fluid in each point (1-2-3-11-12-4•13, 5-6-7-14-15-8•16) of the steam power cycle of Example No. 3 of the Invention is shown in Table 4.

Appendix A, Table 4.

In addition, for the system for the comparison for example in which the same steam power cycle unit as Example No. 1 of the Invention was provided in a single stage, and without conducting a gas-liquid separation by the gas-liquid separator (Example No. 5 for Comparison), and for the system which had the same dual stage structure as Example No. 1 of the Invention, but without conducting a gas-liquid separation by the gas-liquid separator (Example No. 6 for Comparison), conditions of pressure, temperature, etc. of the working fluid at each point of the cycle were determined and heat transfer coefficient, etc. of the evaporator was obtained in the same manner as Example No. 3 of the Invention as indicated above.

The flow rate and the temperature conditions of the high-temperature fluid and the low-temperature fluid were the same as those as set for the apparatus of the present invention as described above.

The condition values at each point of the cycle for the examples for comparison are shown in Table 5 in the same manner as Example No. 3 of the Invention.

Appendix A, Table 5.

Based on the condition values of the respective fluids as the heat source and the working fluid, as shown in Table 4, the ratio of flow rate $G_{WS}$:$G_{WF1}$ of the high-temperature fluid and the low-temperature fluid in the evaporator in Example No. 3 of the Invention may be expressed as follows:

$$\begin{aligned} G_{WS}/G_{WF1} &= G_{WS}(h_{12}-h_{11})/Q_{E1} \\ &= (h_{12}-h_{11})/Cp_{WS}(T_{WSM}-T_{WSI}) \\ &= (1158.0\times10^3-415.7\times10^3)/4.0\times10^3(26-24) \\ &= 93 \end{aligned}$$

Therefore, $G_{WS}$:$G_{WF1}$=93:1

The heat transfer coefficient on the side of the high-temperature fluid in the evaporator in Example No. 3 of the Invention in each of the first and second steam power cycle units was determined as 9460 W/m$^2$K from the actual values for the performance of the heat exchanger of the evaporator at the flow rate of the high-temperature fluid of 0.530 m/s and the mass flux on the side of the working fluid of 16.0 kg/m$^2$s, and the heat transfer coefficient on the side of the working fluid was determined as 10300 W/m$^2$K in the same manner as described above. The overall heat transfer coefficient of the evaporator was determined as 3660 W/m$^2$K based on these values, as well as the performance values such as the rate of heat transfer of the heat exchanging plate by which the high-temperature fluid and the working fluid was separated, and the condition values such as contamination coefficient.

On the other hand, based on the condition values of the respective fluids as the heat source and the working fluid, as shown in Table 5 as indicated above, the ratio of flow rate $G_{WS}$:$G_{WF1}$ of the high-temperature fluid and the low-temperature fluid in the system in a single stage of Example No. 5 for Comparison may be expressed as follows:

$$\begin{aligned} G_{WS}/G_{WF1} &= G_{WS}(h_4-h_3)/Q_{E1} \\ &= (h_4-h_3)/Cp_{WS}(T_{WSO}-T_{WSI}) \\ &= (1624.7\times10^3-399.5\times10^3)/4.0\times10^3(28-24) \\ &= 77 \end{aligned}$$

Therefore, $G_{WS}$:$G_{WF1}$=77:1

The heat transfer coefficient on the side of the high-temperature fluid in the evaporator in Example No. 5 for Comparison was determined as 5460 W/m$^2$K from the actual values for the performance of the heat exchanger of the evaporator at the flow rate of the high-temperature fluid of 0.221 m/s and the mass flux on the side of the working fluid of 9.86 kg/m$^2$s, and the heat transfer coefficient on the side of the working fluid was determined as 3830 W/m$^2$K in the same manner as described above. The overall heat transfer coefficient of the evaporator was determined as 1940 W/m$^2$K based on these values, as well as the performance values such as the rate of heat transfer of the heat exchanging plate by which the high-temperature fluid and the working fluid was separated, and the condition values such as contamination coefficient.

Further, based on the condition values of the respective fluids as the heat source and the working fluid, as shown in Table 5 as indicated above, the ratio of flow rate $G_{WS}$:$G_{WF1}$ of the high-temperature fluid and the low-temperature fluid in the system in dual stage of Example No. 6 for Comparison may be expressed as follows:

$$G_{WS}/G_{WF1} = G_{WS}(h_4 - h_3)/Q_{E1}$$
$$= (h_4 - h_3)/Cp_{WS}(T_{WSO} - T_{WSI})$$
$$= (1626.0\times10^3 - 399.6\times10^3)/4.0\times10^3(26-24)$$
$$= 154$$

Therefore, $G_{WS}:G_{WF1}=154:1$

The heat transfer coefficient on the side of the high-temperature fluid in the evaporator in Example No. 6 for Comparison in each of the first and second steam power cycle units was determined as 7340 $W/m^2K$ from the actual values for the performance of the heat exchanger of the evaporator at the flow rate of the high-temperature fluid of 0.342 m/s and the mass flux on the side of the working fluid of 7.70 $kg/m^2s$, and the heat transfer coefficient on the side of the working fluid was determined as 3190 $W/m^2K$ in the same manner as described above. The overall heat transfer coefficient of the evaporator was determined as 1920 $W/m^2K$ based on these values, as well as the performance values such as the rate of heat transfer of the heat exchanging plate by which the high-temperature fluid and the working fluid was separated, and the condition values such as contamination coefficient.

The results as calculated of the values of the ratio of flow rate and the heat transfer coefficient for the example of the invention and the examples for comparison as described above are shown, together with each of the condition values as indicated above, in Table 4 and Table 5, as indicated above.

The results revealed that the steam power cycle system of Example No. 3 of the Invention in which the gas-liquid separation was conducted by the gas-liquid separator and the dryness adjustment was made, could increase the heat transfer coefficient, especially the heat transfer coefficient on the side of the working fluid, in comparison with each of the examples for comparison in which no gas-liquid separator was used, thus improving the overall heat transfer coefficient indicative of the performance of the evaporator. This revealed that an additional use of the gas-liquid separator to the steam power cycle unit in a multistage permitted to utilize effectively the evaporator to control loss in the heat transfer.

Example No. 4

Next, there was used, as Example No. 4 of the Invention, the same steam power cycle system as the fourth embodiment of the present invention as described above, and namely, the system in which the steam power cycle unit was provided in a dual stage as shown in FIG. 16, and each of the steam power cycle units was provided with the gas-liquid separator in the same manner as Example No. 3 of the Invention as described above, and, in addition, the reheating heat exchanger was caused to make heat exchange between the working fluid in a liquid phase, which had been separated by the gas-liquid separator in the second steam power cycle unit, on the one hand, and the working fluid in a liquid phase flowing from the outlet of the pump toward the evaporator in the first steam power cycle unit, and heat efficiency of the cycle was calculated. For calculation, various kinds of physical properties indicative of pressure, temperature, etc., of the working fluid at each point (1-2-3-17-11-12-4•13, 5-6-7-14-15-8•16-18) of the cycle as shown in FIG. 16 were calculated using assumed values based on an actual environment such as heat transfer performance of the heat exchanger for the evaporator and condenser, temperature conditions of the high-temperature fluid and the low-temperature fluid as the heat source, etc., and then performance values of the evaporator of the cycle were calculated.

Concerning the major conditions for the steam power cycle of Example No. 4 of the Invention, ammonia was used as the working fluid in each of the steam power cycle units, an inlet temperature $T_{WSI}$ on the side of the high-temperature fluid of the evaporator 11 of the first steam power cycle unit 10 was set as 28° C., an outlet temperature $T_{WSM}$ thereon was set as 26° C., and an inlet temperature $T_{WSM}$ on the side of the high-temperature fluid in the evaporator 21 of the second steam power cycle unit 20 was set as 26° C., an outlet temperature $T_{WSO}$ thereon was set as 24° C.

On the other hand, an inlet temperature $T_{CSI}$ on the side of the low-temperature fluid in the condenser 23 of the second steam power cycle unit 20 was set as 4° C., an outlet temperature $T_{CSM}$ thereon was set as 7° C., and an outlet (at Point 6) temperature $T_6$ of the condenser for the working fluid, which was to be subjected to heat exchange with the above-mentioned working fluid was set as 9° C. In addition, an inlet temperature $T_{CSM}$ on the side of the low-temperature fluid in the condenser 13 of the first steam power cycle unit 10 was set as 7° C., an outlet temperature $T_{CSO}$ thereon was set as 10° C., and an outlet (at Point 2) temperature $T_2$ of the condenser for the working fluid, which was to be subjected to heat exchange with the above-mentioned working fluid was set as 12° C.

In addition, in the case of Example No. 4 of the Invention, an inlet temperature on the side of the working fluid of the evaporator 11 of the first steam power cycle unit 10 was set as 18.1° C., and an outlet temperature was set as 24° C., and the temperature of the working fluid flowing from the gas-liquid separator toward the inlet of the evaporator was set as 24° C., because of the regenerative heat exchanger as being provided. Further, an inlet temperature on the side of the working fluid of the evaporator 21 of the second steam power cycle unit 20 was set as 10.2° C., and an outlet temperature was set as 22° C., and the temperature of the working fluid flowing from the gas-liquid separator toward the inlet of the evaporator was set as 22° C.

Further, dryness of the working fluid flowing from the gas-liquid separator toward the turbine in each of the steam power cycle units was set as 0.6.

Each of the condition values such as a pressure P, a temperature T, a specific enthalpy h, etc. of the working fluid in each point (1-2-3-17-11-12-4•13, 5-6-7-14-15-8•16-18) of the steam power cycle of Example No. 4 of the Invention is shown in Table 6.

Appendix A, Table 6.

In addition, for the system for the comparison for example in which the same steam power cycle unit as Example No. 3 of the Invention was provided in a dual stage, and without conducting heat recovery by the regenerative heat exchanger (Example No. 7 for Comparison), conditions of pressure, temperature, etc. of the working fluid at each point of the cycle were determined and heat efficiency of the cycle was obtained in the same manner as Example No. 4 of the Invention as indicated above.

The flow rate and the temperature conditions of the high-temperature fluid and the low-temperature fluid, and the heat transfer conditions for the evaporator and the condenser were the same as those as set for the apparatus of the present invention as described above.

Concerning the different conditions, the inlet temperature on the side of the working fluid in the evaporator 11 of the first steam power cycle unit 10 was set as 15.5° C., because of no use of the regenerative heat exchanger. In addition, the inlet temperature on the side of the working fluid in the evaporator 21 of the second steam power cycle unit 20 was set as 12.8° C.

The condition values at each point of the cycle for Example No. 7 for Comparison are shown in Table 6 together with the respective values in Example No. 4 of the Invention.

Based on the condition values of the respective fluids as the heat source and the working fluid, as shown in Table 6, the heat efficiency $\eta_{th}$ of the cycle for Example No. 4 of the Invention may be expressed as follows $$\eta_{th}=(W_T-W_{PWF})/Q_E=\{(W_{T1}+W_{T2})-(W_{PWF1}+W_{PWF2})\}/(Q_{E1}+Q_{E2})$$

Here, the turbine output $W_T=W_{T1}+W_{T2}=G_{WF1}(h_4-h_1)+G_{WF2}(h_8-h_5)=66.3\times10^3(1626.0\times10^3-1577.1\times10^3)/3600+63.6\times10^3(1624.7\times10^3-1570.9\times10^3)/3600=6670.4\times10^6/3600$ In addition, the pump power $W_{PWF}=W_{PWF1}+W_{PWF2})=G_{WF1}(h_3-h_2)+G_{WF2}(h_7-h_6)=66.3\times10^3(399.6\times10^3-399.1\times10^3)/3600+63.6\times10^3(385.5\times10^3-385.0\times10^3)/3600=65.0\times10^6/3600$ Further, the heat exchange amount $Q_E$ of the evaporator$=Q_{E1}+Q_{E2}=G_{WS}Cp_{WS}(T_{WSM}-T_{WSI})+G_{WS}Cp_{WS}(T_{WSO}-T_{WSM})=G_{WS}Cp_{WS}(T_{WSO}-T_{WSI})=10000\times10^3\cdot4.0\times10^3(28-24)/3600=160000\times10^6/3600$ From these relationship, $$\eta_{th}=(6607.4-65.0)/160000=0.0412$$

Therefore, the heat efficiency of the cycle for Example No. 4 of the Invention was 4.13%.

To the contrary, the heat efficiency $\eta_{th}$ of the cycle for Example No. 7 for Comparison may be expressed as follows:

$$\eta_{th}=(W_T-W_{PWF})/Q_E=\{(W_{T1}+W_{T2})-(W_{PWF1}+W_{PWF2})\}/(Q_{E1}+Q_{E2})$$

Here, the turbine output $W_T=W_{T1}+W_{T2}=G_{WF1}(h_4-h_1)+G_{WF2}(h_8-h_5)=65.2\times10^3(1626.0\times10^3-1577.1\times10^3)/3600+64.6\times10^3(1624.7\times10^3-1570.9\times10^3)/3600=6663.8\times10^6/3600$ In addition, the pump power $W_{PWF}=W_{PWF1}+W_{PWF2})=G_{WF1}(h_3-h_2)+G_{WF2}(h_7-h_6)=65.2\times10^3(399.6\times10^3-399.1\times10^3)/3600+64.6\times10^3(385.5\times10^3-385.0\times10^3)/3600=64.9\times10^6/3600$ Further, the heat exchange amount $Q_E$ of the evaporator$=Q_{E1}+Q_{E2}=G_{WS}Cp_{WS}(T_{WSM}-T_{WSI})+G_{WS}Cp_{WS}(T_{WSO}-T_{WSM})=G_{WS}Cp_{WS}(T_{WSO}-T_{WSI})=10000\times10^3\cdot4.0\times10^3(28-24)/3600=160000\times10^6/3600$ From these relationship, $$\eta_{th}=(6663.8-64.9)/160000=0.0412$$

Therefore, the heat efficiency of the cycle for Example No. 7 for Comparison was 4.12%.

It is clear from the foregoing that the steam power cycle system of Example No. 4 of the Invention uses the regenerative heat exchanger to conduct heat recovery of the working fluid, thus providing a more excellent heat efficiency than the case of the steam power cycle unit in a dual stage structure in which no regenerative heat exchanger is used, and the steam power cycle unit in a multistage structure uses the regenerative heat exchanger in addition to adjustment in dryness through the gas-liquid separation, so as to effectively use the difference in temperature between the high-temperature fluid and the low-temperature fluid as the heat source, thus enhancing efficiency.

REFERENCE SIGNS LIST

1, 2, 3, 4 steam power cycle system
10, 20 steam power cycle unit
11, 21 evaporator
12, 22 turbine
13, 23 condenser
14, 24 pump
15, 25 gas-liquid separator
16, 26 auxiliary pump
30 heat exchanging body
30*a* heat exchanging plate
30*b* first flow channel
30*c* second flow channel
30*d* flange
31*a*, 31*b* pipe channel
32 separation wall
32*a* through-hole
33 chamber
34, 35, 39 region
36 partition wall
37, 38 pump
41, 43 preheating heat exchanger
42, 44 regenerative heat exchanger
51, 52 power generator
60 shell
61 pipe channel

TABLE 1

APPENDIX A

| Item | | Unit | Example No. 3 for Comparison | Example No. 1 of the Invention |
|---|---|---|---|---|
| Type of Heat Exchanger | | | Cross-Flow Plate-Type Heat Exchanger | Cross-Flow Plate-Type Heat Exchanger |
| Heat Source Conditions | | | | |
| High-Temperature Fluid | Inlet Temperature $T_{WSI}$ | ° C. | 28.0 | 28.0 |
| | Intermediate Temperature $T_{WSM}$ | ° C. | — | 26.0 |
| | Outlet Temperature $T_{WSO}$ | ° C. | 24.0 | 24.0 |
| | Specific Heat $Cp_{WS}$ | kJ/kgK | 4.0 | 4.0 |
| | Density $\rho_{WS}$ | t/m³ | 1.023 | 1.023 |
| | Flow Rate $G_{WS}$ | t/h | 10000 | 10000 |

TABLE 1-continued

| | | | | | | | | | |
|---|---|---|---|---|---|---|---|---|---|
| Low-Temperature Fluid | Inlet Temperature $T_{CSI}$ | ° C. | 4.0 | | | 4.0 | | | |
| | Intermediate Temperature $T_{CSM}$ | ° C. | — | | | 7.0 | | | |
| | Outlet Temperature $T_{CSO}$ | ° C. | 10.0 | | | 10.0 | | | |
| | Specific Heat $Cp_{CS}$ | kJ/kgK | 4.0 | | | 4.0 | | | |
| | Density $\rho_{CS}$ | t/m$^3$ | 1.027 | | | 1.027 | | | |
| | Flow Rate $G_{CS}$ | t/h | 6450 | | | 6390 | | | |
| Cycle | | | Single Stage Rankine | | | Dual Stage Rankine | | | |
| Working Fluid Conditions | | | | | | | | | |
| Material | | | Ammonia | | | Ammonia | | | |
| | | | P (MPaA) | T (° C.) | H (kJ/kgK) | S (kJ/kg) | P (MPaA) | T (° C.) | H (kJ/kgK) | S (kJ/kg) |
| Temperature/ Specific Enthalpy of Each Portion | 1 | | 0.659 | 12.0 | 1583.5 | 5.824 | 0.659 | T (° C.) | 1577.1 | 5.802 |
| | 2 | | 0.659 | 12.0 | 399.1 | 1.671 | 0.659 | 12.0 | 399.1 | 1.671 |
| | 3 | | 0.914 | 12.1 | 399.5 | 1.671 | 0.973 | 12.1 | 399.6 | 1.671 |
| | 4 | | 0.914 | 22.0 | 1624.7 | 5.824 | 0.973 | 24.0 | 1626.0 | 5.802 |
| | 5 | | — | — | — | — | 0.594 | 9.0 | 1570.9 | 5.824 |
| | 6 | | — | — | — | — | 0.594 | 9.0 | 385.0 | 1.622 |
| | 7 | | — | — | — | — | 0.914 | 9.1 | 385.5 | 1.622 |
| | 8 | | — | — | — | — | 0.914 | 22.0 | 1624.7 | 5.824 |
| Flow Rate | High-Temperature Side $G_{WF1}$ | t/h | 131 | | | 65.2 | | | |
| | Low-Temperature Side $G_{WF2}$ | t/h | — | | | 64.6 | | | |
| Heat Efficiency of Cycle ((Turbine Output $W_T$ − Working Fluid Pump Consumption Power $W_{PWF}$)/Amount of Heat Input $Q_E$) | | % | 3.32 | | | 4.12 | | | |
| High-Temperature Fluid Pressure Loss in Evaporator | | | | | | | | | |
| Representative Flow Rate (Commonly used on High-Temperature Side and Low-Temperature Side) | | m/s | 0.221 | | | 0.341 | | | |
| Flow Channel Length (Commonly used on High-Temperature Side and Low-Temperature Side) | | m | 0.70 | | | 0.70 | | | |
| Pressure Loss | High-Temperature Side $d_{PE1}$ | kPa | 6.2 | | | 11.0 | | | |
| | Low-Temperatur Side $d_{PE2}$ | kPa | — | | | 11.3 | | | |
| | Total $d_{PE}$ | kPa | 6.2 | | | 22.3 | | | |
| Low-Temperature Fluid Pressure Loss in Condenser | | | | | | | | | |
| Representative Flow Rate (Commonly used on High-Temperature Side and Low-Temperature Side) | | m/s | 0.223 | | | 0.430 | | | |
| Flow Channel Length (Commonly used on High-Temperature Side and Low-Temperature Side) | | m | 0.70 | | | 0.70 | | | |
| Pressure Loss | High-Temperature Side $d_{PC1}$ | kPa | 7.5 | | | 17.2 | | | |
| | Low-Temperature Side $d_{PC2}$ | kPa | — | | | 18.3 | | | |
| | Total $d_{PC}$ | kPa | 7.5 | | | 35.5 | | | |
| Self-Consumption Power of Low-Temperture Fluid Pump (Input Heat Amount Ratio) | | % | 0.030 | | | 0.14 | | | |
| Self-Consumption Power of Working Fluid Pump (Input Heat Amount Ratio) | | % | 0.03 | | | 0.03 | | | |
| Self Consumption Power/Turbine Power | | % | 1.8 | | | 4.2 | | | |
| (Turbine Power − Self-Consumption power)/Input Heat Amount | | % | 3.29 | | | 3.98 | | | |

TABLE 2

APPENDIX A

| Item | | Unit | Example No. 1 for Comparison | Example No. 2 for Comparison |
|---|---|---|---|---|
| Type of Heat Exchanger | | | Counter-Flow Plate-Type Heat Exchanger | Counter-Flow Plate-Type Heat Exchanger |
| Heat Source Conditions | | | | |
| High-Temperature Fluid | Inlet Temperature $T_{WSI}$ | ° C. | 28.0 | 28.0 |
| | Intermediate Temperature $T_{WSM}$ | ° C. | — | 26.0 |
| | Outlet Temperature $T_{WSO}$ | ° C. | 24.0 | 24.0 |
| | Specific Heat $Cp_{WS}$ | kJ/kgK | 4.0 | 4.0 |
| | Density $\rho_{WS}$ | t/m$^3$ | 1.023 | 1.023 |
| | Flow Rate $G_{WS}$ | t/h | 10000 | 10000 |

TABLE 2-continued

| | | | | | | | | | | |
|---|---|---|---|---|---|---|---|---|---|---|
| Low-Temperature Fluid | Inlet Temperature $T_{CSI}$ | ° C. | 4.0 | | | | 4.0 | | | |
| | Intermediate Temperature $T_{CSM}$ | ° C. | — | | | | 7.0 | | | |
| | Outlet Temperature $T_{CSO}$ | ° C. | 10.0 | | | | 10.0 | | | |
| | Specific Heat $Cp_{CS}$ | kJ/kgK | 4.0 | | | | 4.0 | | | |
| | Density $\rho_{CS}$ | t/m³ | 1.027 | | | | 1.027 | | | |
| | Flow Rate $G_{CS}$ | t/h | 6450 | | | | 6390 | | | |
| Cycle | | | Single Stage Rankine | | | | Dual Stage Rankine | | | |
| Working Fluid Conditions | | | | | | | | | | |
| Material | | | Ammonia | | | | Ammonia | | | |
| | | | P (MPaA) | T (° C.) | H (kJ/kgK) | S (kJ/kg) | P (MPaA) | T (° C.) | H (kJ/kgK) | S (kJ/kg) |
| Temperature/ Specific Enthalpy of Each Portion | 1 | | 0.659 | 12.0 | 1583.5 | 5.824 | 0.659 | 12.0 | 1577.1 | 5.802 |
| | 2 | | 0.659 | 12.0 | 399.1 | 1.671 | 0.659 | 12.0 | 399.1 | 1.671 |
| | 3 | | 0.914 | 12.1 | 399.5 | 1.671 | 0.973 | 12.1 | 399.6 | 1.671 |
| | 4 | | 0.914 | 22.0 | 1624.7 | 5.824 | 0.973 | 24.0 | 1626.0 | 5.802 |
| | 5 | | — | — | — | — | 0.594 | 9.0 | 1570.9 | 5.824 |
| | 6 | | — | — | — | — | 0.594 | 9.0 | 385.0 | 1.622 |
| | 7 | | — | — | — | — | 0.914 | 9.1 | 385.5 | 1.622 |
| | 8 | | — | — | — | — | 0.914 | 22.0 | 1624.7 | 5.824 |
| Flow Rate | High-Temperature Side $G_{WF1}$ | t/h | 131 | | | | 65.2 | | | |
| | Low-Temperatur Side $G_{WF2}$ | t/h | — | | | | 64.6 | | | |
| Heat Efficiency of Cycle ((Turbine Output $W_T$-Working Fluid Pump Consumption Power $W_{PWE}$)/Amount of HEar Input $Q_E$) | | % | 3.32 | | | | 4.12 | | | |
| High-Temperature Fluid Pressure Loss in Evaporator | | | | | | | | | | |
| Representative Flow Rate (Commonly used on High-Temperature Side and Low-Temperature Side) | | m/s | 0.637 | | | | 0.776 | | | |
| Flow Channel Length (Commonly used on High-Temperature Side and Low-Temperature Side) | | m | 1.80 | | | | 1.80 | | | |
| Pressure Loss | High-Temperature Side $d_{PE1}$ | kPa | 38.6 | | | | 51.7 | | | |
| | Low-Temperature Side $d_{PE2}$ | kPa | — | | | | 52.7 | | | |
| | Total $d_{PE}$ | kPa | 38.6 | | | | 104.4 | | | |
| Low-Temperature Fluid Pressure Loss in Condenser | | | | | | | | | | |
| Representative Flow Rate (Commonly used on High-Temperature Side and Low-Temperature Side) | | m/s | 0.517 | | | | 0.940 | | | |
| Flow Channel Length (Commonly used on High-Temperature Side and Low-Temperature Side) | | m | 1.20 | | | | 1.20 | | | |
| Pressure Loss | High-Temperature Side $d_{PC1}$ | kPa | 26.4 | | | | 59.4 | | | |
| | Low-Temperature Side $d_{PC2}$ | kPa | — | | | | 62.2 | | | |
| | Total $d_{PC}$ | kPa | 26.4 | | | | 121.6 | | | |
| Self-Consumption Power of High-Temperature Fluid Pump (Input Heat Amount Ratio) | | % | 0.24 | | | | 0.64 | | | |
| Self-Consumption Power of Low-Temperature Fluid Pump (Input Heat Amount Ratio) | | % | 0.11 | | | | 0.49 | | | |
| Self-Consumption Power of Working Fluid Pump (Input Heat Amount Ratio) | | % | 0.03 | | | | 0.03 | | | |
| Self Consumption Power/Turbine Power | | % | 11.1 | | | | 28.0 | | | |
| (Turbine Power − Self-Consumption power)/Input Heat Amount | | % | 2.98 | | | | 2.99 | | | |

TABLE 3

APPENDIX A

| Item | | Unit | Example No. 4 for Comparison | Example No. 2 for Comparison |
|---|---|---|---|---|
| System Configuration | | | Without Heat Recovery | With Heat Recovery |
| Heat Source Conditions | | | | |
| High-Temperature Fluid | Inlet Temperature $T_{WSI}$ | ° C. | 28.0 | 28.0 |
| | Intermediate Temperature $T_{WSM}$ | ° C. | 26.0 | 26.0 |
| | Outlet Temperature $T_{WSO}$ | ° C. | 24.0 | 24.0 |
| | Specific Heat $Cp_{WS}$ | kJ/kgK | 4.0 | 4.0 |
| | Flow Rate $G_{WS}$ | t/h | 10000 | 10000 |
| Low-Temperature Fluid | Inlet Temperature $T_{CSI}$ | ° C. | 4.0 | 4.0 |
| | Intermediate Temperature $T_{CSM}$ | ° C. | 7.0 | 7.0 |
| | Outlet Temperature $T_{CSO}$ | ° C. | 10.0 | 10.0 |
| | Specific Heat $Cp_{CS}$ | kJ/kgK | 4.0 | 4.0 |
| | Flow Rate $G_{CS}$ | t/h | 6400 | 6390 |

TABLE 3-continued

| | | | | | | | | | |
|---|---|---|---|---|---|---|---|---|---|
| Cycle | | | Dual Stage Rankine | | | | Dual Stage Rankine | | |
| Working Fluid Conditions | | | | | | | | | |
| Material | | | Pentane | | | | Pentane | | |
| | | | P (MPaA) | T (° C. ) | H (kJ/kgK) | S (kJ/kg) | P (MPaA) | T (° C. ) | H (kJ/kgK) | S (kJ/kg) |
| Temperature/ Specific Enthalpy of Each Portion | 1 | | 0.041 | 13.8 | 323.4 | 1.142 | 0.041 | 13.8 | 323.4 | 1.142 |
| | 2 | | 0.041 | 12.0 | −55.7 | −0.187 | 0.041 | 12.0 | −55.7 | −0.187 |
| | 3 | | 0.066 | 12.0 | −55.6 | −0.187 | 0.066 | 12.0 | −55.6 | −0.187 |
| | 4 | | 0.066 | 24.0 | 338.8 | 1.142 | 0.066 | 24.0 | 338.8 | 1.142 |
| | 5 | | 0.036 | 10.8 | 318.8 | 1.140 | 0.036 | 10.8 | 318.8 | 1.140 |
| | 6 | | 0.061 | 9.0 | −62.4 | −0.211 | 0.061 | 9.0 | −62.4 | −0.211 |
| | 7 | | 0.061 | 9.0 | −62.4 | −0.211 | 0.061 | 9.0 | −62.4 | −0.211 |
| | 8 | | 0.061 | 22.0 | 335.7 | 1.140 | 0.061 | 22.0 | 335.7 | 1.140 |
| | 9 | | — | — | — | — | 0.061 | 12.0 | 313.1 | 1.106 |
| | 10 | | — | — | — | — | 0.061 | 13.6 | −52.1 | −0.175 |
| Flow Rate | High-Temperature Side $G_{WF1}$ | t/h | 203 | | | | 203 | | | |
| | Low-Temperature Side $G_{WF2}$ | t/h | 201 | | | | 206 | | | |
| Heat Efficiency of Cycle ((Turbine Output $W_T$ − Working Fluid Pump Consumption Power $W_{PWF}$)/Amount of Heat Input $Q_E$) | | % | 4.07 | | | | 4.13 | | | |

20

TABLE 4

APPENDIX A

| Item | | Unit | Example No. 3 of the Invention | | | |
|---|---|---|---|---|---|---|
| System Configuration | | | Dryness Operation by Gas-Liquid Separation | | | |
| Heat Source Conditions | | | | | | |
| High-Temperature Fluid | Inlet Temperature $T_{WSI}$ | ° C. | 28.0 | | | |
| | Intermediate Temperature $T_{WSM}$ | ° C. | 26.0 | | | |
| | Outlet Temperature $T_{WSO}$ | ° C. | 24.0 | | | |
| | Specific Heat $Cp_{WS}$ | kJ/kgK | 4.0 | | | |
| | Flow Rate $G_{WS}$ | t/h | 10000 | | | |
| Low-Temperature Fluid | Inlet Temperature $T_{CSI}$ | ° C. | 4.0 | | | |
| | Intermediate Temperature $T_{CSM}$ | ° C. | 7.0 | | | |
| | Outlet Temperature $T_{CSO}$ | ° C. | 10.0 | | | |
| | Specific Heat $CP_{CS}$ | kJ/kgK | 4.0 | | | |
| | Flow Rate $G_{CS}$ | t/h | 6400 | | | |
| Cycle | | | Dual Stage Rankine | | | |
| Working Fluid Conditions | | | | | | |
| Material | | | Ammonia | | | |
| | | | P (MPaA) | T (° C.) | H (kJ/kgK) | S (kJ/kg) |
| Temperature/ Specific Enthalpy of Each Portion | 1 | | 0.659 | 12.0 | 1577.1 | 5.802 |
| | 2 | | 0.659 | 12.0 | 399.1 | 1.671 |
| | 3 | | 0.973 | 12.1 | 399.6 | 1.671 |
| | 4 | | 0.973 | 24.0 | 1626.0 | 5.802 |
| | 5 | | 0.594 | 9.0 | 1570.9 | 5.824 |
| | 6 | | 0.594 | 9.0 | 385.0 | 1.622 |
| | 7 | | 0.914 | 9.1 | 385.5 | 1.622 |
| | 8 | | 0.914 | 22.0 | 1624.7 | 5.824 |
| | 11 | | 0.973 | 15.5 | 415.7 | 1.727 |
| | 12 | | 0.973 | 24.0 | 1158.0 | 5.959 |
| | 13 | | 0.973 | 24.0 | 456.0 | 1.865 |
| | 14 | | 0.914 | 12.8 | 403.0 | 1.683 |
| | 15 | | 0.914 | 22.0 | 1153.4 | 5.687 |
| | 16 | | 0.914 | 22.0 | 446.5 | 1.833 |
| Flow Rate | High-Temperature Side $G_{WF1}$ | t/h | 65.2 | | | |
| | Low-Temperature Side $G_{WF2}$ | t/h | 64.6 | | | |
| Evaporator Performance | | | | | | |
| High-Temperature Fluid | | | Seawater | | | |
| Dryness of Working Fluid at an Output of Evaporator | | kg/kg | 0.6 | | | |
| Flow Rate between High-Temperature Fluid and Working Fluid | | kg/kg | 93:1 | | | |
| Representative Flow Rate (Mass Flux) | High-Temperature Fluid Side | m/s | 0.530 | | | |
| | Working Fluid Side | $kg/m^2s$ | 16.0 | | | |
| Heat Transfer Coefficient | High-Temperature Fluid Side | $W/m^2K$ | 9,460 | | | |
| | Working Fluid Side | $W/m^2K$ | 10,300 | | | |
| Overall Heat Transfer Coefficient | | $W/m^2K$ | 3,660 | | | |

TABLE 5

APPENDIX A

| Item | | Unit | Example No. 5 for Comparison | | | | Example No. 6 for Comparison | | | |
|---|---|---|---|---|---|---|---|---|---|---|
| System Configuration | | | No Dryness Operation by Gas-Liquid Separation | | | | No Dryness Operation by Gas-Liquid Separation | | | |
| Heat Source Conditions | | | | | | | | | | |
| High-Temperature Fluid | Inlet Temperature $T_{WSI}$ | ° C. | 28.0 | | | | 28.0 | | | |
| | Intermediate Temperature $T_{WSM}$ | ° C. | — | | | | 26.0 | | | |
| | Outlet Temperature $T_{WSO}$ | ° C. | 24.0 | | | | 24.0 | | | |
| | Specific Heat $Cp_{WS}$ | kJ/kgK | 4.0 | | | | 4.0 | | | |
| | Flow Rate $G_{WS}$ | t/h | 10000 | | | | 10000 | | | |
| Low-Temperature Fluid | Inlet Temperature $T_{CSI}$ | ° C. | 4.0 | | | | 4.0 | | | |
| | Intermediate Temperature $T_{CSM}$ | ° C. | — | | | | 7.0 | | | |
| | Outlet Temperature $T_{CSO}$ | ° C. | 10.0 | | | | 10.0 | | | |
| | Specific Heat $Cp_{CS}$ | kJ/kgK | 4.0 | | | | 4.0 | | | |
| | Flow Rate $G_{CS}$ | t/h | 6400 | | | | 6400 | | | |
| Cycle | | | Single Stage Rankine | | | | Dual Stage Rankine | | | |
| Working Fluid Conditions | | | | | | | | | | |
| Material | | | Ammonia | | | | Ammonia | | | |
| | | | P (MPaA) | T (° C. ) | H (kJ/kgK) | S (kJ/kg) | P (MPaA) | T (° C. ) | H (kJ/kgK) | S (kJ/kg) |
| Temperature/ Specific Enthalpy of Each Portion | 1 | | 0.659 | 12.0 | 1583.5 | 5.824 | 0.659 | 12.0 | 1577.1 | 5.802 |
| | 2 | | 0.659 | 12.0 | 399.1 | 1.671 | 0.659 | 12.0 | 399.1 | 1.671 |
| | 3 | | 0.914 | 12.1 | 399.5 | 1.671 | 0.973 | 12.1 | 399.6 | 1.671 |
| | 4 | | 0.914 | 22.0 | 1624.7 | 5.824 | 0.973 | 24.0 | 1626.0 | 5.802 |
| | 5 | | — | — | — | — | 0.594 | 9.0 | 1570.9 | 5.824 |
| | 6 | | — | — | — | — | 0.594 | 9.0 | 385.0 | 1.622 |
| | 7 | | — | — | — | — | 0.914 | 9.1 | 385.5 | 1.622 |
| | 8 | | — | — | — | — | 0.914 | 22.0 | 1624.7 | 5.824 |
| | 11 | | — | — | — | — | — | — | — | — |
| | 12 | | — | — | — | — | — | — | — | — |
| | 13 | | — | — | — | — | — | — | — | — |
| | 14 | | — | — | — | — | — | — | — | — |
| | 15 | | — | — | — | — | — | — | — | — |
| | 16 | | — | — | — | — | — | — | — | — |
| Flow Rate | High-Temperature Side $G_{WF1}$ | t/h | 131.0 | | | | 65.2 | | | |
| | Low-Temperature Side $G_{WF2}$ | t/h | — | | | | 64.6 | | | |
| Evaporator Performance | | | | | | | | | | |
| High-Temperature Fluid | | | Seawater | | | | Seawater | | | |
| Dryness of Working Fluid at Inlet of Evaporator | | kg/kg | ≠1 | | | | ≠1 | | | |
| Flow Rate Ratio between High-Temperature Fluid and Working Medium | | kg/kg | 77:1 | | | | 154:1 | | | |
| Representative Flow Rate (Mass Flux) | High-Temperature Fluid Side | m/s | 0.221 | | | | 0.342 | | | |
| | Working Fluid Side | $kg/m^2s$ | 9.86 | | | | 7.70 | | | |
| Heat Transfer Coefficient | High-Temperature Fluid Side | $W/m^2K$ | 5,460 | | | | 7,340 | | | |
| | Working Fluid Side | $W/m^2K$ | 3,830 | | | | 3,190 | | | |
| Overall Heat Transfer Coefficient | | $W/m^2K$ | 1,940 | | | | 1,920 | | | |

TABLE 6

APPENDIX A

| Item | | Unit | Example No. 7 for Comparison | Example No. 4 of the Invention |
|---|---|---|---|---|
| System Configuration | | | Without Heat Recovery (=Example No. 3 of the Invention) | With Heat Recovery |
| Heat Source Conditions | | | | |
| High-Temperature Fluid | Inlet Temperature $T_{WSI}$ | ° C. | 28.0 | 28.0 |
| | Intermediate Temperature $T_{WSM}$ | ° C. | 26.0 | 26.0 |
| | Outlet Temperature $T_{WSO}$ | ° C. | 24.0 | 24.0 |
| | Specific Heat $Cp_{WS}$ | kJ/kgK | 4.0 | 4.0 |
| | Flow Rate $G_{WS}$ | t/h | 10000 | 10000 |
| Low-Temperature Fluid | Inlet Temperature $T_{CSI}$ | ° C. | 4.0 | 4.0 |
| | Intermediate Temperature $T_{CSM}$ | ° C. | 7.0 | 7.0 |
| | Outlet Temperature $T_{CSO}$ | ° C. | 10.0 | 10.0 |
| | Specific Heat $Cp_{CS}$ | kJ/kgK | 4.0 | 4.0 |
| | Flow Rate $G_{CS}$ | t/h | 6400 | 6400 |

TABLE 6-continued

| Cycle | | | Dual Stage Rankine | | | | Dual Stage Rankine | | | |
|---|---|---|---|---|---|---|---|---|---|---|
| Working Fluid Conditions | | | | | | | | | | |
| Material | | | Ammonia | | | | Ammonia | | | |
| | | | P (MPaA) | T (° C. ) | H (kJ/kgK) | S (kJ/kg) | P (MPaA) | T (° C. ) | H (kJ/kgK) | S (kJ/kg) |
| Temperature/ Specific Enthalpy of Each Portion | 1 | | 0.659 | 12.0 | 1577.1 | 5.802 | 0.659 | 12.0 | 1577.1 | 5.802 |
| | 2 | | 0.659 | 12.0 | 399.1 | 1.671 | 0.659 | 12.0 | 399.1 | 1.671 |
| | 3 | | 0.973 | 12.1 | 399.6 | 1.671 | 0.973 | 12.1 | 399.6 | 1.671 |
| | 4 | | 0.973 | 24.0 | 1626.0 | 5.802 | 0.973 | 24.0 | 1626.0 | 5.802 |
| | 5 | | 0.594 | 9.0 | 1570.9 | 5.824 | 0.594 | 9.0 | 1570.9 | 5.824 |
| | 6 | | 0.594 | 9.0 | 385.0 | 1.622 | 0.594 | 9.0 | 385.0 | 1.622 |
| | 7 | | 0.914 | 9.1 | 385.5 | 1.622 | 0.914 | 9.1 | 385.5 | 1.622 |
| | 8 | | 0.914 | 22.0 | 1624.7 | 5.824 | 0.914 | 22.0 | 1624.7 | 5.824 |
| | 11 | | 0.973 | 15.5 | 415.7 | 1.727 | 0.973 | 18.1 | 427.8 | 1.769 |
| | 12 | | 0.973 | 24.0 | 1158.0 | 5.959 | 0.973 | 24.0 | 1158.0 | 5.959 |
| | 13 | | 0.973 | 24.0 | 456.0 | 1.865 | 0.973 | 24.0 | 456.0 | 1.865 |
| | 14 | | 0.914 | 12.8 | 403.0 | 1.683 | 0.914 | 10.2 | 390.9 | 1.640 |
| | 15 | | 0.914 | 22.0 | 1153.4 | 5.687 | 0.914 | 22.0 | 1153.4 | 5.687 |
| | 16 | | 0.914 | 22.0 | 446.5 | 1.833 | 0.914 | 22.0 | 446.5 | 1.833 |
| | 17 | | — | — | — | — | 0.973 | 15.7 | 416.5 | 1.730 |
| | 18 | | — | — | — | — | 0.914 | 13.1 | 404.3 | 1.687 |
| Flow Rate | High-Temperature Side $G_{WF1}$ | t/h | 65.2 | | | | 66.3 | | | |
| | Low-Temperature Side $G_{WF2}$ | t/h | 64.6 | | | | 63.6 | | | |
| Dryness of Working Fluid at Outlet of Evaporator | | kg/kg | 0.6 | | | | 0.6 | | | |
| Heat Efficiency of Cycle ((Turbine Output $W_T$ − Working Fluid Pump Consumption Power $W_{PWF}$)/Amount of Heat Input $Q_E$) | | % | 4.12 | | | | 4.13 | | | |

What is claimed is:

1. A steam power cycle system comprising:

a plurality of steam power cycle units, each steam power cycle unit comprising:

an evaporator that causes a working fluid in a liquid phase to make heat exchange with a predetermined high-temperature fluid and evaporates said working fluid;

an expander that receives the working fluid as introduced in a gas phase, which has been obtained by said evaporator, to convert heat energy held by the working fluid into a power;

a condenser that causes the working fluid in a gas phase from said expander to make heat exchange with a predetermined low-temperature fluid and condenses it; and a pump that pumps the working fluid in a liquid phase from said condenser toward said evaporator, wherein:

said plurality of steam power cycle units has a connection structure in which flow channels for the high-temperature fluid in the respective evaporator are interconnected in series to each other, flow channels for the low-temperature fluid in the respective condenser are interconnected in series to each other, and a passing order for the high-temperature fluid and the low-temperature fluid in the respective steam power cycle unit is set as an inverse or same order between the high-temperature fluid and the low-temperature fluid;

each evaporator in the respective steam power cycle unit of the plurality of steam power cycle units comprises a cross-flow heat exchanger in which a flowing direction of the working fluid crosses a flowing direction of the high-temperature fluid, said heat exchanger having a structure in which a cross-sectional area of the flow channel for the high-temperature fluid is larger than that for the working fluid, and a length of the flow channel for the high-temperature fluid is smaller than that for the working fluid, and the evaporators are placed in a flowing direction of the high-temperature fluid;

each condenser in the respective steam power cycle unit of the plurality of steam power cycle units comprises a cross-flow heat exchanger in which a flowing direction of the working fluid crosses a flowing direction of the low-temperature fluid, said heat exchanger having a structure in which a cross-sectional area of the flow channel for the low-temperature fluid is larger than that for the working fluid, and a length of the flow channel for the low-temperature fluid is smaller than that for the working fluid, and the condensers are placed in a flowing direction of the low-temperature fluid;

the evaporators of the plurality of steam power cycle units are disposed in proximity to each other in a flowing direction of the high-temperature fluid and are interconnected by a first channel, each evaporator having a heat exchanging body, wherein respective heat exchanging bodies are fixedly connected to each other such that opening ends of the flow channels for the high-temperature fluid face each other, and the respective heat exchanging bodies of the evaporators are interconnected by the first channel having a hollow structure disposed there between, the respective heat exchanging bodies being aligned so that the flowing directions of the high-temperature fluid in the respective heat exchanging bodies are in parallel with each other; and the condensers of the plurality of steam power cycle units are disposed in proximity to each other in a flowing direction of the low-temperature fluid and are interconnected by a second channel, each condenser having a heat exchanging body, wherein respective heat exchanging bodies are fixedly connected to each other such that opening ends of the flow channels for the low-temperature fluid face each other, and the respective heat exchanging bodies of the condensers are interconnected by the second channel having a hollow structure disposed there between, the respective heat exchanging bodies being aligned so that the flowing directions of the low-temperature fluid in the respective heat exchanging bodies are in parallel with each other.

2. The steam power cycle system as claimed in claim 1, further comprises:

a preheating heat exchanger that causes the working fluid flowing from an outlet of the expander of a first steam power cycle unit of the plurality of steam power cycle units toward the condenser of the first steam power cycle unit of the plurality of steam power cycle units to exchange heat with the working fluid flowing from an outlet of the pump of a second steam power cycle unit of the plurality of steam power cycle units toward the evaporator of the second steam power cycle unit of the plurality of steam power cycle units.

3. The steam power cycle system as claimed in claim 1, each steam power cycle unit further comprises:

a gas-liquid separator that separates the working fluid from said evaporator into a gas phase substance and a liquid phase substance, supplies the gas phase substance toward the expander, and supplies the liquid phase substance toward an inlet side of the evaporator.

4. The steam power cycle system as claimed in claim 1, wherein:

each of the evaporator and the condenser in the respective steam power cycle unit comprises a heat exchanging body in which respective heat exchanging plates are formed of metallic thin plates having a rectangular shape, a first heat exchanging plate is placed in parallel and in abutting contact with a second heat exchanging plate which are welded to each other at a first end side where the first heat exchanging plate and the second heat exchanging plate abut and at a second end side where the first exchanging plate and the second heat exchanging plate abut opposite the first end side, the first end side and second end side are in parallel with each other, in a water-tight manner, and the first heat exchanging plate is placed in parallel and in abutting contact with a third heat exchanging plate which are welded to each other at other at a third end side where the first heat exchanging plate and the third heat exchanging plate abut and at a fourth end side where the first exchanging plate and the third heat exchanging plate abut, opposite the third end side the third end side and the fourth end side are in parallel with each other and perpendicular to said first end side and second end side in a water-tight manner, to form a united body, and the flow channels for the working fluid flows and the flow channels for the high-temperature fluid or the low-temperature fluid flows are provided alternately between the respective heat exchanging plates.

5. The steam power cycle system as claimed in claim 2, each steam power cycle unit further comprises:

a gas-liquid separator that separates the working fluid from said evaporator into a gas phase substance and a liquid phase substance, supplies the gas phase substance toward the expander, and supplies the liquid phase substance toward an inlet side of the evaporator.

6. The steam power cycle system as claimed in claim 3, further comprises:

a regenerative heat exchanger that causes the working fluid in the liquid phase substance flowing from the gas-liquid separator toward an inlet side of the evaporator in a predetermined steam power cycle unit to make heat exchange with the working fluid flowing from an outlet of the pump toward the evaporator in another steam power cycle unit than said predetermined steam power cycle unit.

7. The steam power cycle system as claimed in claim 5, further comprises:

a regenerative heat exchanger that causes the working fluid in the liquid phase substance flowing from the gas-liquid separator of the second steam power cycle toward an inlet side of the evaporator in the second steam power cycle unit to exchange heat with the working fluid flowing from an outlet of the pump toward the evaporator in the first steam power cycle unit.

8. The steam power cycle system as claimed in claim 2, wherein:

each of the evaporator and the condenser in the respective steam power cycle unit comprises a heat exchanging body in which respective heat exchanging plates are formed of metallic thin plates having a rectangular shape, a first heat exchanging plate is placed in parallel and in abutting contact with a second heat exchanging plate which are welded to each other at a first end side where the first heat exchanging plate and the second heat exchanging plate abut and at a second end side where the first exchanging plate and the second heat exchanging plate abut opposite the first end side, the first end side and second end side are in parallel with each other, in a water-tight manner, and the first heat exchanging plate is placed in parallel and in abutting contact with a third heat exchanging plate which are welded to each other at other at a third end side where the first heat exchanging plate and the third heat exchanging plate abut and at a fourth end side where the first exchanging plate and the third heat exchanging plate abut, opposite the third end side, the third end side and the fourth end side are in parallel with each other and perpendicular to said first end side and second end side in a water-tight manner, to form a united body, and the flow channels for the working fluid flows and the flow channels for the high-temperature fluid or the low-temperature fluid flows are provided alternately between the respective heat exchanging plates.

9. The steam power cycle system as claimed in claim 3, wherein:

each of the evaporator and the condenser in the respective steam power cycle unit comprises a heat exchanging body in which respective heat exchanging plates are formed of metallic thin plates having a rectangular shape, a first heat exchanging plate is placed in parallel and in abutting contact with a second heat exchanging plate which are welded to each other at a first end side where the first heat exchanging plate and the second heat exchanging plate abut and at a second end side where the first exchanging plate and the second heat exchanging plate abut opposite the first end side, the first end side and second end side are in parallel with each other, in a water-tight manner, and the first heat exchanging plate is placed in parallel and in abutting contact with a third heat exchanging plate which are welded to each other at other at a third end side where the first heat exchanging plate and the third heat exchanging plate abut and at a fourth end side where the first exchanging plate and the third heat exchanging plate abut, opposite the third end side, the third end side and the fourth end side are in parallel with each other and perpendicular to said first end side and second end side in a water-tight manner, to form a united body, and the flow channels for the working fluid flows and the flow channels for the high-temperature fluid or the low-temperature fluid flows are provided alternately between the respective heat exchanging plates.

10. The steam power cycle system as claimed in claim 5, wherein:

each of the evaporator and the condenser in the respective steam power cycle unit comprises a heat exchanging body in which respective heat exchanging plates are formed of metallic thin plates having a rectangular shape, a first heat exchanging plate is placed in parallel and in abutting contact with a second heat exchanging plate which are welded to each other at a first end side where the first heat exchanging plate and the second heat exchanging plate abut and at a second end side where the first exchanging plate and the second heat exchanging plate abut opposite the first end side, the first end side and second end side are in parallel with each other, in a water-tight manner, and the first heat exchanging plate is placed in parallel and in abutting contact with a third heat exchanging plate which are welded to each other at other at a third end side where the first heat exchanging plate and the third heat exchanging plate abut and at a fourth end side where the first exchanging plate and the third heat exchanging plate abut, opposite the third end side, the third end side and the fourth end side are in parallel with each other and perpendicular to said first end side and second end side in a water-tight manner, to form a united body, and the flow channels for the working fluid flows and the flow channels for the high-temperature fluid or the low-temperature fluid flows are provided alternately between the respective heat exchanging plates.

11. The steam power cycle system as claimed in claim 6, wherein:

each of the evaporator and the condenser in the respective steam power cycle unit comprises a heat exchanging body in which respective heat exchanging plates are formed of metallic thin plates having a rectangular shape, a first heat exchanging plate is placed in parallel and in abutting contact with a second heat exchanging plate which are welded to each other at a first end side where the first heat exchanging plate and the second heat exchanging plate abut and at a second end side where the first exchanging plate and the second heat exchanging plate abut opposite the first end side, the first end side and second end side are in parallel with each other, in a water-tight manner, and the first heat exchanging plate is placed in parallel and in abutting contact with a third heat exchanging plate which are welded to each other at other at a third end side where the first heat exchanging plate and the third heat exchanging plate abut and at a fourth end side where the first exchanging plate and the third heat exchanging plate abut, opposite the third end side, the third end side and the fourth end side are in parallel with each other and perpendicular to said first end side and second end side in a water-tight manner, to form a united body, and the flow channels for the working fluid flows and the flow channels for the high-temperature fluid or the low-temperature fluid flows are provided alternately between the respective heat exchanging plates.

12. The steam power cycle system as claimed in claim 7, wherein:

each of the evaporator and the condenser in the respective steam power cycle unit comprises a heat exchanging body in which respective heat exchanging plates are formed of metallic thin plates having a rectangular shape, a first heat exchanging plate is placed in parallel and in abutting contact with a second heat exchanging plate which are welded to each other at a first end side where the first heat exchanging plate and the second heat exchanging plate abut and at a second end side where the first exchanging plate and the second heat exchanging plate abut opposite the first end side, the first end side and second end side are in parallel with each other, in a water-tight manner, and the first heat exchanging plate is placed in parallel and in abutting contact with a third heat exchanging plate which are welded to each other at other at a third end side where the first heat exchanging plate and the third heat exchanging plate abut and at a fourth end side where the first exchanging plate and the third heat exchanging plate abut, opposite the third end side, the third end side and the fourth end side are in parallel with each other and perpendicular to said first end side and second end side in a water-tight manner, to form a united body, and the flow channels for the working fluid flows and the flow channels for the high-temperature fluid or the low-temperature fluid flows are provided alternately between the respective heat exchanging plates.

13. A steam power cycle system comprising:

a plurality of steam power cycle units, each steam power cycle unit comprising:

an evaporator that causes a working fluid in a liquid phase to make heat exchange with a predetermined high-temperature fluid and evaporates said working fluid;

an expander that receives the working fluid as introduced in a gas phase, which has been obtained by said evaporator, to convert heat energy held by the working fluid into a power;

a condenser that causes the working fluid in a gas phase from said expander to make heat exchange with a predetermined low-temperature fluid and condenses it;

a pump that pumps the working fluid in a liquid phase from said condenser toward said evaporator;

a gas-liquid separator that separates the working fluid from said evaporator into a gas phase substance and a liquid phase substance, supplies the gas phase substance toward the expander, and supplies the liquid phase substance toward an inlet side of the evaporator; and wherein the steam power cycle system cycle further comprises:

a regenerative heat exchanger that causes the working fluid in the liquid phase substance flowing from the gas-liquid separator toward an inlet side of the evaporator in a predetermined steam power cycle unit to exchange heat with the working fluid flowing from an outlet of the pump toward the evaporator in another steam power cycle unit than said predetermined steam power cycle unit, said plurality of steam power cycle units has a connection structure in which flow channels for the high-temperature fluid in the respective evaporator are interconnected in series to each other, flow channels for the low-temperature fluid in the respective condenser are interconnected in series to each other, and a passing order for the high-temperature fluid and the low-temperature fluid in the respective steam power cycle unit is set as an inverse or same order between the high-temperature fluid and the low-temperature fluid;

said plurality of steam power cycle units has a connection structure in which flow channels for the high-temperature fluid in the respective evaporator are interconnected in series to each other, flow channels for the low-temperature fluid in the respective condenser are interconnected in series to each other, and a passing order for the high-temperature fluid and the low-temperature fluid in the respective steam power cycle unit is set as an inverse or same order between the high-temperature fluid and the low-temperature fluid;

each evaporator in the respective steam power cycle unit of the plurality of steam power cycle units comprises a cross-flow heat exchanger in which a flowing direction of the working fluid crosses a flowing direction of the high-temperature fluid, said heat exchanger having a structure in which a cross-sectional area of the flow channel for the high-temperature fluid is larger than that for the working fluid, and a length of the flow channel for the high-temperature fluid is smaller than that for the working fluid, and the evaporators are placed in a flowing direction of the high-temperature fluid; and each condenser in the respective steam power cycle unit of the plurality of steam power cycle units comprises a cross-flow heat exchanger in which a flowing direction of the working fluid crosses a flowing direction of the low-temperature fluid, said heat exchanger having a structure in which a cross-sectional area of the flow channel for the low-temperature fluid is larger than that for the working fluid, and a length of the flow channel for the low-temperature fluid is smaller than that for the working fluid, and the condensers are placed in a flowing direction of the low-temperature fluid.

14. A steam power cycle system comprising:

a plurality of steam power cycle units, each steam power cycle unit comprising:

an evaporator that causes a working fluid in a liquid phase to make heat exchange with a predetermined high-temperature fluid and evaporates said working fluid;

an expander that receives the working fluid as introduced in a gas phase, which has been obtained by said evaporator, to convert heat energy held by the working fluid into a power;

a condenser that causes the working fluid in a gas phase from said expander to make heat exchange with a predetermined low-temperature fluid and condenses it;

a pump that pumps the working fluid in a liquid phase from said condenser toward said evaporator; and a pump that pumps the working fluid in a liquid phase from said condenser toward said evaporator; and a gas-liquid separator that separates the working fluid from said evaporator into a gas phase substance and a liquid phase substance, supplies the gas phase substance toward the expander, and supplies the liquid phase substance toward an inlet side of the evaporator;

wherein the steam power cycle system further comprises:

a preheating heat exchanger that causes the working fluid flowing from an outlet of the expander of a predetermined steam power cycle unit of the plurality of steam power cycle units toward the condenser of the predetermined steam power cycle unit of the plurality of steam power cycle units to exchange heat with the working fluid flowing from an outlet of the pump of another steam power cycle unit of the plurality of steam power cycle units toward the evaporator of the another steam power cycle unit of the plurality of steam power cycle units;

a regenerative heat exchanger that causes the working fluid in a liquid phase flowing from the gas-liquid separator toward an inlet side of the evaporator in the predetermined steam power cycle unit to exchange heat with the working fluid flowing from an outlet of the pump toward the evaporator in the another steam power cycle unit than said predetermined steam power cycle unit, said plurality of steam power cycle units has a connection structure in which flow channels for the high-temperature fluid in the respective evaporator are interconnected in series to each other, flow channels for the low-temperature fluid in the respective condenser are interconnected in series to each other, and a passing order for the high-temperature fluid and the low-temperature fluid in the respective steam power cycle unit is set as an inverse or same order between the high-temperature fluid and the low-temperature fluid;

each evaporator in the respective steam power cycle unit of the plurality of steam power cycle units comprises a cross-flow heat exchanger in which a flowing direction of the working fluid crosses a flowing direction of the high-temperature fluid, said heat exchanger having a structure in which a cross-sectional area of the flow channel for the high-temperature fluid is larger than that for the working fluid, and a length of the flow channel for the high-temperature fluid is smaller than that for the working fluid, and the evaporators are placed in a flowing direction of the high-temperature fluid; and each condenser in the respective steam power cycle unit of the plurality of steam power cycle units comprises a cross-flow heat exchanger in which a flowing direction of the working fluid crosses a flowing direction of the low-temperature fluid, said heat exchanger having a structure in which a cross-sectional area of the flow channel for the low-temperature fluid is larger than that for the working fluid, and a length of the flow channel for the low-temperature fluid is smaller than that for the working fluid, and the condensers are placed in a flowing direction of the low-temperature fluid.

* * * * *